US008019258B2

(12) United States Patent
Nishida et al.

(10) Patent No.: US 8,019,258 B2
(45) Date of Patent: Sep. 13, 2011

(54) DEVELOPING APPARATUS

(75) Inventors: Shinichi Nishida, Mishima (JP); Katsunori Yokoyama, Susono (JP); Yasushi Shimizu, Suntou-gun (JP); Kazunari Hagiwara, Numazu (JP); Katsuhiro Sakaizawa, Numazu (JP); Rie Endo, Ashigarakami-gun (JP); Naoto Kichijima, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/904,007

(22) Filed: Oct. 13, 2010

(65) Prior Publication Data

US 2011/0026978 A1 Feb. 3, 2011

Related U.S. Application Data

(63) Continuation of application No. 11/766,507, filed on Jun. 21, 2007, now Pat. No. 7,840,168.

(30) Foreign Application Priority Data

Jun. 23, 2006 (JP) ..... 2006-174138
Aug. 10, 2006 (JP) ..... 2006-219058

(51) Int. Cl.
*G03G 15/09* (2006.01)
*G03G 15/08* (2006.01)

(52) U.S. Cl. ..... 399/274; 399/273; 399/283; 399/284

(58) Field of Classification Search ..... 399/284, 399/273, 274, 283
See application file for complete search history.

(56) References Cited

U.S. PATENT DOCUMENTS

| | | | | |
|---|---|---|---|---|
| 5,640,648 | A * | 6/1997 | Komakine et al. | 399/103 |
| 7,463,854 | B2 * | 12/2008 | Nishida et al. | 399/284 |
| 2008/0310886 | A1 * | 12/2008 | Shimizu et al. | 399/274 |

FOREIGN PATENT DOCUMENTS

| | | | |
|---|---|---|---|
| JP | 2-154283 | A | 6/1990 |
| JP | 06149032 | A * | 5/1994 |
| JP | 6-250509 | A | 9/1994 |
| JP | 06250509 | A * | 9/1994 |
| JP | 8-137248 | A | 5/1996 |
| JP | 2000-019840 | A | 1/2000 |
| JP | 2000-206776 | A | 7/2000 |

* cited by examiner

*Primary Examiner* — David Gray
*Assistant Examiner* — Francis Gray
(74) *Attorney, Agent, or Firm* — Canon USA Inc IP Division

(57) ABSTRACT

An amount-of-developer regulating apparatus configured to restrict the amount of developer carried on a developer bearing member. The amount-of-developer regulating apparatus includes a flexible developer amount regulation member having a contact portion configured to contact with a developer bearing member, and first and second holding portions configured to hold the developer amount regulation member and to contact with the developer amount regulation member at further upstream and further downstream in a direction where the developer bearing member is rotationally moved than the contact portion. With a pressure distribution of the contact portion as to the developer bearing member, there are a plurality of local maximum values in the direction where the developer bearing member is rotationally moved. Thus, the apparatus can be reduced in size, and also image concentration unevenness after long-term use can be prevented.

7 Claims, 26 Drawing Sheets

PUSH-IN AMOUNT: NONE

PUSH-IN AMOUNT: SMALL

PUSH-IN AMOUNT: GREAT

PUSH-IN AMOUNT: NONE

PUSH-IN AMOUNT: SMALL

PUSH-IN AMOUNT: GREAT

DEVELOPING APPARATUS

CROSS-REFERENCE TO RELATED APPLICATIONS

This application is a continuation of U.S. patent application Ser. No. 11/766,507 filed Jun. 21, 2007, which claims the benefit of Japanese Application No. 2006-174138 filed Jun. 23, 2006 and No. 2006-219058 filed Aug. 10, 2006, all of which are hereby incorporated by reference herein in their entirety.

BACKGROUND OF THE INVENTION

1. Field of the Invention

The present invention relates to a developing apparatus employed for an image forming apparatus employing an electro-photography method or electrostatic recording method, for example.

2. Description of the Related Art

As for a developing method employing monocomponent toner serving as an existing developer, a contact developing method and a non-contact developing method have been widely employed. Specifically, (1) Contact developing method employing a developing roller serving as a developer bearing member having an elastic layer, (2) Non-contact developing method with nonmagnetic toner employing a developing roller serving as a developer bearing member including a metal sleeve or elastic layer, (3) Non-contact method with magnetic toner employing a metal sleeve serving as a developing bearing member, and so forth, have been proposed. As for a developer amount regulation member configured to regulate the amount of developer to subject monocomponent toner to thin-layer formation on a developer bearing member as to those developing methods, several measures have been proposed.

(1) Contact Developing Method Employing Developing Roller Having Elastic Layer (FIG. 10)

A method has been widely known wherein developing is performed by bearing nonmagnetic developer on a developing roller 3 serving as an elastic roller having a dielectric layer, and making this contact with a photosensitive drum 1. Supply of a developer to the developing roller 3 is performed by a supply roller 5 which is in contact with the developing roller 3. The supply roller 5 includes a function of transporting a developer from within a developer container T, making the developer adhere to the developing roller 3, and temporarily eliminating the developer remaining on the developing roller 3.

The application of charge due to the layer regulation and frictional charge of a developer adhered to the developing roller 3 is performed by causing a developer amount regulation member 4-*c* to make contact with the developing roller 3. As for the developer amount regulation member 4-*c*, it has been proposed to employ a blade-shaped metal thin plate, which is supported along one side in the longitudinal direction, with the underside of the facing portion thereof in contact with the developing roller 3. The developer coated on the developing roller 3 develops the electrostatic latent image formed on the photosensitive drum 1, and bias potential applied on the developing roller 3. As for the method of (1), Japanese Patent Laid-Open No. 2001-92201 has been known.

(2) Non-Contact Developing Method with Nonmagnetic Toner Employing Developing Roller Including Metal Sleeve or Elastic Layer (FIG. 11)

A method has been widely known wherein a developer is carried and held on a developing sleeve 3*a* having a cylindrical metal or a conductive resin layer on the surface thereof, and developing is performed by non-contact with the adjacent photosensitive drum 1 surface. Supply of a nonmagnetic developer to the developing sleeve 3*a* is performed by the supply roller 5, as with (1) Contact developing method.

The application of charge due to the layer regulation and frictional charge of a developer adhered to on the developing roller 3 is performed by causing a developer amount regulation member 4-*c* to make contact with the developing sleeve 3*a*. In the event of employing a developing roller including an elastic layer, it has been proposed to employ a blade-shaped metal thin plate which is supported along one side in the longitudinal direction, and the underside of the facing portion thereof is in contact with the developing roller, as with (1) Contact developing method. Also, in the event of employing the developing sleeve 3*a* having high rigidity, it is difficult to employ a metal plate serving as the developer amount regulation member 4-*c* to contact with the developing sleeve 3*a*. So it has been proposed to employ a metal thin plate on which a resin layer including some elastic properties is coated, and the like.

Not only DC bias but also AC bias is applied between the developing sleeve 3*a* and the photosensitive drum 1. The developer coated on the developing sleeve 3*a* with the developer amount regulation member 4-*c* flies and goes back and forth between the photosensitive drum 1 and the non-contact developing sleeve 3*a* by this AC bias. Also, an electrostatic latent image formed on the photosensitive drum 1 is developed by the potential of the DC bias applied to the developing sleeve 3*a*.

(3) Non-Contact Method with Magnetic Toner Employing Metal Sleeve (FIG. 12)

A non-contact developing method employing monocomponent magnetic toner has been widely known. This method is the same as (2) Non-contact developing method employing nonmagnetic toner in that the cylindrical developing sleeve 3*a* is employed, and in that the application of charge due to the layer regulation and frictional charge of a developer is performed by causing the developer amount regulation member 4-*c* to make contact with the developing sleeve 3*a*. However, with the non-contact developing method, supply of a developer to the developing sleeve 3*a* is performed with magnetic force by providing a magnet 7 within the developing sleeve 3*a*. As for the method of (3), Japanese Patent Laid-Open No. 54-43027, and Japanese Patent Laid-Open No. 55-18656 have been known.

DC bias and AC bias are applied between the developing sleeve 3*a* and the photosensitive drum 1 as with (2) Non-contact developing method employing nonmagnetic toner, and development is performed by non-contact. At this time, even if there is too much toner having insufficient electrification properties on the developing sleeve 3*a*, the toner is prevented from being developed unnecessarily by disposing a magnetic pole near the developing portion. Accordingly, with regard to the electrification properties of the developer on the developing sleeve 3*a*, strict control as much as (2) Non-contact developing method employing nonmagnetic toner is not requested. As for the developer amount regulation member 4-*c*, it has been proposed to employ a rubber plate having low contact pressure as compared with (2) Non-contact developing method employing nonmagnetic toner by taking stability of contact as to the developing sleeve 3*a* into consideration.

Heretofore, as for a developer amount regulation member, a blade-shaped developer amount regulation member has been known, which supports a thin-plate elastic member along one side in the longitudinal direction, and causes the underside of the facing portion thereof to make contact with the developing roller.

Also, a developer amount regulation member has been known in Japanese Patent Laid-Open No. 6-250509, which fixes both ends of a plate-shaped elastic body to a holding member, and causes the center portion of the plate-shaped elastic body to make contact with a developing roller.

An existing developer amount regulation member, which supports a thin-plate elastic member and causes the underside of the facing portion to make contact with a developing roller, has a problem in that reduction in size is difficult. Upon reduction in size being performed on such a developer amount regulation member, the distance from a supporting point where the thin plate is supported along one side in the longitudinal direction to a contact point with the developing roller, i.e., free length is shortened. Thus, the spring constant of the contact pressure increases, and if the setting position of the developer amount regulation member is changed even slightly, the contact pressure greatly changes. Accordingly, in order to set stable contact pressure, assembly with high precision is necessary.

Also, shortening the free length of the thin-plate elastic member enables the influence of the adhesion unevenness and so forth at a supporting portion along one side in the longitudinal direction to be readily received. As such, it is difficult to apply uniform contact pressure over a longitudinal direction, which further makes it difficult to realize reduction in size.

Also, in the event of employing a developer amount regulation member according to known technology, it is difficult to set a desired local maximum value of contact pressure in a stable manner, and the variation in local maximum values of contact pressure is readily caused in the longitudinal direction of the developer amount regulation member. Accordingly, the variation in toner degradation conditions occurs over the longitudinal direction after endurance (long-term use of developing apparatus), and consequently, leading to a problem wherein concentration unevenness occurs over the longitudinal direction in a solid image after endurance.

In the event of forming toner in a thin layer by employing a developer amount regulation member according to known techniques, a developing roller serving as a developer bearing member is pressed against the underside of a blade (surface except for the edges of the blade) serving as a developer amount regulation member. Accordingly, regarding pressure distribution of contact nip portion between the blade and developing roller, contact pressure becomes the maximum at the nip portion center, and contact pressure assumes a parabolic pressure distribution, which becomes weak at contact positions farther upstream and downstream from the nip portion center in the direction of rotation of the developing roller.

In the event of the developer amount regulation member having the aforementioned parabolic pressure distribution, upon so-called "push-in amount by developing roller" increasing, which is the virtual distance between the setting position of the blade before the developing roller being embedded and the setting position of the blade after the developing roller being embedded of the assembly of the developing apparatus, the local maximum value of contact pressure increases in proportion to the push-in amount by the developing roller.

Accordingly, it is expected that the variation in the push-in amount by the developing roller due to assembly also makes the maximum value of contact pressure vary. Consequently, it is necessary to obtain high assembly precision to set a desired local maximum value of contact pressure with little variation in a stable manner.

Also, in the event that the variation in setting positions of the developer amount regulation member and the developing roller arises in the longitudinal direction of the developing roller due to the variation in production, the circumferential deflection of the developing roller, and so forth, i.e., in the event that the variation in the push-in amount of the developing roller as to the developer amount regulation member arises in the longitudinal direction, the variation in the local maximum values of contact pressure of the developer amount regulation member and the developing roller arises over the longitudinal direction. Thus, the variation in toner degradation arises over the longitudinal direction, after endurance in particular. Consequently, concentration unevenness arises over the longitudinal direction in a solid image after endurance.

On the other hand, in recent years, one measure arranged to reduce the power consumption of an electro-photography apparatus is reduction of the power consumption in a fixing process. In order to realize low-power consumption in the fixing process, it is effective to reduce quantity of heat necessary for melting of toner, i.e., to lower the melting point of toner.

However, while toner having a low melting point facilitates low-temperature fixing, the strength as to toner stress is reduced. Accordingly, with a monocomponent developing system, toner is readily crushed and melted under the pressure affected from a developer amount regulation member. The variation in toner degradation conditions as to the variation in the local maximum values of contact pressure such as described above becomes still more pronounced.

SUMMARY OF THE INVENTION

The present invention is directed to a developing apparatus suitable for reduction in size. The present invention is also directed to a developing apparatus which can stabilize the contact pressure between a developer amount regulation member and a developer bearing member. The present invention is also directed to a developing apparatus, which can reduce the variation in the contact pressure between a developer amount regulation member and a developer bearing member in the longitudinal direction. The present invention is also directed to a developing apparatus which can suppress image concentration unevenness.

A developing apparatus according to an aspect of the present invention includes a developer bearing member configured to carry and hold a developer and to develop an electrostatic image formed on an image bearing member with the developer, and an amount-of-developer regulating apparatus configured to regulate an amount of developer carried and held by the developer bearing member. The amount-of-developer regulating apparatus includes a flexible developer amount regulation member including a contact portion configured to contact with the developer bearing member, and first and second holding portions configured to hold the developer amount regulation member and to contact with the developer amount regulation member at further upstream and further downstream in the direction where the developer bearing member is rotationally moved than the contact portion. With a pressure distribution of the contact portion as to the developer bearing member, there are a plurality of local maximum values in the direction where the developer bearing member is rotationally moved.

Further features of the present invention will become apparent from the following description of exemplary embodiments with reference to the attached drawings.

DESCRIPTION OF THE EMBODIMENTS

First Embodiment of Developing Apparatus

Figure 1A:
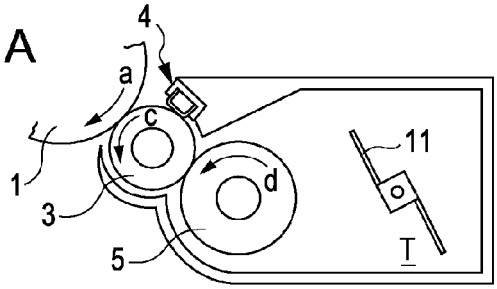
FIGS. 1A through 1H are schematic diagrams illustrating the features of a developer amount regulation member according to an example 1.
Figure 1B:
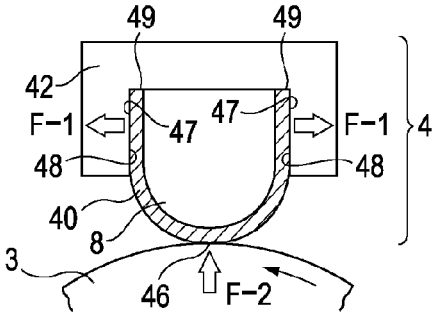
Figure 1C:
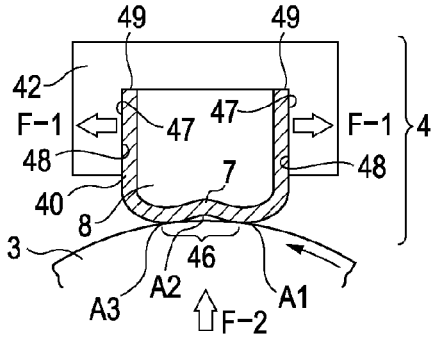
Figure 1D:
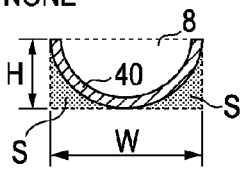
Figure 1E:
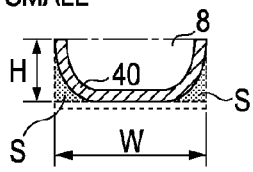
Figure 1F:
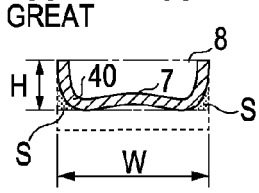
Figure 1G:
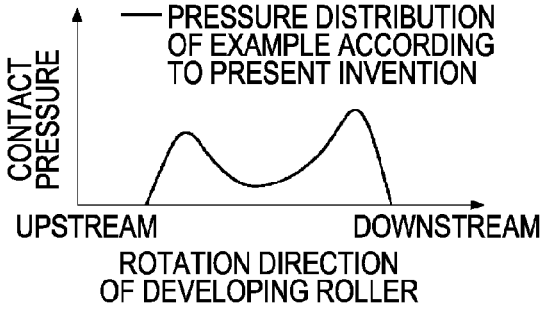
Figure 1H:
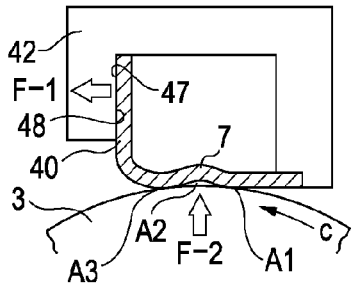
Figure 2:
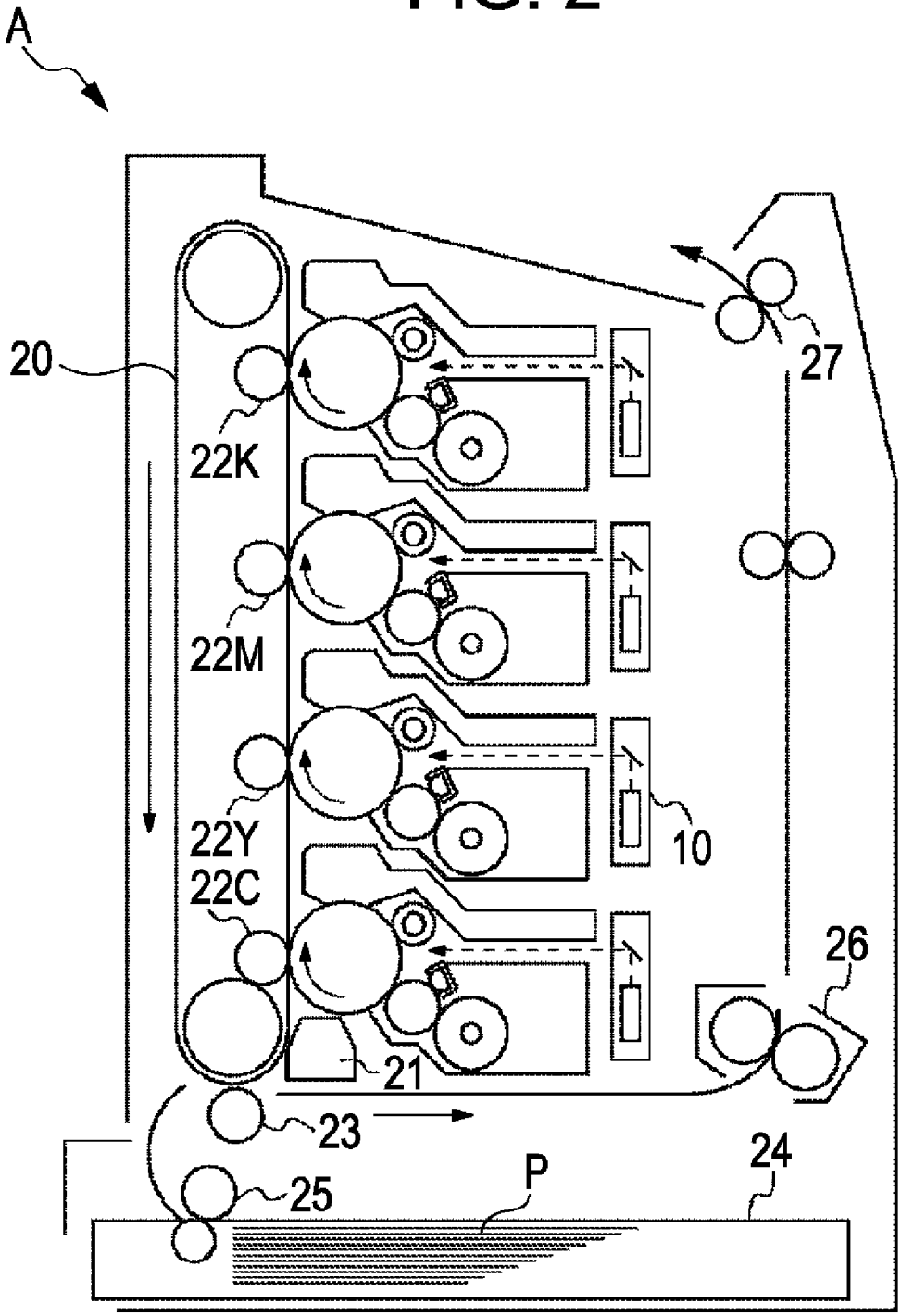
FIG. 2 is a schematic diagram illustrating an image forming apparatus main assembly according to the example 1.

FIGS. 1A through 3 are schematic configuration diagrams of an image forming apparatus employing a developing apparatus in accordance with the present invention, and detail drawings describing those diagrams. An image forming apparatus A shown in FIG. 2 is a full-color laser printer employing the electro-photography process. Description will be made below regarding an overall schematic configuration of the image forming apparatus A according to the following present embodiment.

Figure 3:
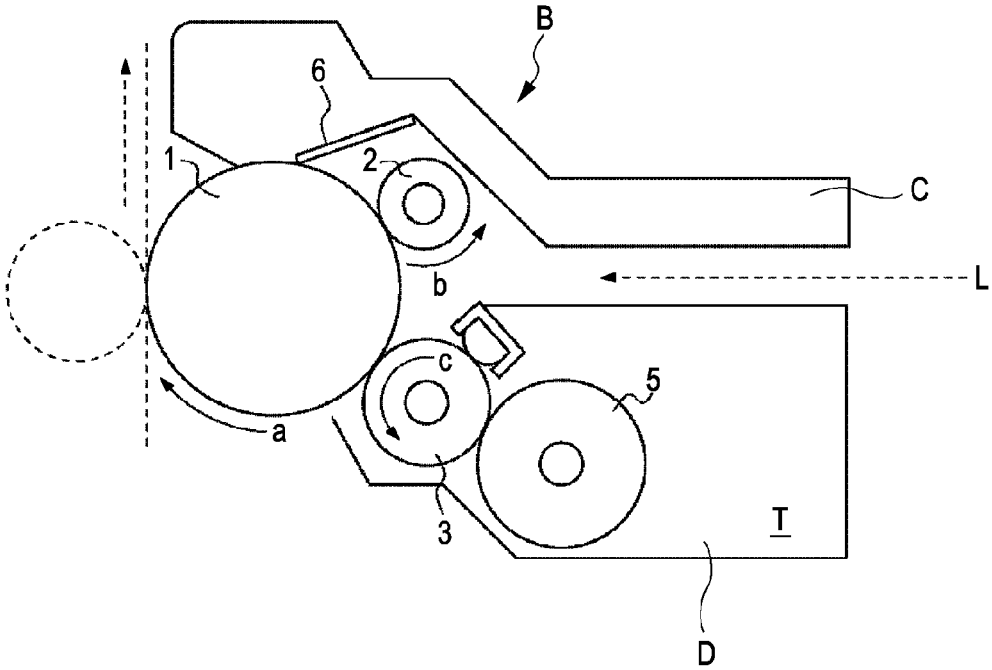
FIG. 3 is a schematic diagram of a process cartridge according to the example 1.

With the image forming apparatus A, as shown in FIG. 3, four series of process cartridges B integrally formed of a charging apparatus, a developing apparatus D, a cleaning apparatus C, a photosensitive drum 1, and so forth are arrayed for each color of yellow, magenta, cyan, and black, as shown in FIG. 2. Each of the process cartridges B is configured to be detachable with respect to the main assembly of the image forming apparatus. A toner image formed by the process cartridge B of each color is transferred to an intermediate transfer belt 20 of a transfer apparatus, thereby forming a full-color toner image. Description will be made later in detail regarding image forming process on each process cartridge B.

A toner image formed on the photosensitive drum 1 serving as an image bearing member by the process cartridge B of each color is transferred to the intermediate transfer belt 20 by primary transfer rollers 22*y*, 22*m*, 22*c*, and 22*k* provided on the facing position of the photosensitive drum 1 of each color sandwiching the intermediate transfer belt 20. The toner images of the four colors are transferred to a recording sheet all at once by a secondary transfer roller 23 provided at the downstream side in the movement direction of the intermediate transfer belt. Note that transfer residual toner on the intermediate transfer belt 20 is collected by an intermediate transfer belt cleaner 21.

A recording sheet P is loaded within a cassette 24 at the lower portion of the image forming apparatus A, and is transported by a sheet feed roller 25 in accordance with a printing operation request. A toner image formed on the intermediate transfer belt 20 is transferred to the sheet P at the secondary transfer roller 23 position.

Subsequently, the toner image on the recording sheet is fused by heat by a fusing unit 26, and the recording sheet is discharged to the outside of the image forming apparatus A via a discharge unit 27.

With the image forming apparatus A, an upper portion unit in which the process cartridges B of each four color, a transfer unit, and a lower portion unit in which a recording sheet or the like is stored can be separated. Accordingly, with jam processing such as for handling a paper jam and so forth, and replacement processing of a process cartridge B, the above-mentioned processing is performed by separating and releasing the upper portion unit and the lower portion unit.

Note that the image forming apparatus A according to the present embodiment employs process cartridges B whose life including the capacity of toner is equivalent to 4000 sheets by A4-sheet 5%-printing-rate conversion.

Next, description will be made regarding image forming process according to a process cartridge B.

FIG. 3 illustrates the cross section of one of the four process cartridges disposed in parallel, and the neighborhood thereof. As for the photosensitive drum 1 serving as the center in the image forming process, an organic photosensitive drum 1 is employed wherein the outer circumferential face of the cylinder made from aluminum is coated with an underlying layer, carrier generating layer, and carrier transferring layer, each serving as a functional film in order. With the image forming process, the photosensitive drum 1 is driven in the direction of the arrow a by the image forming apparatus A at a predetermined speed.

A charging roller 2 serving as a charging apparatus subjects the roller portion of conductive rubber to pressurized contact to the photosensitive drum 1, and subjects this to follower rotation in the direction of the arrow b. Here, as a charging process, with the core of charging roller 2, DC voltage of −1100V is applied to the photosensitive drum 1, and the charge thus induced forms uniform dark potential (Vd) wherein the surface potential of photosensitive drum 1 reaches −550V.

A spot pattern of laser beam emitted corresponding to image data from a scanner unit 10 as to such a uniform surface charge distributed face exposes a photosensitive member such as shown with the arrow L in FIG. 3. With the exposed portion of the photosensitive member, the charge of the surface is eliminated by the carrier from the carrier generating layer, and the potential thereof decreases. Consequently for an electrostatic image (electrostatic latent image) formed on the photosensitive drum 1, the exposed portions have a bright potential of V1=−100V and the non-exposed portions have a dark potential of Vd=−550V.

The electrostatic latent image is developed by the developing apparatus D having a toner coating layer formed on the developing roller 3 serving as a developer bearing member configured to bear toner serving as a developer having a predetermined coat amount and charge amount. A method for forming the above-mentioned toner layer will be described later, but the developing roller 3 rotates in the forward direction with respect to the rotational direction of the photosensitive drum 1 as shown with the arrow c while making contact with the photosensitive drum 1. With the present embodiment, the voltage of DC bias=−350V is applied to the developing roller 3, and with the developing portion which is in contact with the photosensitive drum 1, from the potential difference thereof the toner negatively charged due to frictional charge adheres only to a bright potential portion to convert the electrostatic latent image into an actual image. That is to say, the charged polarity of the toner and the charged polarity of the electrostatic latent image have the same polarity, and reversal developing is performed.

The intermediate transfer belt 20 which is in contact with the photosensitive drum 1 of each process cartridge B is pressurized to the photosensitive drum 1 by the primary transfer rollers 22*y*, 22*m*, 22*c*, and 22*k* facing the photosensitive drum 1. Also, DC voltage is applied to the primary transfer rollers 22*y*, 22*m*, 22*c*, and 22*k*, thereby forming an electric field between the primary transfer rollers and the photosensitive drum 1. Thus, the toner image converted into an actual image on the photosensitive drum 1 receives the force from the electric field with the above-mentioned pressurized and contacted transfer region, and is transferred to on the intermediate transfer belt 20 from on the photosensitive drum 1. On the other hand, the toner, which has not been transferred to the intermediate belt 20, remaining on the photosensitive drum 1 is scratched and dropped from the drum surface by a cleaning blade 6 made of polyurethane rubber disposed at the cleaning apparatus C, and is stored in the cleaning apparatus C.

Description will be made below regarding the details of the developing apparatus employed for the present first embodiment.

FIG. 1A illustrates a later-described developing apparatus according to an example 1. The developing apparatus includes a developer container T configured to store a non-magnetic monocomponent developer, and a developing roller 3 serving as a developer bearing member which rotates in a forward direction c while being in contact with the photosensitive drum 1. Further, the developing apparatus includes a supply roller 5 which rotates in a reverse direction d while being in contact with the developing roller 3, an amount-of-developer regulating apparatus 4 serving as an amount-of-developer regulating apparatus configured to regulate the amount of a developer on the developing roller 3, which is in contact with the developing roller 3 at the downstream side of the supply roller 5, and an agitation member 11 configured to agitate toner T.

Now, with the present example, the developing roller 3 employs an elastic roller of 12 mm in diameter wherein a conductive elastic layer of 3 mm is formed at a core whose outer diameter is 6 mm, and silicone rubber whose volume resistance value is $10^6$ Ωm is employed for the elastic layer. Note that a coat layer or the like having a charge application function as to a developer may be provided on the elastic roller surface layer. With the present example, in order to elastically make contact with the photosensitive drum 1 in a stable manner, the hardness of the elastic layer should be 45° for JIS-A, and the surface roughness of the developing roller 3 may depend on the granule diameter of the toner used, but should have a coarseness of 3 μm to 15 μm Rz at ten-point mean roughness. If the toner granules used have an average volume granule diameter of 6 μm, the ideal ten-point mean roughness thereof would be between 5 μm and 12 μm Rz. The ten-point mean roughness Rz employs a definition specified by JIS B 0601, and for the measurement thereof the surface roughness tester "SE-30H" manufactured by Kosaka Laboratory was used.

Also, as for the supply roller 5, with the present example, we have employed an elastic sponge roller whose outer diameter is 16 mm, which forms a polyurethane foam of 5.5 mm having comparatively low hardness with a foaming framework structure on the core whose outer diameter is 5 mm. The supply roller 5 is configured of an interconnected cell foam, thereby making contact with the developing roller 3 without applying excessive pressure thereupon. Then, supplying the toner on the developing roller 3 with appropriate unevenness on the foam surface, and scraping the remaining unused toner at the time of developing is performed. The cell structure having the scrapability is not restricted to being formed of urethane foam; rather, rubber wherein a silicone rubber or ethylene-propylene-diene rubber (EPDM rubber) or the like is foamed may be used.

A developer amount regulation apparatus 4 is provided at the downstream side of a contact face between the supply roller 5 and the developing roller 3 as to the developing roller rotation direction (direction of moving rotationally) c, which is configured to make contact with the developing roller 3, and regulate the amount of developer borne by the developing roller 3. The developer amount regulation apparatus 4 includes a developer amount regulation member which makes contact with the developing roller 3, and a holding portion configured to hold the developer amount regulation member.

The developer amount regulation apparatus 4 controls the coating amount of the toner on the developing roller 3 to be a predetermined amount, and the charge amount to be a predetermined amount, appropriate for developing on the photosensitive drum 1. The developer amount regulation apparatus 4 will be described in detail with the examples and comparative examples to be described later.

Second Embodiment of Developing Apparatus

Figure 8:
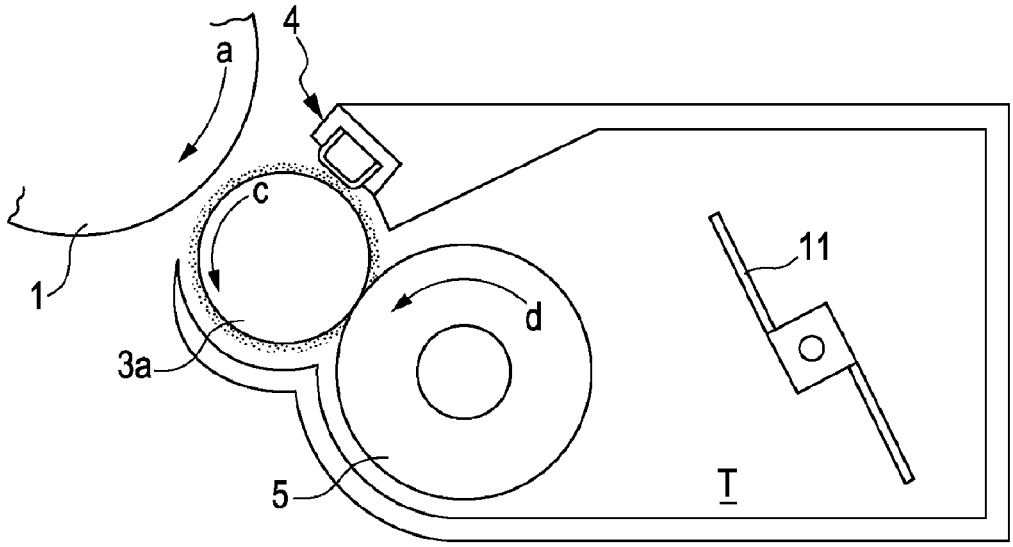
FIG. 8 is a schematic diagram of a developing apparatus according to a second embodiment employing the example 1.

FIG. 8 is a cross-sectional view of a developing apparatus serving as a second embodiment according to the present invention. With the present embodiment, the above-mentioned developing apparatus is applied to a full-color laser printer, but the configuration of the image forming apparatus other than the above-mentioned developing apparatus is the same as that in the first embodiment. Description will be omitted regarding the same points as those in the first embodiment, and description will be made only regarding different points thereof. With the present embodiment, the developing sleeve 3*a* serving as a developer bearing member is disposed facing the photosensitive drum such that a gap between the developing sleeve 3*a* and the photosensitive drum is 300 μm, and nonmagnetic monocomponent toner borne on the developing sleeve 3*a* is developed on the photosensitive drum surface in a non-contact manner.

Specifically, the developing sleeve 3*a* rotates in the forward direction along with the photosensitive drum 1 such as shown by the arrow c. A DC bias of −350 V and an AC bias of a rectangular waveform of 2400 Hz and 1600 Vpp are applied to the developing sleeve 3*a*. On the photosensitive drum 1, as with the first embodiment, an electrostatic latent image of a dark potential Vd=−550 V and a bright potential V1=−100 V is formed. The magnetic toner having been subjected to negative frictional charge on the developing sleeve 3*a* forms a toner image on the photosensitive drum 1 by flying and going back and forth between the photosensitive drum 1 and the developing portion in the vicinity of the developing sleeve 3*a*, with the AC bias.

Third Embodiment of Developing Apparatus

Figure 9A:
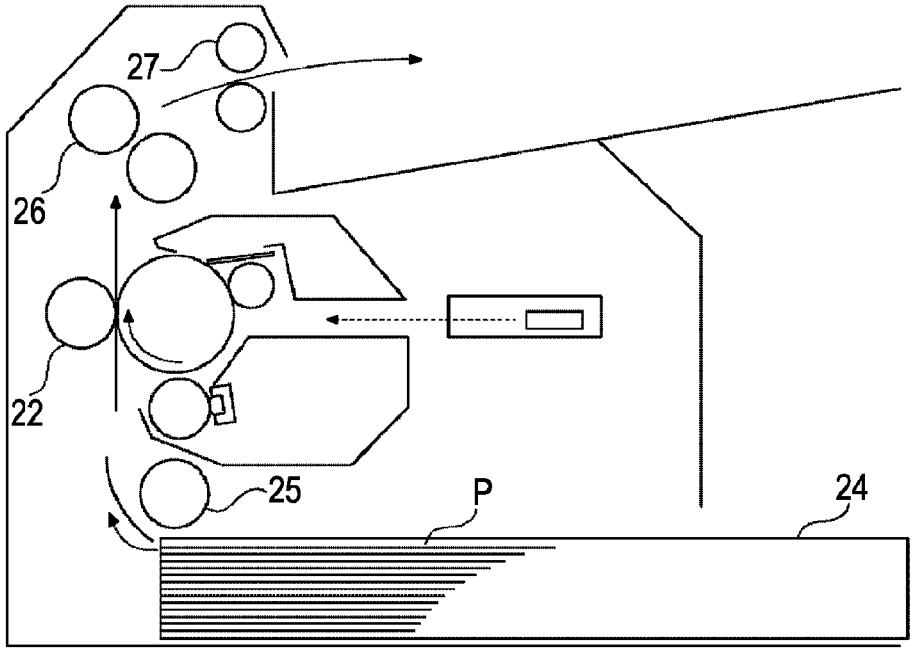
FIGS. 9A and 9B are schematic diagrams of an image forming apparatus and a developing apparatus according to a third embodiment employing the example 1.
Figure 9B:
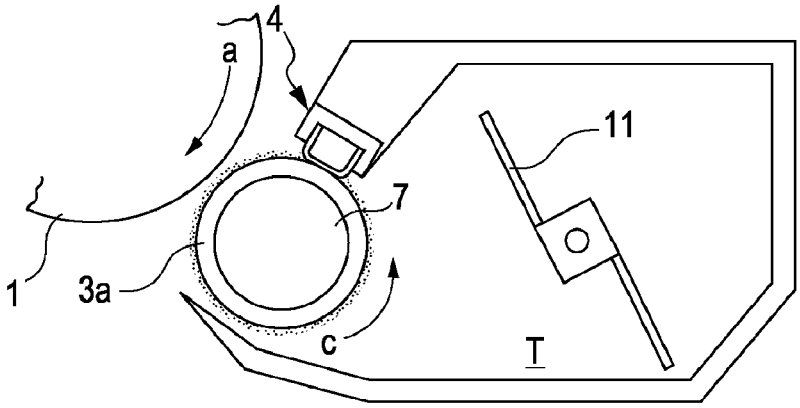
Figure 10:
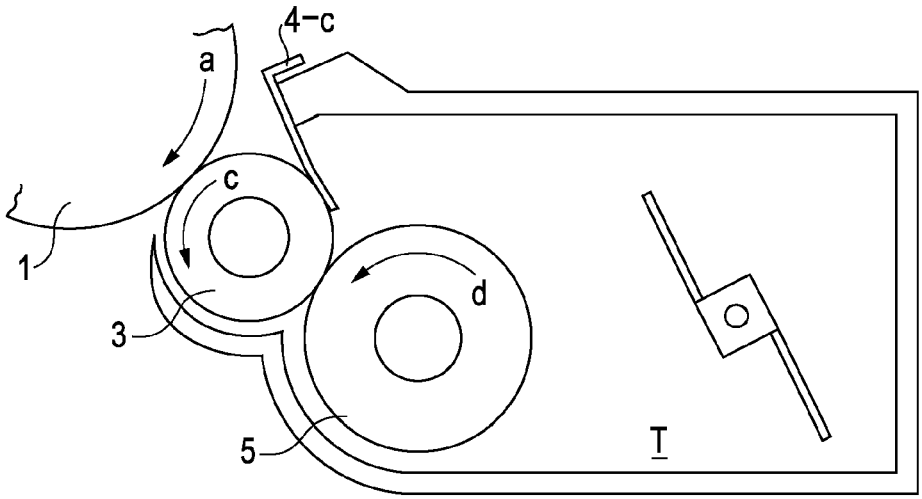
FIG. 10 PRIOR ART
FIG. 10 is a schematic diagram of a developing apparatus according to background art (1).
Figure 11:
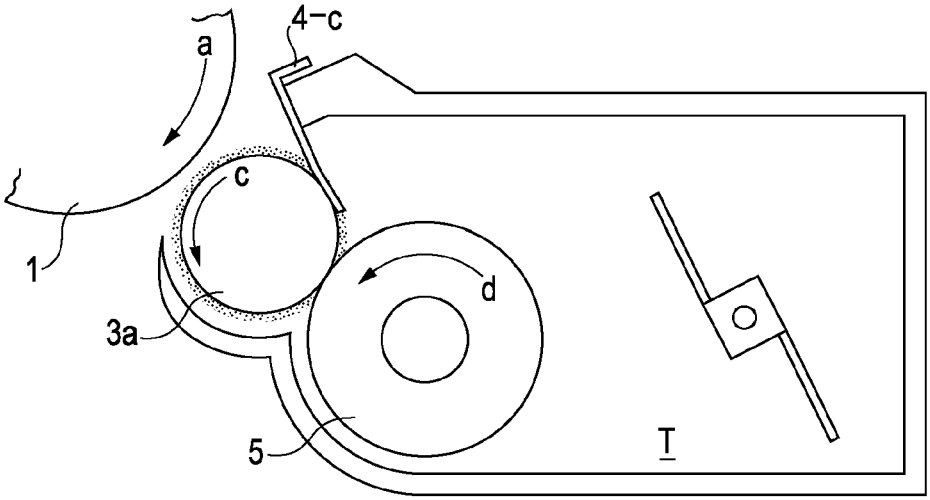
FIG. 11 PRIOR ART
FIG. 11 is a schematic diagram of a developing apparatus according to background art (2).
Figure 12:
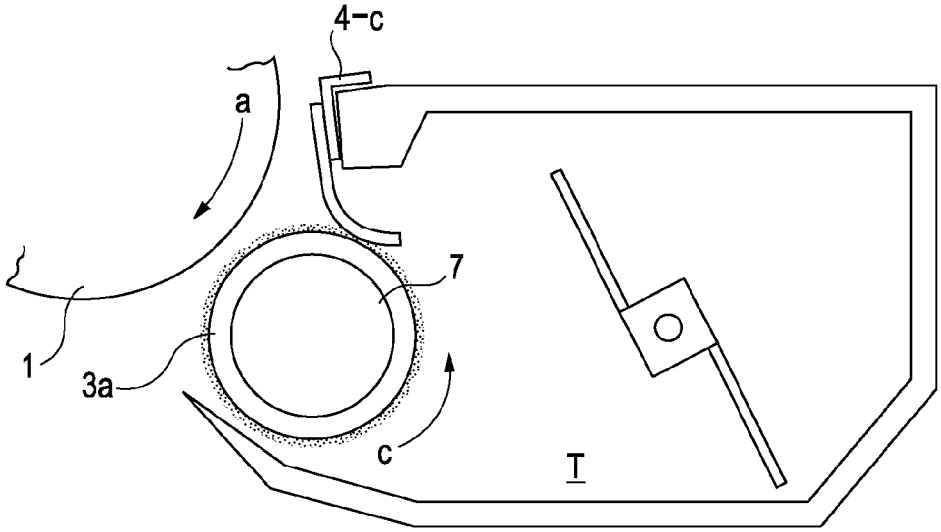
FIG. 12 PRIOR ART
FIG. 12 is a schematic diagram of a developing apparatus according to background art (3).

FIGS. 9A and 9B are schematic configuration diagrams illustrating an image forming apparatus according to a third embodiment employing the developing apparatus according to the present invention. FIG. 9A is a cross-sectional view regarding a monochrome laser printer main assembly serving as an image forming apparatus, and FIG. 9B is a cross-sectional view regarding a developing apparatus employed for the monochrome laser printer thereof.

With the present embodiment, a metal sleeve on which a conductive resin is coated is employed for the developing sleeve 3*a* serving as a developer bearing member, and a magnet roller 7 serving as a fixed magnetic field generating member having a predetermined magnetic pole positioned on the inside of the developing sleeve 3*a* is provided. The magnetic toner within the developer container is pulled and adhered toward the surface of the developing sleeve 3*a* by the magnetic force of the magnet roller 7. The magnetic toner adhered to the surface of the developing sleeve 3*a* is transported by the rotation of the developing sleeve 3*a* in the direction shown by the arrow c. However, when passing through the contact portion with the developer amount regulation member 4, a charged toner coat layer is formed after being subjected to frictional charge application under pressure, as well as being subjected to layering regulating.

With the present embodiment, a gap of 300 μm at the nearest point is maintained between the developing sleeve 3*a* and the photosensitive drum 1. Also, a DC bias of −350 V and an AC bias of a rectangular waveform of 2400 Hz and 1600 Vpp are applied to the developing sleeve 3*a*. As with the first embodiment an electrostatic latent image of Vd=−550 V, V1=−100 V is formed on the photosensitive drum 1. Then the magnetic toner having been subjected to negative frictional charge on the developing sleeve 3*a* forms a toner image on the photosensitive drum 1 by flying and going back and forth between the photosensitive drum 1 and the developing portion in the vicinity of the developing sleeve 3*a*, with the AC bias. Note that the magnet roller within the developing sleeve 3*a* has a magnetic pole provided in the vicinity of the developing portion. With the present embodiment, the toner having an inappropriate charge can be suppressed from flying erroneously to the dark portion Vd portion by having a magnetic force of 800 G (Gauss) at the surface of the developing sleeve 3*a*, such as which cannot be controlled with the above-described potential setting.

EXAMPLES AND COMPARATIVE EXAMPLES

Description will be made below regarding examples and comparative examples of the developer amount regulation apparatus.

Example 1

Description will be made regarding a developer amount regulation apparatus 4 according to the present example. FIG. 1B shows the state of the developer amount regulation apparatus 4 which is maintained in a U-shape (state of unused position), prior to making contact with the developing roller 3 at a predetermined use position (ordinary position where developing is performed). Also, FIG. 1C shows the developer amount regulation apparatus 4 according to the present example in a state of being pressed against the developing roller 3 at a predetermined usage position and at a predetermined push-in force. As shown in FIG. 1B, the developer amount regulation apparatus 4 of the present example includes a flexible sheet member 40 serving as a developer amount regulation member, and a sheet holding member 42 serving as a holding portion configured to hold the developer amount regulation member. The flexible sheet member 40 is in an unfixed state wherein fixing such as adhesion or the like is not performed as to the sheet holding member 42. Now, the flexible sheet member 40 is formed into a U-shape by bending in the movement direction of the developing roller. The flexible sheet member 40 is bent in the longitudinal direction thereof so as to have generally the same shape as that in FIG. 1C. The longitudinal direction of the flexible sheet member 40 is the direction perpendicular to the spaces of FIG. 1B and FIG. 1C.

At this time, restoration force F-1 acts on the flexible sheet member 40, wherein the flexible sheet member 40 attempts to revert back from the state of being subjected to bending in the longitudinal direction. Accordingly, a second contact portion 47 serving as a face of both end portions in the widthwise direction (movement direction of developing roller) of the flexible sheet member 40 makes contact with a flexible sheet supporting portion 48 of the recessed inner wall of the sheet holding member 42 by pressure, and the flexible sheet member 40 is held by the recessed sheet holding member 42 in a stable manner even without being glued or supporting from another component. Further, the flexible sheet member 40 receives pressure force F-2 from the developing roller 3 at a first contact portion 46 where the flexible sheet member 40 comes into contact with the developing roller 3, so is held by elastic force in a stable manner. Also, an end face 49 of the flexible sheet member comes into contact with the sheet holding member 42 by receiving pressure force F-2 at the first contact portion 46, and thus the position of the flexible sheet member 40 is regulated in a predetermined position. Note that the second contact portion 47 is provided at the two positions of the upstream and downstream in the direction of the developing roller rotating as to the first contact portion 46.

With the example 1, as the flexible sheet member 40, a urethane rubber with a hardness of 70° with JIS-A is employed, and the sheet member mentioned above which has a thickness of 0.4 mm and a widthwise length of 12.5 mm is received at the recessed portion of the holding member 42 having a width of 5.0 mm. Thus, the U-shape is formed. Let us say that the contact condition for the flexible sheet member 40 and the developing roller 3 is that the amount to be pressed in, which is the imaginary overlap amount of the tip position (the position of the center portion of the U-shape) of the flexible sheet member 40 in the event of providing no developing roller 3 and the surface position (the tip position of the flexible sheet member 40) of the developing roller 3 in the event of providing the developing roller 3 at a normal position, is arranged to be set to 20 KPa by setting the amount to be pushed in to 0.8 mm.

As for the sheet holding member 42, a polystyrene resin, ABS resin, polycarbonate resin, or the like can be employed. Also, the sheet holding member 42 can be formed as a part of the frame unit of the developing apparatus by being molded integrally with the frame unit of the developing apparatus.

The generally used measurement method for contact pressure is a pressure sensor in a thin sheet shape (for example, Prescale film manufactured by Fuji Film Corporation or the like). With the present embodiment, the contact pressure is low, and measurement is difficult with a general pressure sensor. Therefore, measurement of the contact pressure is performed by layering together three layers of hard H material of SUS 304 stainless steel with a thickness of 20 μm, inserting this at the contact portion of the developer amount regulation member and developing roller 3, pulling out a thin plate from the center of the contact face in the linear direction of contact with a spring scale, and measuring the pullout force thereof. Thus, the measurement of contact pressure is obtained from the proof value and contact width from the pullout pressure measurement in the event of a known load being placed on the pressure measurement tool.

Now, pressure distribution within a contact nip serving as a contact region between the developing roller 3 and the flexible sheet member 40 is shown in FIG. 1G. With the present example, there are a plurality of local maximum values of contact pressure at the upstream and downstream in the rotation direction c of the developing roller 3, a pressure distribution including two local maximum values of contact pressure is formed so as to have a low contact pressure region (local minimal value) in the middle thereof.

With the pressure distribution measurement, change in contact pressure is detected as an electric signal by employing a strain gauge. Specifically, a strain gauge "KFG-02-120" manufactured by Kyowa Electronic Instruments Co. Ltd. is attached to a hole provided in a hollow acrylic roller having the same diameter as the developing roller 3. At this time, the tip of the resin base portion of the strain gauge is attached so as to protrude from the surface of the acrylic roller in a range of 0.1 mm through 0.3 mm. Also, the lead wire of the strain gauge is extracted from the hollow portion to the end portion of the acrylic roller, thereby enabling the roller to be rotated. Upon the acrylic roller to which the strain gauge is attached being made to contact with the developer amount regulation member 4, and being rotated, the tip of the resin base portion of the strain gauge is deformed by contact pressure received from the developer amount regulation member 4. Thus, change in the contact pressure can be detected with an electric signal as change in the strain amount of the strain gauge itself. At this time, in order to reduce the noise of the electric signal, the members coming into contact with the developing roller 3 other than the developer amount regulation member are removed. Note that "PCD-300A" manufactured by Kyowa Electronic Instruments Co. Ltd. Was been employed for detection of the electric signal.

Description will be made below regarding the reason why a plurality of contact peaks are formed in a nip internal pressure distribution of the developer amount regulation member with the present example.

Upon the developing roller 3 being pressed further in as to the flexible sheet member 40 which is supported in a U-shape (the developing roller 3 being moved upwards in FIG. 1B), the flexible sheet member 40 is made to contact with the developing roller 3 at the elastic portion having a space 8 formed in the U-shaped center portion. At this time, the flexible sheet member 40 is deformed, and thus elastic force is generated, whereby contact pressure arranged to regulate the amount of toner can be realized on the developing roller 3. As shown in FIG. 1B, the flexible sheet member 40 receives the pressure force F-2 from the developing roller 3 at the first contact portion 46.

Next, the second contact portion 47 serving as the face of both end portions of the flexible sheet member 40, by the first contact portion 46 being pushed in by the developing roller 3, attempts to spread in the same direction as the restoration force F-1 which attempts to revert from the state wherein the flexible sheet member 40 is subjected to bending into a U-shape. However, this attempt is regulated by the holding portion 48 of the recessed inner wall of the sheet holding member 42.

Now, let us consider, with reference to FIGS. 1D, 1E, and 1F, an arc-shaped portion in a state in which the flexible sheet member 40 is supported in a U-shape. The flexible sheet member 40 changes from the state shown in FIG. 1B to the states shown in FIGS. 1D, 1E, and 1F in order as the developing roller 3 is moved upward. Note that the normal use position of the flexible sheet member 40 according to the present example is the position shown in FIG. 1F. The arc-shaped portion is generally not protruded externally from the frame shown with a dotted line. This reason is that the sheet holding portion 48 regulates the spread of both end portions of the flexible sheet member 40. The width W of the frame shown with the dotted line is approximately the groove width of the recessed portion of the sheet holding portion 48, and is constant. Also, the height H of the frame shown with the dotted line is generally the distance from the end portion of the recessed outer wall of the sheet holding member 42 to the surface of the developing roller 3, but which decreases as the push-in amount of the developing roller 3 increases. That is to say, in FIG. 1B, as the developing roller 3 is moved upward, the distance H between the bottom portion of the inner wall of the recessed portion of the sheet holding member 42 and the developing roller 3 surface decreases. On the other hand, the length of the arc-shaped portion of the flexible sheet member 40 extracted in FIG. 1D can be conceived to be kept generally constant regardless of change in the frame size shown with the dotted line.

As shown in FIG. 1E, in the event that the push-in amount of the developing roller 3 as to the flexible sheet member 40 is small, with the flexible sheet member 40 pushed in by the developing roller 3, the length of the arc-shaped portion can be kept generally constant by deforming the flexible sheet member 40 to escape to a space S which is a shaded portion.

Next, as shown in FIG. 1F illustrating the present example, in the event of the push-in amount of the developing roller 3 exceeding a predetermined amount, the space S which is a shaded portion becomes narrow. Accordingly, the flexible sheet member 40 pushed in by the developing roller 3 fails to deform itself and escape to the space S, and consequently, the length of the arc-shaped portion is kept generally constant by deforming the center portion of the arc toward the U-shaped hollow portion 8. At this time, compression load due to reaction force received from the flexible sheet supporting portion 48 is acting on the arc-shaped portion of the flexible sheet member 40. At the center of the sheet member arc portion, this compression load exceeds limit load wherein buckling occurs, and is made to contact with the developing roller 3 in a state in which buckling occurs. That is to say, in FIG. 1F the center portion of the flexible sheet member 40 is made to contact with the developing roller 3 in a state of being deformed upward. Thus, as shown in FIG. 1C, with a contact nip portion between the developing roller 3 and the flexible sheet member 40, a contact region A1 exists at the contact nip upstream portion, a region A2 where contact pressure is low, and "slack" 7 occurs exists at the contact nip center, and a contact region A3 exists at the contact nip downstream portion. Also, the pressure distribution of the contact nip portion having such a configuration, as shown in FIG. 1G, assumes a two-peak pressure distribution which includes the local maximum values of contact pressure at the upstream and the downstream of the contact nip portion, and a low contact pressure region (local minimal value) at the contact nip center portion.

With the present example, the flexible sheet member 40 forms the developer amount regulation member in a U-shape by bending the flexible sheet member 40 over the longitudinal direction thereof as to the direction where the developing roller moves.

As a modification of an example, a configuration such as shown in FIG. 1H also includes the same advantages as those in the above-mentioned example. Specifically, the flexible sheet member 40 is not supported in a U-shape but generally L-shape having curvature. With the downstream in the rotation direction of the developing roller 3, as described above, the restoration force F-1 generated by bending the flexible sheet member 40 acts on the flexible sheet supporting portion 48 of the recessed inner wall of the sheet holding member 42 at the second contact portion 47. Also, with the upstream in the rotation direction of the developing roller 3, the flexible sheet member 40 is held by being adhered to the sheet holding member 42 without employing the restoration force such as with the above. With this modification as well, in the event that the push-in amount of the developing roller 3 exceeds a predetermined amount, with a contact nip portion between the developing roller 3 and the flexible sheet member 40, a contact region A1 exists at the contact nip upstream portion, a region A2 where contact pressure is low, and "slack" 7 occurs exists at the contact nip center, and a contact region A3 exists at the contact nip downstream portion. The pressure distribution of the contact nip portion having such a configuration, as shown in FIG. 1G, assumes a two-peak pressure distribution which includes the local maximum values of contact pressure at the upstream and the downstream of the contact nip portion, and a low contact pressure region at the contact nip center portion.

Note that with the example in FIG. 1C, the flexible sheet member 40 may be fixed to the sheet holding member 48 at least at one place of the second contact portion 47 serving as the upstream side, and the second contact portion 47 serving as the downstream side.

Example 2

Figure 7:
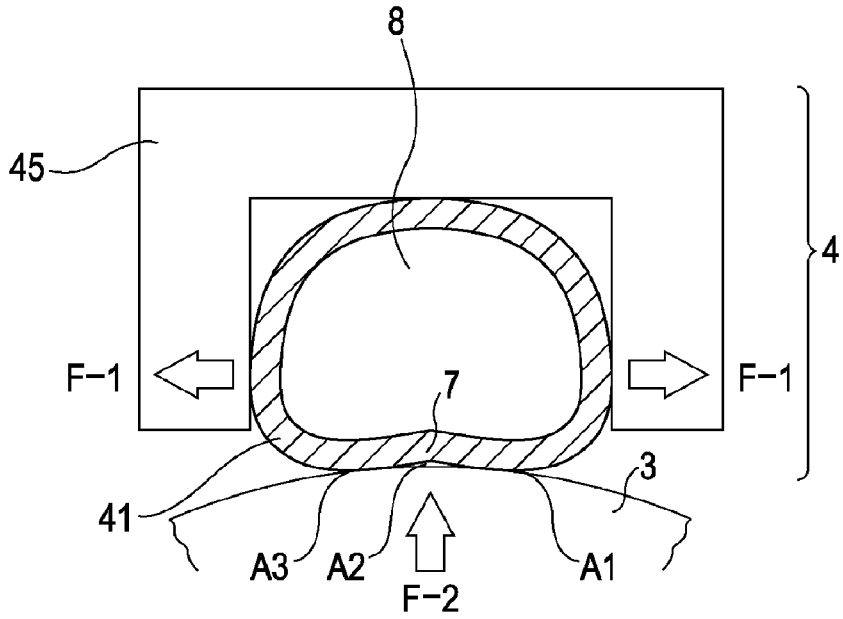
FIG. 7 is a schematic diagram illustrating the features of a developer amount regulation member according to an example 2.

Description will be made regarding a developer amount regulation apparatus 4 according to the present example. The present example applied to the developing apparatus according to the first embodiment is illustrated in FIG. 7. The developer amount regulation apparatus 4 according to the present example comprises a seamless flexible tube member 41, and a tube holding member 45 serving as a holding portion configured to hold a tube in a recessed shape facing the developing roller 3.

With the present example, as the flexible tube member 41, as the flexible sheet member 41, a silicone rubber with an outer diameter of 5 mm and a thickness of 0.5 mm, and a hardness of 60° with JIS-A is employed, and the flexible sheet member 41 is held by the recessed portion with a width of 5.2 mm of the tube holding member 45. A contact condition between the developer amount regulation member (flexible tube member) 41 and the surface of the developing roller 3 at this time is as follows. That is to say, contact pressure is arranged to be set to 20 KPa by setting the push-in amount to 0.8 mm, which is an imaginary overlap amount serving as the distance between the tip position of the developer amount regulation member in the event of providing no developing roller 3, and the developing roller 3 in the case of providing the developing roller 3 at an ordinary use position.

As a pressure distribution within a nip where the developing roller 3 is made contact with the flexible tube member 41 at this time, a pressure distribution including two local maximum values of contact pressure is formed, which includes local maximum values of contact pressure at the upstream and the downstream of the rotation direction c of the developing roller 3 as with the example 1, and includes a low contact pressure region at the middle thereof.

Comparative Example 1

Figure 13:
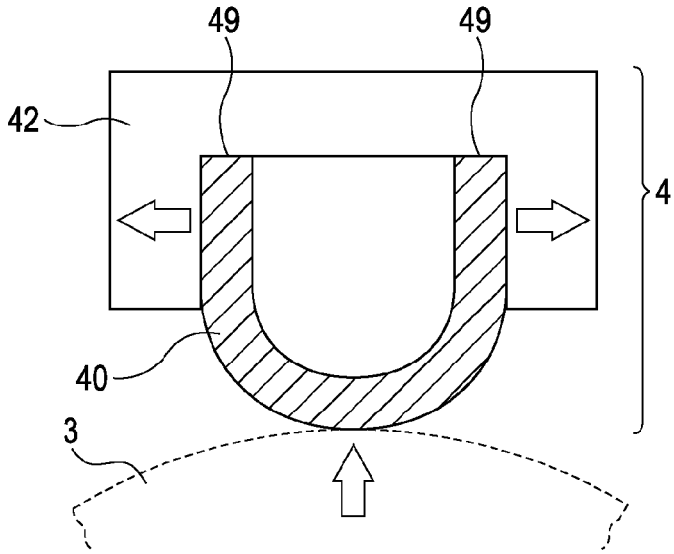
FIG. 13 is a schematic diagram illustrating a developer amount regulation member according to a comparative example 1.

Description will be made regarding a developer amount regulation apparatus 4 according to the present example 1. The present comparative example applied to the developing apparatus according to the first embodiment is illustrated in FIG. 13. The developer amount regulation apparatus 4 according to the present example is basically similar to the developer amount regulation apparatus 4 described in the example 1, but the push-in amount of the developing roller 3 as to a developer amount regulation member is set to 0.3 mm. With the setting of the above-mentioned push-in amount, it is difficult to obtain contact pressure necessary for sufficiently causing the toner on the developing roller 3 to be reduced to a thin layer. So with the present comparative example, appropriate contact pressure is realized by employing a sheet thicker than that in the example 1 as the flexible sheet member 40 serving as a developer amount regulation member. Specifically, a urethane rubber with a thickness of 1.0 mm, and a hardness of 70° for JIS-A is employed as the flexible sheet member 40. In the event of applying no force to the flexible sheet member, the length in the widthwise direction thereof is 12.5 mm, the flexible sheet member is held by the recessed portion with a width of 5.0 mm of the sheet holding member 42, thereby forming a U-shape.

The flexible sheet member 40 according to the comparative example has a sheet thicker than that in the example 1, so elastic force thereof is high. Also, the push-in amount of the developing roller as to the sheet member 40 is not great as to the thickness thereof. Accordingly, the flexible sheet member 40 held in a U-shape is made to contact with the surface of the developing roller 3 in a state in which the curvature of the bending face scarcely changes. In this case, the buckling of the flexible sheet member 40 does not occur (the center portion of the flexible sheet member does not separate from the developing roller), so with the pressure distribution at the contact portion as to the developing roller 3, only one local maximum value which causes the contact pressure of the contact nip center portion to the maximum is formed.

Note that with the plate-like elastic member disclosed in Japanese Patent Laid-Open No. 6-250509 as well, as with the present comparative example 1, only one local maximum value is seemed to be formed as a pressure distribution as to the amount-of-developer bearing member.

Comparative Example 2

Figure 14A:
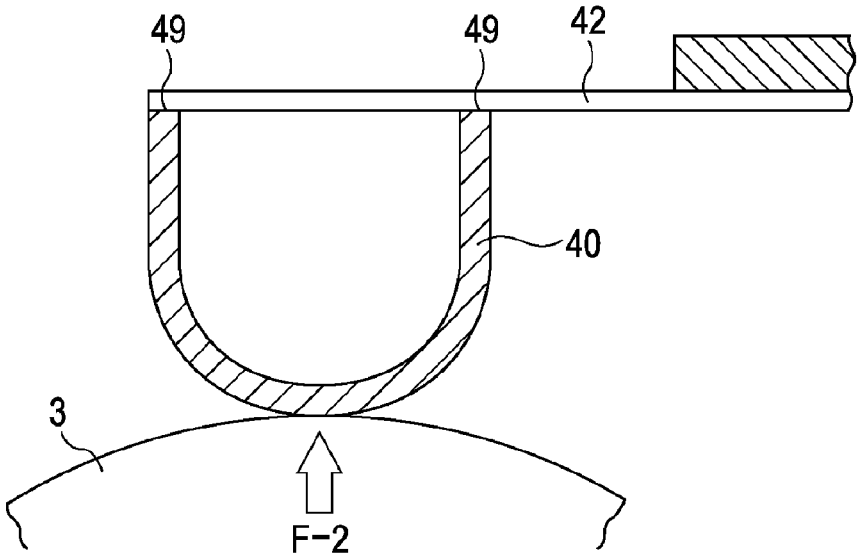
FIGS. 14A and 14B are schematic diagrams illustrating a developer amount regulation member according to a comparative example 2.

Description will be made regarding a developer amount regulation apparatus according to the present comparative example. The present comparative example applied to the developing apparatus according to the first embodiment is illustrated in FIG. 14. The developer amount regulation apparatus according to the present comparative example, as with the example 1, comprises a flexible sheet member 40 serving as a developer amount regulation member, and a sheet holding member 42. However, this differs from the example 1 in that when holding the flexible sheet member 40 in a U-shape, the side face of both end portions in the widthwise direction of the flexible sheet member is not regulated. The flexible sheet member 40 is held by both end faces in the widthwise direction (direction where the developing roller rotates) being adhered to the sheet holding member 42. FIG. 14A illustrates a state in which the developing roller 3 is not pushed in the flexible sheet member supported in a U-shape (when the pressure between the flexible sheet member and the developing roller is closed to zero).

Figure 14B:
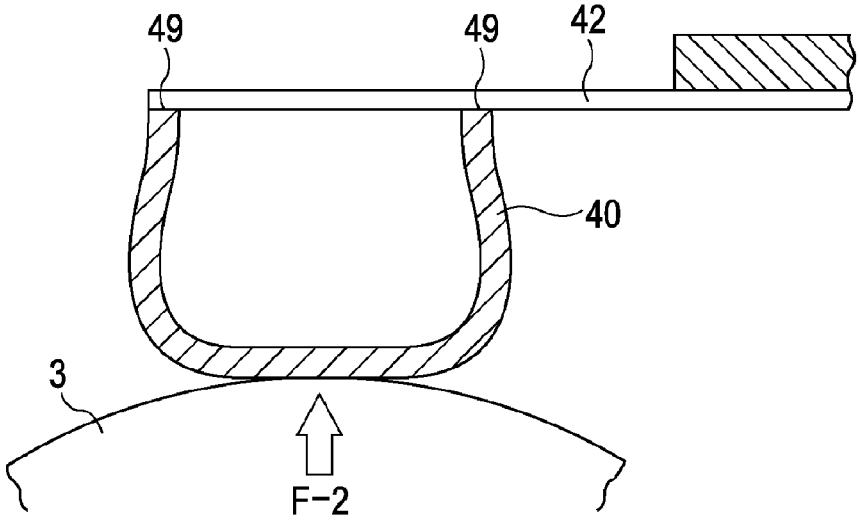

Also, FIG. 14B illustrates a state at the time of the developing roller 3 being pushed in the flexible sheet member 40 supported in a U-shape. The flexible sheet member 40 is made to contact with the developing roller 3 at an elastic portion having a hollow state at the center portion in a U-shape, and receives pressure force F-2. With this configuration, the sheet holding member 42 is not a recessed portion, whereby both end side faces of the flexible sheet member 40 are not regulated, so even if the push-in amount of the developing roller 3 increases, the flexible sheet member 40 can spread in the direction perpendicular to the pressure force F-2. Consequently, even in the event of setting the same push-in amount of the developing roller 3 as that in the example 1, the buckling of the flexible sheet member is prevented from occurring, and with the pressure distribution at the contact portion with the developing roller 3, only one local maximum value which causes the contact pressure of the contact nip center portion to the maximum is formed.

Also, as a configuration similar to the comparative example 2, there is a developing apparatus disclosed in Japanese Patent Laid-Open No. 11-265115.

Comparative Example 3

Figure 15:
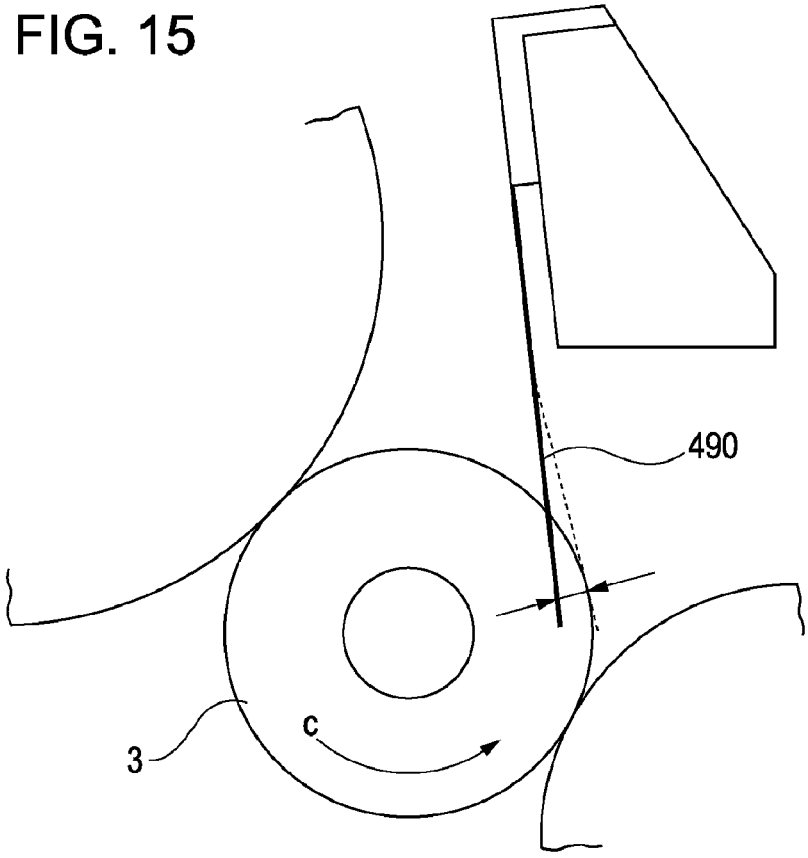
FIG. 15 is a schematic diagram illustrating a developer amount regulation member according to a comparative example 3.

Description will be made regarding a developer amount regulation apparatus according to the present comparative example. The developer amount regulation apparatus according to the present comparative example shown in FIG. 15 supports a thin-plate-shaped elastic member 490 such as a phosphor bronze plate, a stainless steel plate, or the like along one side in the longitudinal direction by a supporting metal plate fixed to the developer container. The underside of the facing portion of the thin-plate-shaped elastic member 490 serving as a developer amount regulation member is made to contact with the developing roller 3. With the present comparative example, an iron plate with a thickness of 1.2 mm is employed as a supporting metal plate, a phosphor bronze plate with a thickness of 120 μm is taken as the thin-plate-shaped elastic member 490, thereby adhering the supporting metal plate to the thin-plate-shaped elastic member 490. The distance from the supporting portion along one side in the longitudinal direction of the thin-plate-shaped elastic member 490 to the contact portion with the developing roller 3, i.e., so-called free length is 14 mm, and the push-in amount of the developing roller 3 as to the thin-plate-shaped elastic member 490 is 1.5 mm. Also, with such a configuration, only one local maximum value which causes the contact pressure of the contact nip center portion to the maximum is formed in a pressure distribution at the contact portion with the developing roller 3.

Comparative Example 4

Figure 16:
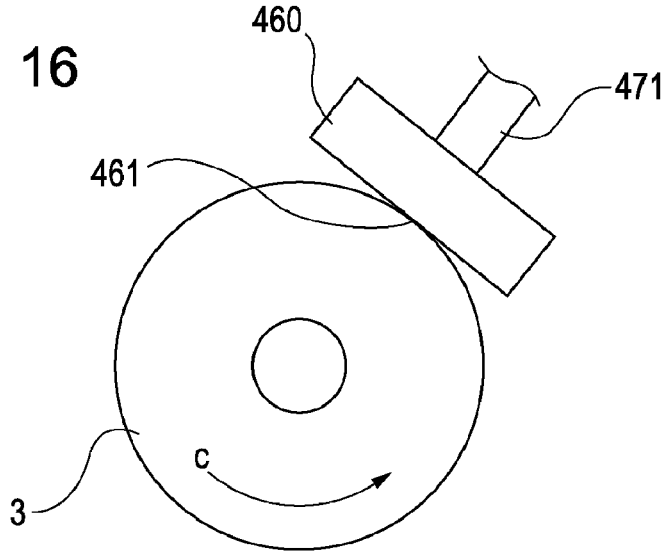
FIG. 16 is a schematic diagram of a developer amount regulation member circumference of a developing apparatus according to a comparative example 4.

Description will be made regarding a developer amount regulation apparatus according to the present comparative example shown in FIG. 16. The developer amount regulation apparatus according to the present comparative example comprises a blade 460 serving as a developer amount regulation member made up of a rigidity member which is in contact with the circumferential surface of the developing roller 3, and an elastic pressing unit 471 configured to press the single side of the blade 460 in the direction of being pressed against the circumferential surface of the developing roller 3. The blade 460 made up of a rigidity member includes a contact recessed portion 461 having the same curvature as the circumferential surface of the developing roller 3 at the single side thereof.

Thus, with the developing roller 3 and the contact nip portion of the regulation member, the overall sides of the contact recessed portion 461 come into contact with the circumferential surface of the developing roller 3 about evenly. Also, with a pressure distribution of the contact nip portion having such a configuration, only one local maximum value which causes the contact pressure of the contact nip center portion to the maximum is formed. Also, as a configuration similar to the present example, there is a developing apparatus disclosed in Japanese Patent Laid-Open No. 9-34247.

Comparative Example 5

Figure 17:
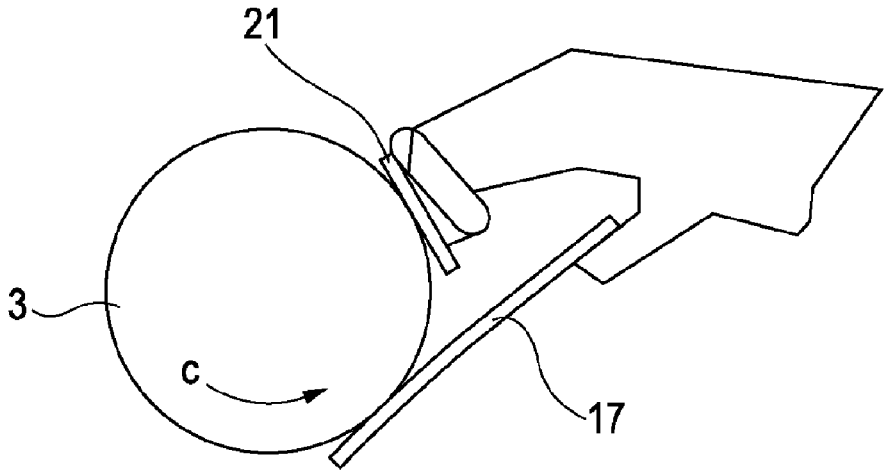
FIG. 17 is a schematic diagram of a developer amount regulation member circumference of a developing apparatus according to a comparative example 5.

Description will be made regarding a developer amount regulation apparatus according to the present comparative example. The developer amount regulation apparatus according to the present comparative example shown in FIG. 17 supports a thin-plate-shaped elastic member such as a phosphor bronze plate or the like along one side in the longitudinal direction. The thin-plate-shaped elastic member includes a first metal blade 17 which causes the underside of the facing portion thereof to make contact with the developing roller 3, and a second metal blade 21 at the downstream side of the first metal blade with respect to the rotation direction c of the developing roller 3, which is a configuration which makes contact with the developing roller 3 at two places. According to the present configuration, the contact portion with the developing roller 3 of each of the first blade 17 and second blade 21 includes a pressure distribution wherein one local maximum value is each formed at the nip center portion.

Also, as a configuration similar to the present example, there is a developing apparatus disclosed in Japanese Patent Laid-Open No. 6-95484.

Comparative Example 6

Figure 18:
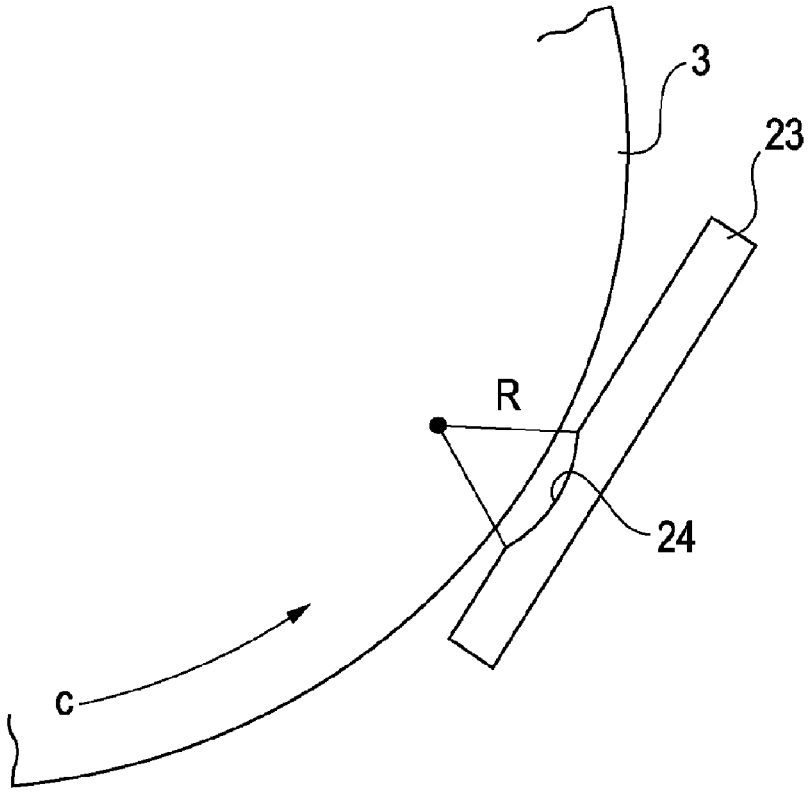
FIG. 18 is a schematic diagram of a developer amount regulation member circumference of a developing apparatus according to a comparative example 6.

A developer amount regulation apparatus according to the present comparative example is illustrated in FIG. 18. A metal blade 23 which is in contact with the developing roller 3 includes an arc-shaped recessed portion 24 at the contact portion, which is a configuration satisfying a relation of $0<R\leqq r$ when assuming that the radius of the developing roller 3 is r, and the curvature radius of the recessed portion 24 is R. At this time, two edge portions of the arc-shaped recessed portion 24 of the metal blade 23 are in contact with the developing roller 3. Here, the metal blade is a rigidity member, and is regarded as inflexible.

With such a configuration, the contact nip portion between the developing roller 3 and the metal blade 23 includes a first edge contact portion at an upstream portion of the contact nip, a region where the contact nip center portion is not in contact with the developing roller 3, and a second edge contact portion at a downstream portion of the contact nip. The pressure distribution of the contact nip portion according to the present comparative example becomes a pressure distribution including two local maximum values, which includes a region where no contact pressure occurs at the contact nip portion center, and includes steep peak pressure at the first edge contact portion and second edge contact portion.

Also, as a configuration similar to the present example, there is a developing apparatus disclosed in Japanese Patent Laid-Open No. 6-95484.

Examples 3 and 4

The present examples 3 and 4 are examples wherein the developer amount regulation apparatus according to the example 1 is applied to the developing apparatus according to each of the second embodiment and the third embodiment.

Comparative Example 7

The present comparative example is an example wherein the developer amount regulation apparatus according to the comparative example 3 is applied to the developing apparatus according to the second embodiment.

Comparative Example 8

The present comparative example is an example wherein a developer amount regulation apparatus described below is applied to the developing apparatus according to the third embodiment. The developer amount regulation apparatus according to the present comparative example supports a polyurethane rubber or the like along one side in the longitudinal direction at a supporting metal plate fixed to the developer container, and makes the underside of the facing portion thereof contact with the developing sleeve. With the present comparative example, an iron plate with a thickness of 1.2 mm is employed as a supporting metal plate, and a polyurethane rubber plate with a thickness of 0.9 mm is adhered to the supporting metal plate as a developer amount regulation member. The distance from the supporting portion along one side in the longitudinal direction of the polyurethane rubber plate to the contact portion with the developing sleeve, i.e., so-called free length is 6.5 mm, and the push-in amount of the developing sleeve as to the polyurethane rubber is 3.1 mm. Also, with such a configuration, only one local maximum value which causes the contact pressure of the contact nip center portion to the maximum is formed in a pressure distribution at the contact portion with the developing sleeve.

Evaluation Method for Each Example and Comparative Example a) Precision Arranged to Set a Predetermined Pressure when Implementing Reduction in Size, and Cost Evaluation C: High precision is required to set a predetermined pressure when implementing reduction in size, which increase costs.

A: High precision is not required to set a predetermined pressure when implementing reduction in size, which increase no cost.

b) Longitudinal Image Concentration Unevenness after Endurance Test

Image evaluation was made by outputting a solid image where black is printed on the whole surface, and viewing whether or not there is image concentration unevenness over the longitudinal direction of the developer amount regulation apparatus (laser main scanning direction).

C: Longitudinal image concentration unevenness is observed.

A: Longitudinal image concentration unevenness is not observed.

The longitudinal image concentration unevenness evaluation was performed after test printing of 4000 recording sheets. The test printing was performed by continuously feeding sheets with a recorded image of horizontal lines with an image ratio of 5%.

c) Image Concentration Unevenness Due to Traces of Pressing

Concentration unevenness was evaluated, which is generated during a developing roller cycle due to change in a local shape such as a recess of the developing roller. The present evaluation has been made wherein a developing cycle is calculated accurately while taking process speed, and a peripheral-speed ratio between the photosensitive drum and the developing roller into consideration, thereby extracting image errors having the same cycle. Though the size of an image error differs depending on the size of the recess of the developing roller, the length in the laser sub scanning direction (the direction where the developing roller rotates) is 1 through 2 mm or so, and the length in the laser main scanning direction (the longitudinal direction of the developer amount regulation apparatus) is crossed to the whole region. With the present evaluation, two types of images of a solid image where black is printed on the whole surface, and a halftone image have been employed. A halftone image means a striped pattern wherein one line in the main scanning direction is recorded, following which one line is not recorded, and represents halftone concentration as a whole.

The evaluation was made with the following standards by viewing whether or not there is an image error.

C: Both two types of a solid image and a halftone image include an image error.

B: A solid image includes an image error, but a halftone image includes no image error.

A: Both two types of a solid image and a halftone image include no image error.

Note that with the present evaluation, a developing apparatus was employed, which had been left under a normal temperature normal-relative-humidity environment (23 and 50%) for ten months.

d) Ghosting

The image evaluation was made wherein a patch of 25 mm around is developed at the image tip portion (at the 1st round of the developing-roller rotation), and the concentration difference in a patch shape which appears on a halftone image at the 2nd or less round of the developing-roller rotation is evaluated as a ghost image. Also, a developing cycle has been calculated correctly while taking process speed, and a peripheral-speed ratio between the photosensitive drum and the developing sleeve, etc. into consideration, and an image error of this cycle was extracted.

The evaluation was made with the following standards by viewing whether or not there is an image error.

C: Ghosting is observed.

A: Ghosting is not observed.

The evaluation was performed at the time of the first 100 sheets being printed.

e) Pitch Unevenness

The image evaluation was made with a solid image where black is printed on the whole surface is output, and pitch unevenness generated at an unspecific cycle is regarded as an image error.

The evaluation has been made with the following standards by viewing whether or not there is an image error.

C: Pitch unevenness is observed.

A: Pitch unevenness is not observed.

The evaluation was performed at the time of the first 100 sheets being printed.

Evaluation Results

The evaluation results regarding the examples and the comparative examples are summarized in the following Table 1.

TABLE 1

| Examples and Comparative examples | a) Precision and cost when reduction in size | b) Longitudinal image concentration unevenness after endurance test | c) Image concentration unevenness from pressing | d) Ghosting | e) Pitch unevenness |
|---|---|---|---|---|---|
| Example 1 | A | A | A | A | A |
| Example 2 | A | A | A | A | C |
| Comparative example 1 | C | C | C | A | A |
| Comparative example 2 | C | C | B | A | A |
| Comparative example 3 | C | C | C | A | A |
| Comparative example 4 | C | C | C | A | A |
| Comparative example 5 | C | C | C | A | A |
| Comparative example 6 | C | C | C | A | A |
| Example 3 | A | A | A | A | A |
| Comparative example 7 | C | C | A | A | A |
| Example 4 | A | A | A | A | A |
| Comparative example 8 | C | C | A | C | A |

Superiority Over Conventional Technology

First, superiority as to the comparative examples, relating to a blade-shaped developer amount regulation member, which is a common conventional technique, will be described. Specifically, description will be made regarding the examples 1, 3, and 4, and the comparative examples 3, 7, and 8.

a) Precision and Cost when Reduced in Size

The comparative examples 3, 7, and 8 are blade-shaped developer amount regulation members which are common conventional techniques, but include a problem wherein it is difficult to realize reduction in size. Such a blade-shaped developer amount regulation member supports a thin-plate-shaped elastic member along one side in the longitudinal direction, and causes the underside of the facing portion thereof to make contact with the developing roller 3. With these comparative examples, upon reduction in size being performed, the distance from a supporting point where the thin plate is supported along one side in the longitudinal direction to the contact point with the developing roller 3, i.e., free length becomes short. Thus, change in contact pressure as to the push-in amount of the developing roller 3, i.e., a spring constant increases.

Figure 4:
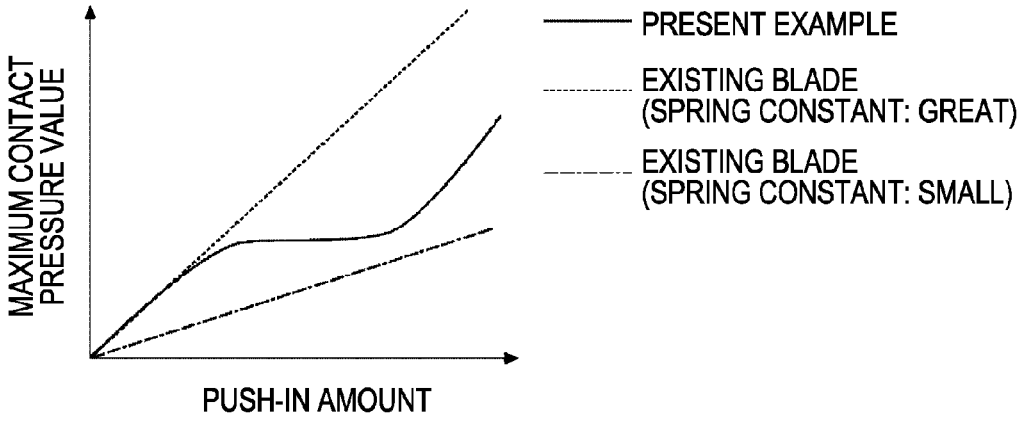
FIG. 4 is a graph illustrating the relation between the push-in amount by a developing roller and a local maximum value of contact pressure according to a developer amount regulation member of the present invention.

Now, FIG. 4 illustrates a relation between the push-in amount of the developing roller 3 as to the developer amount regulation member and the local maximum value of contact pressure. With a developer amount regulation member having a conventional configuration, the position where the contact pressure with the developing roller 3 becomes the maximum is the contact nip center portion. At this time, the local maximum value of contact pressure as to the push-in amount of the developing roller 3 increases in linearity, though an inclination differs depending on a spring constant due to each configuration.

Thus, with a developer amount regulation member having a conventional configuration, the local maximum value of contact pressure changes along with change in a setting position. With a blade-shaped developer amount regulation member, upon reduction in size being performed, the spring constant of contact pressure increases, whereby high assembly precision is required.

On the other hand, with the developer amount regulation members according to the present examples 1, 3, and 4, as shown in FIG. 4, there is a region where the local maximum value of contact pressure with the developing roller 3 does not change in proportion to the push-in amount of the developing roller 3. Accordingly, even if an error arises in the push-in amount of the developing roller 3, the local maximum value of contact pressure cannot change easily. In other words, even if there is no need to provide assembly with high precision, a desired local maximum value of contact pressure can be set in a stable manner. Description will be made below regarding the reason why there is a region where the local maximum value of contact pressure with the developing roller 3 does not change in proportion to the push-in amount of the developing roller 3.

With the descriptions in FIGS. 1D, 1E, and 1F of the present example 1, the contact configuration between the developer amount regulation member and the developing roller 3 has been described. According to those descriptions, in the event of the push-in amount of the developing roller 3 exceeding a predetermined amount, a "slack" portion is generated by buckling which occurs at the contact nip center portion, so contact pressure at the contact nip center portion decreases. That is to say, the flexible sheet member 40 is apart from the developing roller 3 toward FIG. 1*f* from FIG. 1E, whereby contact pressure at the contact nip center portion decreases. Consequently, the pressure distribution within the contact nip includes two local maximum values.

Figure 5A:
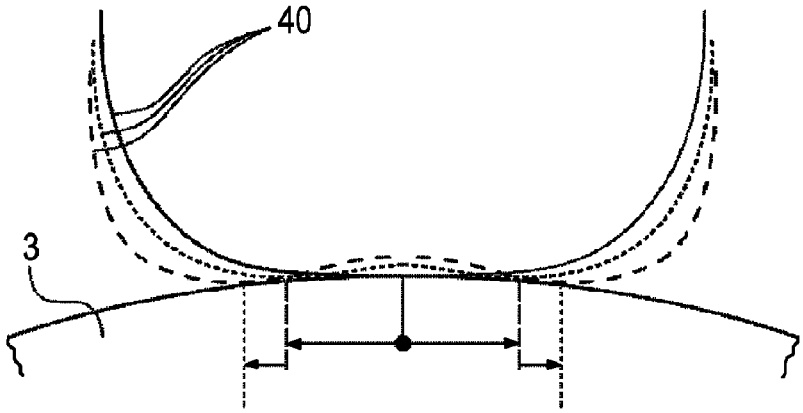
FIGS. 5A and 5B are schematic diagrams illustrating the transition of a deformed state of a flexible sheet member according to the developer amount regulation member of the present invention.

FIG. 5A illustrates the transition of a deformed state of the flexible sheet member 40 as to increase in the push-in amount of the developing roller 3. The push-in amount of the developing roller 3 increases in the order of a solid line, a dotted line (short dotted line), and a dashed line (long dotted line) from the top to bottom of FIG. 5A. First, in the event that the push-in amount of the developing roller shown in a solid line is small, contact pressure becomes the local maximum value at the contact nip center portion. Next, in the event that the push-in amount of the developing roller 3 increases to make the transition to the deformed state shown in a dotted line, a "slack" portion is generated at the contact nip center portion, the position of the local maximum value of contact pressure moves to the upstream side and downstream side as to the direction c where the developing roller rotates from the nip center portion. Further, in the event that the push-in amount of the developing roller increases to make the transition to the deformed state shown in a dashed line, the position of the local maximum value of contact pressure further moves to the upstream side and downstream side as to the direction c where the developing roller rotates.

Figure 5B:
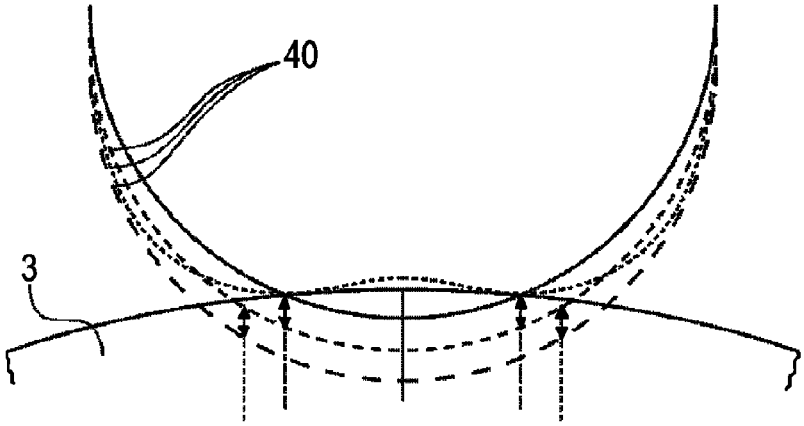

FIG. 5B illustrates the overlapped amount between the developing roller 3 and the flexible sheet member 40. A solid line, a dotted line (short dotted line), and a dashed line (long dotted line) correspond to those in FIG. 5A in the order from the top of FIG. 5B. It can be understood that upon arcs having a constant curvature being overlapped, the overlapped amount thereof becomes the maximum at the center of the contact portion, and the overlapped amount thereof gradually becomes small as the overlapped position moves to the upstream side and downstream side. However, with the present configuration, a "slack" is generated at the contact nip center portion where contact pressure originally becomes the maximum, and contact pressure decreases. Further, as described regarding FIG. 5A, the position where contact pressure becomes the maximum instead of the original position moves to the upstream side and downstream side where the overlapped amount becomes small. Accordingly, in the event of the deformed states of the dotted line and dashed line in FIG. 5A, change in the overlapped amount represented with the length of the arrow shown in FIG. 5B is small. Consequently, the local maximum value of contact pressure does not change in corporation to increase in the push-in amount of the developing roller, whereby almost a specific value can be maintained. As described above, as shown in FIG. 4, there is a region where the local maximum value of contact pressure is not changed in proportion to increase in the push-in amount of the developing roller 3. Thus, with the present example, a desired local maximum value of contact pressure can be set in a stable manner, so there is no need to obtain high precision at the time of assembly.

Also, when performing reduction in size regarding the developing roller 3, the curvature of the roller becomes great, and consequently, a tendency wherein the local maximum value of contact pressure is not changed in proportion to increase in the push-in amount of the developing roller 3 becomes further pronounced. Accordingly, this tendency is very advantageous for reduction in size of a developing apparatus.

b) Longitudinal Image Concentration Unevenness after Endurance Test

Next, the superiority of the present invention will be described regarding longitudinal image concentration unevenness after an endurance test. With the developer amount regulation members according to the comparative examples 3, 7, and 8, longitudinal image concentration unevenness of a solid image occurs after an endurance test. This is because the variation in toner degradation conditions occurs over the longitudinal direction after an endurance test. As described above, with a developer amount regulation member having a conventional configuration, the local maximum value of contact pressure increases as to the push-in amount of the developing roller 3 in linearity.

Upon the local maximum value of contact pressure between the developing roller 3 and the developer amount regulation member increasing, regulation force caused by the developer amount regulation member as to toner is enhanced, so it is effective to prevent toner from excessive passing through without regulation. However, as a result of increase in stress to toner by the developer amount regulation member, toner is readily crushed and melted at the developer amount regulation member, thereby promoting toner degradation to shorten the life thereof markedly.

With a developer amount regulation member having a conventional configuration, the variation in production, the circumferential deflection of the developing roller 3, and so forth cause the variation in the push-in amount of the developing roller 3 as to the developer amount regulation member to occur over the longitudinal direction. Thus, it can be conceived that the variation in the local maximum value of contact pressure between the developing roller 3 and the developer amount regulation member occurs over the longitudinal direction. Thus, the variation in toner degradation conditions occurs over the longitudinal direction through an endurance test, and consequently, longitudinal image concentration unevenness occurs on a solid image after an endurance test.

On the other hand, with the developer amount regulation members according to the present examples 1, 3, and 4, there is a region where the local maximum value of contact pressure between the developer amount regulation member and the developing roller 3 does not increase as to the push-in amount of the developing roller 3. Accordingly, as long as usage is restricted to this region, the variation in the push-in amount of the developing roller 3 as to the developer amount regulation member over the longitudinal direction can be absorbed. Thus, the longitudinal image concentration unevenness of a solid image can be prevented even after an endurance test.

c) Image Concentration Unevenness Due to Traces of Pressing

Next, the results of comparison between the example 1 and the comparative example 3 will be described regarding superiority of the present invention as to the image concentration unevenness due to change in a local shape such as a recess of the developing roller 3 according to the first embodiment.

Upon the developing roller 3 having an elastic layer being pressed against the same portion of the developer amount regulation member or the like for a long term, a recess occurs at the pressing portion as a permanent compressed distortion. Upon a conventional developer amount regulation member being applied to the developing roller 3 where the recess occurs, change in the amount of toner coat serving as the amount of developer on the developing roller 3 occurs at a portion including change in a local shape such as a recess. On the other hand, in the event of the contact developing method, developing is performed with high developing efficiency, so the unevenness of the amount of toner coat on the developing roller 3 is reflected on an image as it is.

On the other hand, with the example 1, image concentration unevenness due to change in a local shape such as a recess of the developing roller 3 is suppressed. As described above, with the example 1, the contact nip portion between the developing roller 3 and the flexible sheet member 40 includes a contact region A1 at the nip upstream portion, a region A2 where a slack 7 having low contact pressure occurs at the nip center, and a contact region A3 at the nip downstream portion. As an action of this configuration, the flexible sheet member 40 can perform local deformation corresponding to change in a local shape such as a recess of the developing roller 3. That is to say, the flexible sheet member 40 can follow the recess of the developing roller 3.

Figure 6A:
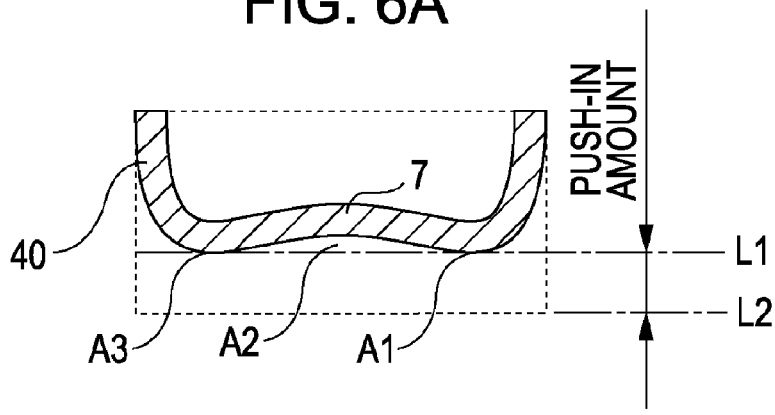
FIGS. 6A trough 6C are schematic diagrams illustrating a deformed state of a flexible sheet member as to a hollow of a developing roller regarding the developer amount regulation member of the present invention.

Description will be made below regarding the mechanism thereof with reference to FIG. 6. FIG. 6A models and illustrates a contact state of the flexible sheet member 40 according to the present example as to the developing roller 3. L1 linearly illustrates the circumferential surface of the developing roller 3 when pushing the developing rollers 3 in the flexible sheet member 40 by a predetermined amount. Also, L2 illustrates the position of the ark peak of the flexible sheet member 40 in a state in which the developing roller 3 is not pushed in (state in which the pressure between the flexible sheet member 40 and the developing roller 3 is almost zero). The distance between the L1 and L2 represents the push-in amount of the developing roller 3 as to the flexible sheet member 40. Next, L3 in FIGS. 6B and 6C linearly illustrates the circumferential surface of the developing roller 3 at a portion which changed in a local shape such as a recess of the developing roller 3 or the like, and the distance between the L1 and L3 represents the recessed amount (space) of the developing roller 3.

Figure 6B:
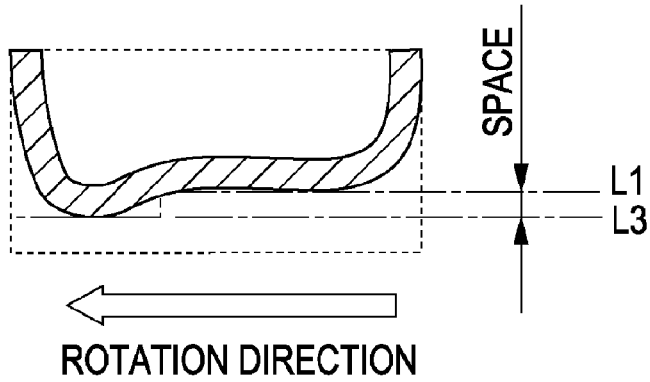
Figure 6C:
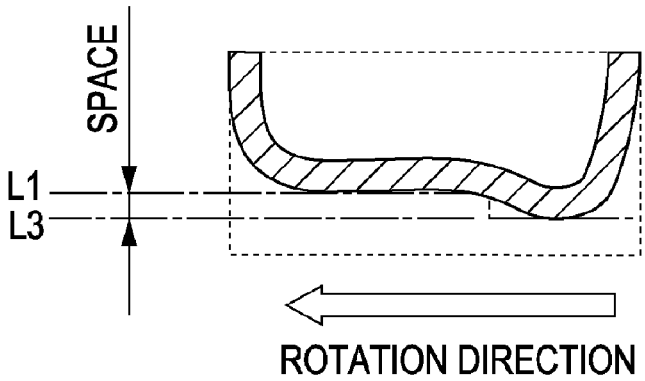

First, FIG. 6C illustrates a contact state when a portion including change in a local shape such as a recess of the developing roller 3 or the like along with the rotation of the developing roller 3 enters the contact nip portion. The nip upstream portion A1 of the flexible sheet member 40 deforms in accordance with change in a shape of the developing roller 3 such as shown in FIG. 6C. At this time there is a "slack" 7 of the nip center portion A2, whereby the nip upstream portion A1 can deform in accordance with change in a shape without having an affect on the nip downstream portion A3.

Next, FIG. 6B illustrates a contact state when a portion including change in a shape gets out of the nip. The nip downstream portion A3 of the flexible sheet member 40 deforms in accordance with change in a shape. At this time as well, as with at the time of entering the nip, there is a "slack" 7 of the nip center portion A2, whereby the nip downstream portion A3 can deform in accordance with change in a shape without having an affect on the nip upstream portion A1.

In other words, the presence of the "slack" 7 of the sheet center portion enables the nip upstream portion A1 and nip downstream portion A3 of the flexible sheet member 40 to deform so as to follow change in a local shape such as a recess of the developing roller 3. Accordingly, contact pressure and the fluctuation of the toner taking-in width of the contact nip entrance can be suppressed markedly. Thus, change in the amount of toner coat on the developing roller 3 as much as the amount which causes an image error can be suppressed. Consequently, the image concentration unevenness at a developing roller cycle due to change in a local shape such as a recess of the developing roller 3 can be suppressed markedly.

On the other hand, with the developer amount regulation member according to the comparative example 3, concentration unevenness due to change in a local shape such as a recess of the developing roller 3 occurs on both two types of a solid image and a halftone image as an image error. With the comparative example 3, the metal thin plate is supported along one side in the longitudinal direction to be made to contact with the developing roller 3. With such a configuration, in the event of a portion including change in a local shape entering the contact nip portion along with the rotation of the developing roller 3, the rigidity included in the metal thin plate prevents change in a local shape in accordance with change in a shape such as a recess of the developing roller 3. Therefore, with a portion including change in a local shape such as a recess of the developing roller 3, contact pressure and the toner taking-in width of the contact nip entrance fluctuate, which causes unevenness of the amount of toner coat on the developing roller 3. Consequently, am image error occurs as image concentration unevenness at a developing roller cycle.

d) Ghosting

Next, the results of comparison between the example 4 and the comparative example 8 will be described regarding superiority of the present invention with regard to ghost images which occur corresponding to a cycle of the developing sleeve serving as the developer bearing member according to the third embodiment.

With the comparative example 8, a ghost occurs at a developing sleeve cycle. This is caused by occurrence of unevenness of the amount of toner coat and the amount of toner charged on the developing sleeve 3*a*. Now, the developing sleeve 3*a* portion corresponding to an image portion of the photosensitive member consumes toner, so the amount of toner on the developing sleeve 3*a* decreases. On the other hand, the toner of the developing sleeve 3*a* portion corresponding to a non-image portion of the photosensitive member is not consumed, so the amount of toner on the developing sleeve 3*a* remains without changing. Incidentally, the developing apparatus according to the third embodiment includes no supply roller configured to supply developer to the developing roller, and supply of toner is performed in a magnetic manner. In the event of providing no supply roller, supply of toner to the developing roller is not performed mechanically, so the deference in the amount of toner supplied immediately before the developer amount regulation member 4 is readily caused depending on whether or not toner is consumed at the developing portion. Consequently, ghosting at a developing sleeve cycle readily occurs.

With the comparative example 8, it can be conceived that the contact pressure of the developer amount regulation member readily changes in accordance with the amount of supplied toner, and a developing-history-related ghost image occurs. On the other hand, the example 4 markedly suppresses ghosting at the developing sleeve cycle. This is because even with the difference of the amount of toner occurring on the developing sleeve 3*a* after developing, the developer amount regulation member 4 according to the example 4 can uniform not only contact pressure but also the amount of toner coat.

Further, toner is supplied in a magnetic manner, so uncharged toner is supplied at a portion where toner is consumed at the developing portion until immediately before the developer amount regulation member 4. Therefore, in order to suppress a ghost image, it is necessary to provide appropriate charge to toner during one-time passage of the developer amount regulation member 4. With the present example, charging is performed twice of the peak pressure at the upstream side and the peak pressure at the downstream side, so uncharged toner newly supplied can be subjected to sufficient charging.

As described above, with the present example, ghosting during a developing sleeve cycle can be suppressed markedly.

Superiority as to Comparative Technology

Next, the difference with the first embodiment as to comparative technology will be described. Specifically, the example 1 and the comparative examples 1, 2, and 4 through 6 will be compared.

a) Precision and Cost when Reduction in Size

First, the superiority of the present invention regarding influence when implementing reduction in size will be shown. The comparative example 1 whose sheet thickness is thicker than that in the example 1, so elastic force is high. Therefore, even in the event that the push-in amount of the developing roller 3 is increased, the flexible sheet member 40 supported in a U-shape comes into contact with the surface of the developing roller 3 in a state in which the curvature of the curved surface thereof is almost unchanged. With the comparative example 1, upon the push-in amount of the developing roller increasing, the local maximum value of contact pressure increases linearly. Therefore, it is necessary to implement assembly with extremely high precision when performing reduction in size.

Next, with the comparative example 2 shown in FIG. 14, when supporting the flexible sheet member 40 in a U-shape, the sides of both end portions in the widthwise direction of the flexible sheet member 40 are not regulated. Therefore, as with the comparative example 1, upon the push-in amount of the developing roller increasing, the local maximum value of contact pressure increases linearly, so it is difficult to set the local maximum value of contact pressure to a predetermined value in a stable manner.

Also, with the comparative example 2, the sides of both end portions in the widthwise direction of the flexible sheet member are not regulated, as described above. Therefore, collapsing readily occurs at the downstream side in the rotation direction c of the developing roller 3 by receiving the force in the circumferential direction due to frictional force at the contact portion with the developing roller 3. As a result thereof, a problem is readily caused wherein the state of the flexible sheet member 40 serving as the developer amount regulation member readily fluctuates, and the contact position is unstable.

Also, with the developer amount regulation member having a contact recessed portion of generally the same curvature as the circumferential surface of the developing roller 3 such as the comparative example 4, in order to make contact with the circumferential surface of the developing roller 3 over the longitudinal direction thereof in a stable manner, it is necessary to ensure surface accuracy. Therefore, processing with extremely high precision is required.

The comparative example 5 has a configuration including a first metal blade 17 and a second metal blade 21 in the rotation direction c of the developing roller 3. The reason why each unit of metal blade fails to be subjected to reduction in size is the same as that in the comparative example 3. Additionally, there are a plurality of metal blades in the rotation direction c of the developing roller 3, which further makes it difficult to perform reduction in size.

Also, with the comparative example 6, a blade 23 including a recessed portion 24 having smaller curvature radius than the radius of the developing roller 3 is made to contact with the developing roller 3, so two edges are made to contact with the inside of one contact nip.

The sharp edge portions of the inflexible metal blade are made to contact with the developing roller 3, so the local maximum value of contact pressure excessively increases as to change in the push-in amount of the developing roller 3. Reduction in size manifests this influence appears markedly.

Also, with the contact state of the edge portions of the metal blade, the nip width is extremely narrowed, which is infinitely close to line contact. In order to cause the two edges to make contact with the developing roller 3 having a curvature over the longitudinal direction in a stable manner, assembly with extremely high precision is required.

On the other hand, with the developer amount regulation member 4 according to the example 1, as shown in FIG. 4, there is a region where the local maximum value of contact pressure is not changed in proportion to increase in the push-in amount of the developing roller 3. Thus, a desired local maximum value of contact pressure can be set in a stable manner, so there is no need to obtain high precision at the time of assembly. Also, with the example 1, as a result of the developing roller 3 being made to contact with the developer amount regulation member 4 by push-in, with the contact portion between the developer amount regulation member 4 and the developing roller 3, a state is formed wherein the developer amount regulation member 4 is made to contact with two points of the upstream side and downstream side in the rotation direction c of the developing roller 3. Therefore, even with a simple assembly, a contact state can be always realized in a stable manner. As described above, with the developer amount regulation member 4 according to the example 1, there is no need to provide high assembly accuracy even when implementing reduction in size.

Also, regardless of the example 1, like all of the other examples, the contact surface of the developer amount regulation member as to the developer bearing member may be a smooth surface without steps and edges. This is because like the comparative example 6, upon a step or edge being made to contact with the developing roller, as described above, local stress concentration arises. In this case, assembly accuracy is demanded, which makes assembly difficult. Also, like the comparative example 6, providing a step or edge makes it difficult to mold the developer amount regulation member.

b) Longitudinal Image Concentration Unevenness after an Endurance Test

Next, description will be made regarding the superiority of the present invention as to longitudinal image concentration unevenness after an endurance test. With the developer amount regulation members according to the comparative examples 1, 2, 4 through 6, the longitudinal image concentration unevenness of a solid image occurs after an endurance test. As described above, with a developer amount regulation member having a conventional configuration, the local maximum value of contact pressure increase linearly as to the push-in amount of the developing roller 3.

With a developer amount regulation member having a conventional configuration, in the event that the variation in the push-in amount of the developing roller 3 as to the developer amount regulation member over the longitudinal direction occurs due to the variation in production, the circumferential deflection of the developing roller 3, and so forth, the variation in the local maximum value of contact pressure between the developer amount regulation member and the developing roller 3 occurs over the longitudinal direction. Thus, the variation in toner degradation conditions occurs over the longitudinal direction through an endurance test, and consequently, the longitudinal image concentration unevenness of a solid image occurs after an endurance test.

On the other hand, with the developer amount regulation member 4 according to the present invention, there is a region where the local maximum value of contact pressure between the developer amount regulation member 4 and the developing roller 3 does not increase as to the push-in amount of the developing roller 3. Therefore, as long as usage is restricted to this region, the variation in the push-in amount of the developing roller 3 as to the developer amount regulation member 4 over the longitudinal direction can be absorbed. Thus, the longitudinal image concentration unevenness of a solid image can be prevented even after an endurance test.

c) Image Concentration Unevenness Due to Traces of Pressing

Next, description will be made regarding the superiority of the present invention as to concentration unevenness due to change in a local shape such as a recess of the developing roller 3.

First, with the developer amount regulation member according to the comparative example 1, concentration unevenness at a developing roller cycle due to change in a local shape such as a recess of the developing roller 3 occurs on both two types of a solid image and a halftone image as an image error. With the comparative example 1, even in the event of increasing the push-in amount of the developing roller 3, the developer amount regulation member is made to contact with the surface of the developing roller 3 in a state in which the curvature of the curved surface thereof is almost not changed. At this time, the pressure distribution at a contact nip formed between the developing roller 3 and the flexible sheet member 40 includes one local maximum value, and also no "slack" at the contact nip center portion. Therefore, it is difficult for the regulation member to sufficiently follow change in a local shape such as a recess of the developing roller 3, so unevenness occurs on the amount of toner coat on the developing roller 3. As a result thereof, an image error occurs as concentration unevenness at a developing roller cycle.

On the other hand, with the developer amount regulation member according to the present example 1, there is "slack" 7 at the contact nip center portion, whereby the nip upstream portion A1 and nip downstream portion A3 of the flexible sheet member 40 can deform so as to follow change in a local shape such as a recess of the developing roller 3. Therefore, contact pressure and the fluctuation of the toner taking-in width of the contact nip entrance can be suppressed markedly. Thus, change in the amount of toner coat on the developing roller 3 as much as the amount which causes an image error can be suppressed. Consequently, the image concentration unevenness at a developing roller cycle due to change in a local shape such as a recess of the developing roller 3 can be suppressed markedly.

Next, with the developer amount regulation member according to the comparative example 2, concentration unevenness at a developing roller cycle due to change in a local shape such as a recess of the developing roller 3 occurs on a solid image, but does not occur on a halftone image. With the comparative example 2, even in the event of increasing the push-in amount of the developing roller 3, the buckling of the flexible sheet member is prevented from occurring, and there is no "slack" at the contact nip center portion. With the pressure distribution at the contact portion with the developing roller 3, one local maximum value, which makes the contact pressure at the contact nip center portion the maximum, is formed. Therefore, it is difficult for the flexible sheet member 40 to sufficiently follow change in a local shape such as a recess of the developing roller 3, at the upstream side and downstream side of the nip as with example 1, so unevenness occurs on the amount of toner coat on the developing roller 3. As a result thereof, an image error occurs on a solid image as concentration unevenness at a developing roller cycle. However, concentration unevenness at a developing roller cycle does not occur on a halftone image. With the comparative example 2, a flexible member is employed, the amount of deformation from the initial state is great, operation attempting to revert back to the initial state works as to the push-in of the developing roller 3. A halftone image has a low developing efficiency as compared with a solid image, so in the event that change in the amount of toner coat is small, concentration unevenness to which change in the amount of toner coat is reflected is prevented from occurring. Consequently, with the comparative example 2, it can be conceived that change in the amount of toner coat as much as the amount which cause concentration unevenness within a halftone image is prevented from occurring.

Next, with the developer amount regulation member according to the comparative example 4, concentration unevenness at a developing roller cycle due to change in a local shape such as a recess of the developing roller 3 occurs on both two types of a solid image and a halftone image as an image error. The comparative example 4 is an example wherein between the developing roller 3 and the developer amount regulation member are subjected to surface contact, whereby a wide contact nip width is realized, and toner on the developing roller 3 is regulated. However, the quality of the employed material is a not flexible but rigidity member wherein the contact surface shape with the developing roller 3 is formed with generally the same curvature as the circumferential surface of the developing roller 3, and accordingly, it is difficult for this member to deform in accordance with change in a local shape such as a recess of the developing roller 3. Therefore, with a portion including change in a local shape such as a recess of the developing roller 3, contact pressure and the toner taking-in width of the contact nip entrance fluctuate, and unevenness occurs on the amount of toner coat on the developing roller 3. Consequently, an image error occurs as image concentration unevenness at a developing roller cycle.

Also, with the developer amount regulation member according to the comparative example 5, concentration unevenness at a developing roller cycle due to change in a local shape such as a recess of the developing roller 3 occurs on both two types of a solid image and a halftone image as an image error. The comparative example 5 has a configuration including the first metal blade 17 and the second metal blade 21 in the rotation direction c of the developing roller 3. However, with the first metal blade 17 and the second metal blade 21, the advantages and mechanism to be applied by each metal blade to toner on the developing roller 3 are the same as those in the comparative example 3. Therefore, according to the reason described in comparison with the comparative example 3, image concentration unevenness at a developing roller cycle due to change in a local shape such as a recess of the developing roller 3 occurs.

Next, with the developer amount regulation member according to the comparative example 6, concentration unevenness at a developing roller cycle due to change in a local shape such as a recess of the developing roller 3 occurs on both two types of a solid image and a halftone image as an image error. With the comparative example 6, a blade including a recessed portion having smaller curvature radius than the radius of the developing roller 3 is made to contact with the developing roller 3, so two edges are made to contact with the inside of one contact nip. With such a configuration, the pressure distribution at the contact nip portion assumes a two-peak distribution, which includes two local maximum values. However, the quality of the employed material is metal, and accordingly, it is difficult at each contact point to follow locally as to change in a shape of the developing roller 3, and consequently, image concentration unevenness at a developing roller cycle due to change in a local shape such as a recess of the developing roller 3 occurs.

Further, the local maximum value of contact pressure excessively increases since the edges of the blade are made to contact with the developing roller 3. Therefore, a recess of the developing roller 3 readily occurs at the time of long-term neglect, which is disadvantageous for suppression of image concentration unevenness due to a recess of the developing roller 3.

Lastly, description will be made regarding the example 2. With the developer amount regulation member 4 according to the example 2, as with the example 1, a contact nip portion between the developing roller 3 and the flexible tube member 41 includes a contact region A1 at the nip upstream portion, a region A2 at the nip center where contact pressure is low, and a "slack" 7 occurs, and a contact region A3 exists at the nip downstream portion. Therefore, there is a region where the local maximum value of contact pressure with the developing roller 3 does not change in proportion to the push-in amount of the developing roller 3. Therefore, a desired local maximum value of contact pressure can be set in a stable manner even without assembly with high precision when implementing reduction in size.

Also, as long as usage is restricted to the region where the local maximum value of contact pressure between the developer amount regulation member 4 and the developing roller 3 does not increase as to the push-in amount of the developing roller 3, the variation in the push-in amount of the developing roller 3 as to the developer amount regulation member 4 over the longitudinal direction can be absorbed. Therefore, the longitudinal image concentration unevenness of a solid image can be prevented even after an endurance test.

Also, there is a "slack" 7 at the contact nip center portion, so the nip upstream portion A1 and nip downstream portion A3 of the flexible tube member 41 can deform so as to follow change in a local shape such as a recess of the developing roller 3. Therefore, contact pressure and the fluctuation of the toner taking-in width of the contact nip entrance can be suppressed markedly. Thus, change in the amount of toner coat on the developing roller 3 as much as the amount which causes an image error can be suppressed. Consequently, the image concentration unevenness at a developing roller cycle due to change in a local shape such as a recess of the developing roller 3 can be suppressed markedly.

However, this member has a tube shape, i.e., an endless shape, so the movement when the peak position at the upstream or downstream following change in a shape is propagated at the rear side. Thus, unevenness at an unspecified cycle occurs on the amount of toner coat on the developing roller 3, and consequently, pitch unevenness occurs in an image.

With the above-mentioned examples, the number of local maximum values of the pressure distribution of the developer amount regulation member as to the developer bearing member is not restricted to two, and rather may be three or more.

Description will be made below regarding the operation and advantages of the above-mentioned example. The developer amount regulation member 4 according to the present example can realize improvement in performance with sufficient balance as to the problems included in a conventional developer amount regulation member (cost and evil when implementing reduction in size, longitudinal image concentration unevenness after an endurance test).

The developer amount regulation member 4 according to the present example does not need assembly with high precision even when implementing reduction in size for the following reasons. There is a region where the local maximum value of contact pressure does not change in proportion to an increase in the push-in amount of the developing roller 3. Thus, a desired local maximum value of contact pressure can be set in a stable manner, so there is no need to obtain high precision at the time of assembly. Also, with the present invention, as a result of the developing roller 3 being pushed in to make contact with the developer amount regulation member 4, the contact portion between the developer amount regulation member 4 and the developing roller 3 is formed in a state in which two points of the upstream side and the down stream side are made to contact with the rotation direction c of the developing roller 3. Therefore, even with a simple assembly, a stable contact state can be realized constantly.

Also, longitudinal image concentration unevenness after an endurance test can be suppressed effectively for the following reasons. With the developer amount regulation member 4 according to the present example, there is a region where the local maximum value of contact pressure between the developer amount regulation member 4 and the developing roller 3 does not increase as to the push-in amount of the developing roller 3. Therefore, as long as usage is restricted to the range of this region, the variation of the push-in amount of the developing roller 3 as to the developer amount regulation member 4 over the longitudinal direction can be absorbed, and longitudinal image concentration unevenness can be suppressed even after an endurance test.

Implementing the present example has enabled reduction in size of a developing apparatus to be performed, and also has enabled improvement in assembly performance with a simple configuration to be realized as compared with conventional technology. Also, developing with toner coat was performed for a long term in a stable manner.

Next, description will be made further in detail regarding another example of an image forming apparatus, and another embodiment of a developing apparatus with reference to the drawings. The following embodiment of a developing apparatus, as with the third embodiment of a developing apparatus, is a non-contact developing method, which is anther example of a method arranged to perform developing with a magnetic monocomponent developer.

Another Example of Image Forming Apparatus

Description will be made regarding the overall configuration and operation of another example of an image forming apparatus including a developing apparatus according to the present invention. FIG. 1 illustrates a schematic cross sectional view of an image forming apparatus 100 according to the present example. The image forming apparatus 100 is a laser printer employing a transfer electro-photography process.

The image forming apparatus 100 includes an OPC photosensitive member (hereafter, referred to as "photosensitive drum") as an image bearing member (developed member), which is a rotating-drum type having a diameter of 24 mm, and a negative polarity with the present example. The photosensitive drum 101 is rotationally driven with a constant speed of peripheral velocity (surface migration speed) 85 mm/sec in the clockwise direction of the arrow in the drawing. With the image forming apparatus 100 according to the present example, the peripheral velocity of the photosensitive drum 101 is equivalent to a process speed (printing speed).

A charging roller 102 serving as a charging unit of the photosensitive drum 101 is provided at the circumference of the photosensitive drum 101. The charging roller 102 can be a conductive elastic roller, and includes a core 102*a* and a conductive elastic layer 102*b* formed on the core 102*a*. The charging roller 102 is pressed against the photosensitive drum 101 by a predetermined pressing force. Thus, a charging unit (charging nip) c1 is formed between the charging roller 102 and the photosensitive drum 101. With the present example, the charging roller 102 is driven to rotate by the rotation of the photosensitive drum 101.

The charging roller 102 is connected with a charging bias power source S1 serving as a charging bias applying unit configured to apply a charging bias. With the present example, DC voltage, which is not less than breakdown voltage, is applied to a contact portion between the charging roller 102 and the photosensitive drum 101. Specifically, as a charging bias, a bias on which AC voltage having VPP of 1.4 kV, and a frequency of 1.3 kHz was superimposed is applied to DC voltage of −600 V, and the surface of the photosensitive drum 101 is subjected to contact charging evenly with charging potential (dark space potential) of −600 V.

Also, a laser beam scanner (exposure apparatus) 103 including a laser diode, a polygon mirror, and so forth is provided in the circumference of the photosensitive drum 101. The laser beam scanner 103 outputs a laser beam L which was subjected to enhanced modulation in accordance with a time-series digital pixel signal of target image information, and scans and exposes the uniform charging surface of the rotating photosensitive drum 101 with the laser beam L. In the event that the uniform charging processing surface of the photosensitive drum 101 is subjected to full-surface exposure with the laser beam L, laser power was adjusted such that the potential of the surface of the photosensitive drum 101 becomes −150 V. According to the scanning exposure with the laser beam L, an electrostatic image (latent image) corresponding to target image information is formed on the surface of the rotating photosensitive drum 101.

Figure 19:
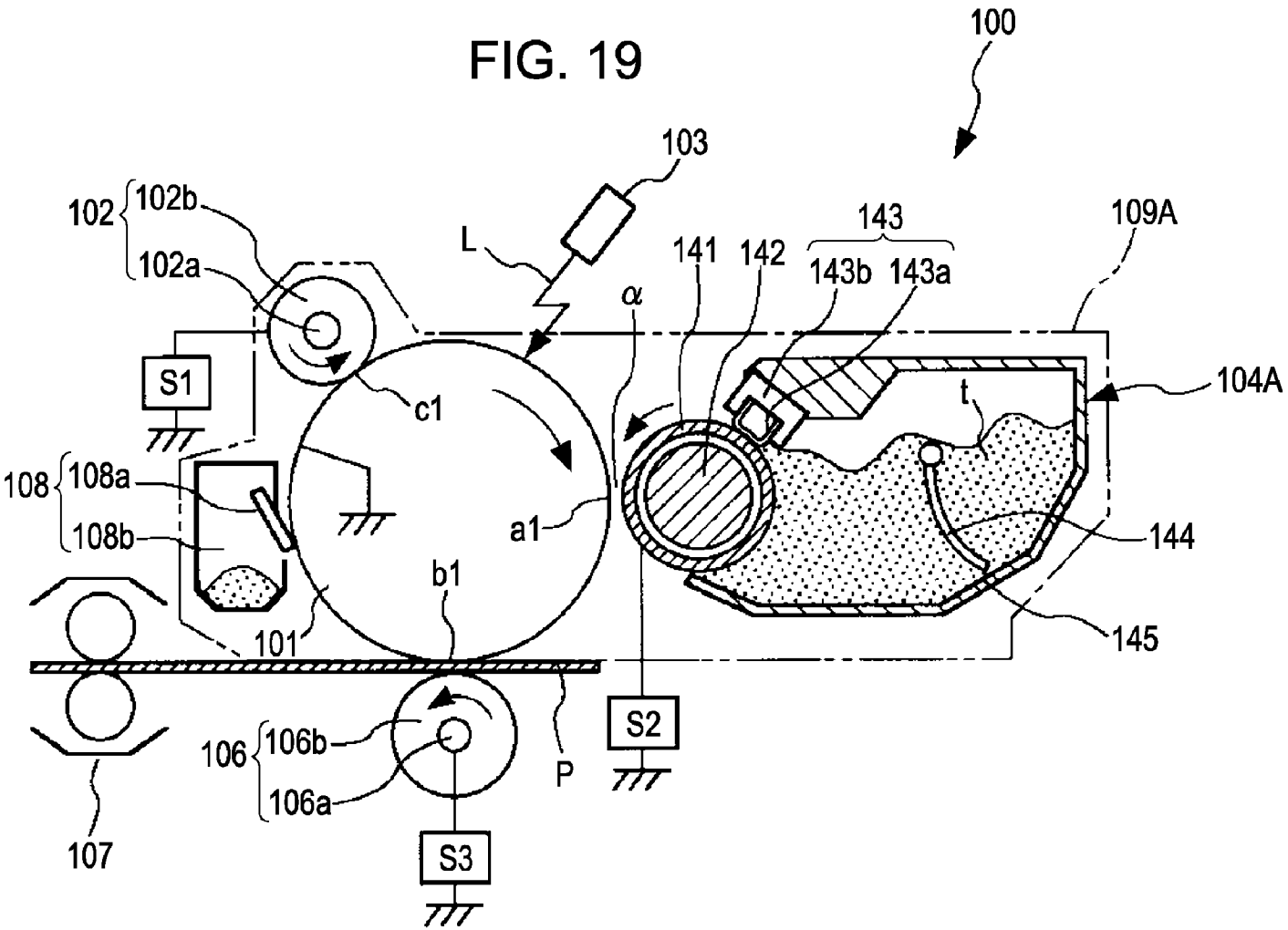
FIG. 19 is a schematic cross-sectional view of one example of an image forming apparatus according to the present invention.

Also, a developing apparatus 104A configured to develop an electrostatic image formed on the photosensitive drum 101 is provided in the circumference of the photosensitive drum 101. The developing apparatus 104A shown in FIG. 19 employs a later-described developer amount regulation apparatus 143 according to an example 5. Though the details thereof will be described later, the developing apparatus 104A stores magnetic monocomponent developer, i.e., toner (magnetic toner) t serving as a developer within a developer container 145 serving as a developer storing unit. The toner t is charged with a frictional charge. Subsequently, developing bias to be applied to between a developing sleeve 141 serving as a developer bearing member (developing member) and the photosensitive drum 101 develops an electrostatic latent image on the photosensitive drum 101 at a developing regional where the developing sleeve 141 and the photosensitive drum 101 face each other. The developing bias is applied with a developing bias power source S2 serving as a developing bias applying unit connected to the developing sleeve 141.

Also, a transfer roller 106 whose resistance is middle serving as a transfer unit is provided in the circumference of the photosensitive drum 101. The transfer roller 106 is pressed against the photosensitive drum 101 with predetermined contact pressure, and forms a transfer portion (transfer nip) b1. A transfer material P serving as a recorded member is supplied to the transfer nip b1 from a supply sheet portion with predetermined timing. Also, predetermined transfer bias voltage is applied to the transfer roller 106 from a transfer bias applying power source S3 serving as a transfer bias applying unit. Thus, a toner image at the photosensitive drum 101 side is sequentially transferred to the surface of a transfer material P supplied to the transfer nip b1.

The transfer roller 106 employed with the present example is a transfer roller having a roller resistance value of 5×108Ω. The transfer roller 106 includes a core 106*a* and a middle-resistance foaming layer 106*b* formed on the core 106*a*. Subsequently, transfer is performed by applying a transfer bias voltage of +2.0 kV to the core 106*a*. The transfer material P introduced in the transfer nip b1 is transported by the photosensitive drum 101 and the transfer roller 106 from the transfer nip b1 in a sandwiching manner. Subsequently, a toner image formed and borne on the surface of the photosensitive drum 101 is sequentially transferred to the surface side of the transfer material P by an electrostatic force and suppress strength.

The transfer material P which was supplied to the transfer nip b1, and was subjected to transfer of a toner image at the photosensitive drum 101 side, is separated from the surface of the photosensitive drum 101, and is introduced in a fixing apparatus 107 which employs a heat fusing method in this example. Upon fixing of a toner image thereupon, the transfer material P is discharged outside the apparatus as an image formation article (print copy).

Further, a cleaning apparatus 108 serving as a cleaning unit configured to clean the surface of the photosensitive drum 101 is disposed in the circumference of the photosensitive drum 101. The cleaning apparatus 108 scrapes toner remaining (transfer residual toner) on the photosensitive drum 101 at a cleaning blade 108*a*, and stores this in a waste toner container 108*b*. The photosensitive drum 101 thus cleaned is charged by the charging roller 102, and is repeatedly employed for image formation.

With the present example, the photosensitive drum 101, charging roller 102, developing apparatus 104A, and cleaning apparatus 108 are integrally formed as a cartridge, thereby making up a process cartridge 109A detachable as to the image forming apparatus main assembly. The process cartridge is a cartridge in which at least one of the photosensitive member, developing apparatus serving as a process unit configured to act on the photosensitive member, charging unit, and cleaning unit is integrally formed, and is detachable as to the image forming apparatus main assembly. The process cartridge conformed to the present example includes at least the photosensitive member and the developing apparatus. However, the cartridge detachable as to the image forming apparatus main assembly, in accordance with the present example, is not restricted to a process cartridge, rather, any cartridge may be employed as long as at least the developing apparatus is detachable as to the image forming apparatus main assembly. For example, a cartridge (developing cartridge) by which the developing apparatus is detachable as to the image forming apparatus may be employed.

Fourth Embodiment of Developing Apparatus

Figure 20:
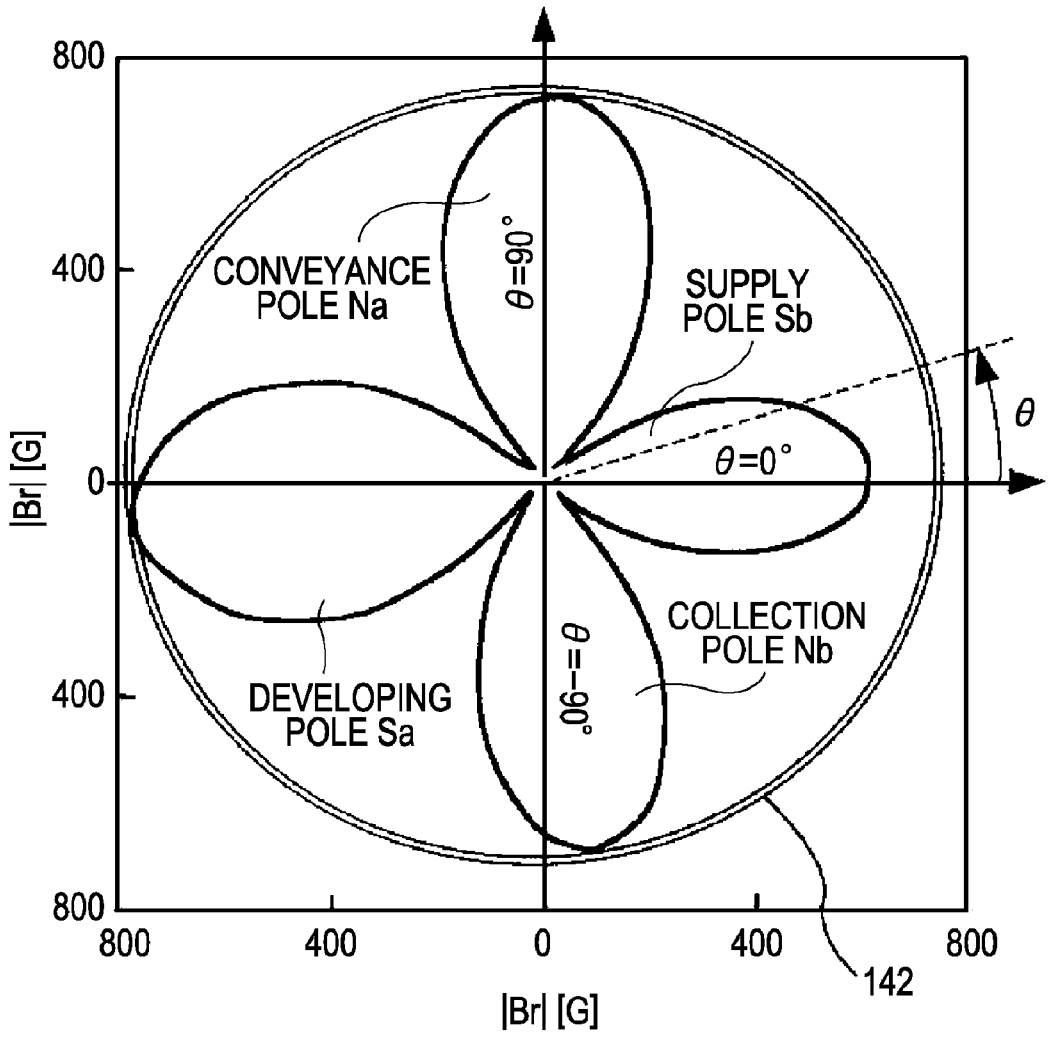
FIG. 20 is a graph illustrating one example of a magnet roll flux density distribution.

Next, description will be made further in detail regarding the developing apparatus according to the present embodiment. With the present embodiment, a metal sleeve on which a conductive resin is coated is employed for the developing sleeve 141 serving as a developer bearing member. The developing sleeve 141 is rotationally driven in the counterclockwise direction of the arrow in the drawing. That is to say, with the present embodiment, the photosensitive drum 101 and the developing sleeve 141 are rotated in the direction such that both surfaces are mutually moved in the forward direction at a facing portion. A fixed magnet roll 142 having a predetermined magnetic pole placement is provided within the developing sleeve 141 as a magnetic-field generating member configured to generate the magnetic field which draws at least toner t near to the developing sleeve 141. Specifically, the magnet roll 142 is a fixed magnet configured to generate magnetic force at each portion on the developing sleeve 141. With the present example, as shown in FIG. 20, the magnet roll 142 includes peak density at each portion of developing pole Sa, conveyance pole Na, supply pole Sb, and collection pole Nb. Note that N and S represent the N pole and S pole of a magnet respectively.

The measurement of flux density according to the present specification was performed with a gauss meter Series 9900 and Probe A-99-153 manufactured by Bell Inc. This gauss meter includes a rod-like axial probe connected to the gauss meter main unit. The developing sleeve is fixed horizontally, and the magnet roll inside thereof is attached so as to be rotated. The probe having level posture is disposed right-angled with a somewhat interval as to the developing sleeve. Also, the probe is fixed such that the center of the developing sleeve and the center of the probe are disposed on about the same horizontal surface, and measurement is performed in the state thereof. The magnet roll can be a cylindrical member which is generally concentric to the developing sleeve. It can be conceived that the interval between the developing sleeve and the magnet roll is equal even at any portion. Accordingly, the surface position of the developing sleeve and flux density in the normal-line direction at the surface position are measured while rotating the magnet roll, whereby the measurement results at all positions can be employed regarding the circumferential direction of the developing sleeve. The peak speed at each position was obtained from the obtained flux density data in the circumferential direction, and taken as Br. Subsequently, the size of the Br thereof is represented with polar coordinates.

Let us say that the origin of an angle θ is the position of the peak value of flux density in the normal-line direction of the supply pole Sb. With the present example, in particular, the peak position of flux density in the normal-line direction of the developing pole Sa is positioned within a developing regional where the photosensitive drum 1 and the developing sleeve 141 face each other. Also, as shown in FIG. 20, the peak positions of flux density in the normal-line direction of adjacent magnetic poles differ by generally 90 degrees in the circumferential direction of the developing sleeve 141. Note that let us say that the positive direction of the angle θ is the downstream direction from the origin (i.e., Sb→Na→Sa→Nb→Sb) in the surface movement direction (rotation direction) of the developing sleeve 141.

The toner (magnetic toner) t serving as a magnetic monocomponent developer is fabricated by mixing a binding resin, magnetic substance particles, and a charge control agent, passing through each process of kneading, grinding, and classification, and adding a fluidization agent etc. as an external additive. As for magnetic substance particles, magnetic particles capable of conveyance with sufficient magnetic force are fabricated by prescribing the same weight as a binding resin. Also, the average particle of toner (D4) was 8 μm.

The toner t is subjected to layer thickness regulation (amount of developer regulation) and application of charge at the developer amount regulation apparatus 143 during a process wherein the toner t is transported on the developing sleeve 141 while receiving magnetic force by the magnet roll 142. Also, the developing apparatus 104A includes an agitation member 144 within the developer container 145, which is configured to perform circulation of the toner t within the developer container 145, and sequentially transport the toner t within a range where magnetic force can reach in the circumference of the developing sleeve 141. The details of the regulation apparatus 143 will be described with later-described examples and comparative examples.

The toner t coated on the developing sleeve 141 is transported to the developing portion (developing region) where the photosensitive drum 101 and the developing sleeve 141 face each other by the rotation of the developing sleeve 141. Here, the developing sleeve 141 is disposed with an interval α of 300 μm at the closest position as to the photosensitive drum 101. Also, developing bias voltage (DC voltage value: −450 V, AC voltage value: Vpp 1.8 kV, 1.6 kHz, square wave) is applied to the developing sleeve 141 by the developing bias applying power source S2.

The developing sleeve 141 is driven by 1.2 times the peripheral speed of the photosensitive drum 101. Thus, an electrostatic image at the photosensitive drum 101 side is subjected to reversal developing by the toner t. Here, the peripheral speed of the developing sleeve 141 as to the photosensitive drum 101 is set 1.2 times, but the peripheral speed of the developing sleeve 141 as to the photosensitive drum 101 is not restricted to this. It is desirable to set the peripheral speed of the developing sleeve 141 to 1.0 through 2.0 times the peripheral speed of the photosensitive drum 101, and with such a peripheral speed of the developing sleeve 141, the advantages of the present example can be obtained sufficiently.

Also, with the magnet roll 142 within the developing sleeve 141, a magnetic pole is provided around the developing portion a1, with the present example, and the magnetic force at the surface of the developing sleeve 141 is set to 800 G. Thus, the toner t having inappropriate charge which cannot be controlled with potential settings, accidentally flying to the charging potential (non-image portion potential Vd) portion of the photosensitive drum 101, can be prevented.

Now, as described above, in the event of employing a blade-shaped regulation member along one side in the longitudinal direction, which is conventionally generally employed as a regulation member included in a developer amount regulation apparatus, ghosting, and concentration unevenness (longitudinal concentration unevenness) in the longitudinal direction of the regulation member, readily occur.

One of the features of the present fourth embodiment is to be capable of suppressing an image error due to a problem of the regulation member such as a ghost, longitudinal concentration unevenness, and so forth. Also, the regulation member configured in accordance with the present fourth embodiment can regulate developer on the developer bearing member, and can simply realize reduction in size, and can form a toner coat layer in a stable manner, which is advantageous as compared with a blade-shaped regulation member along one side in the longitudinal direction, which is conventionally generally employed for coating.

With the present embodiment, an arrangement is made wherein with the developing apparatus employing a magnetic monocomponent non-contact developing method, the regulation apparatus includes a flexible regulation member, and the regulation member forms a contact portion (nip portion) where the regulation member is made to contact with the developer bearing member. Subsequently, an arrangement is made wherein there are a plurality of local maximum values of contact pressure in a contact pressure distribution in the surface movement direction of the developer bearing member. Also, an arrangement is made wherein with a flux density distribution of the magnetic field generated by the magnetic field generating member, the peak position of flux density closest to the nip portion exists outside the nip portion.

The developing apparatus according to the fourth embodiment will be described below further in detail with reference to the examples and comparative examples of the developer amount regulation apparatus employed thereby.

Examples 5 Through 9 and Comparative Examples 9 Through 13

Example 5

Figure 21A:
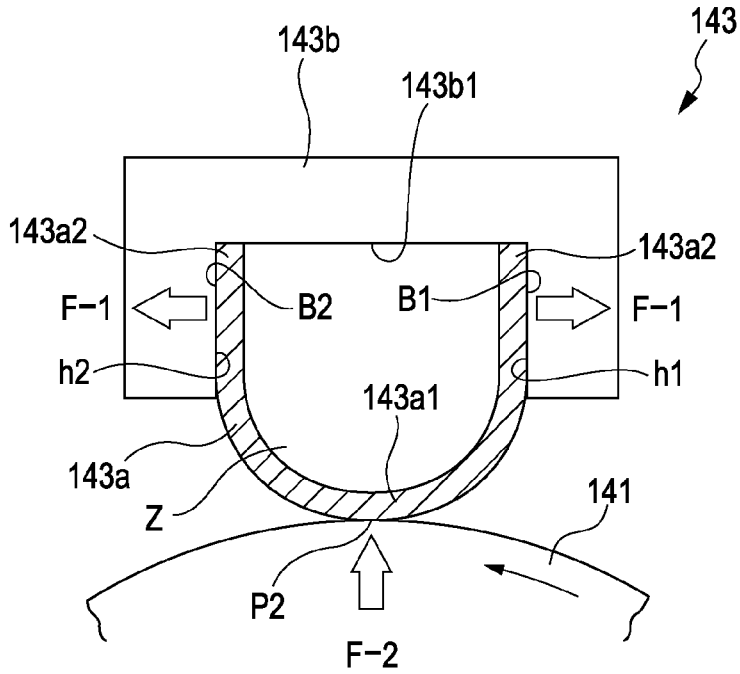
FIGS. 21A and 21B are schematic cross-sectional views illustrating one example of a regulating unit in accordance with the present invention.

Regulation Member: U-Shaped Sheet Member, Contact Pressure: Two Peaks, Closest Magnetic Pole: Downstream of Nip FIG. 21 illustrates the schematic cross-sectional configuration of the regulation apparatus 143 according to the present example. FIG. 21A illustrates a state before the regulation member 143*a* supported in a U-shape included in the regulation apparatus is made to contact with the developing sleeve 141. Also, FIG. 21B illustrates a state when the regulation member 143*a* is made to contact with the developing sleeve 141 with a predetermined push-in amount.

As shown in FIG. 21A, the regulation apparatus 143 according to the present example includes a flexible sheet member 143*a* serving as a regulation member, and a flexible sheet holding member 143*b* serving as a holding portion configured to hold the regulation member. The holding member 143*b* may be attached to the frame unit of the developing apparatus, or may be taken as a part of the developing frame unit as an integral model with the frame unit of the developing apparatus.

Here, the flexible sheet member 143*a* forms a U-shape by being bent over the longitudinal direction so as to be bent as to the widthwise direction. With the present example, the flexible sheet member 143*a* is bent in the surface movement direction of the developing sleeve 141, and the direction orthogonal to the bending direction and the longitudinal direction of the developing sleeve 141 are substantively in parallel. In other words, the regulation apparatus 143 is provided such that the overall longitudinal direction and the longitudinal direction of the developing sleeve 141 are substantively in parallel.

Figure 21B:
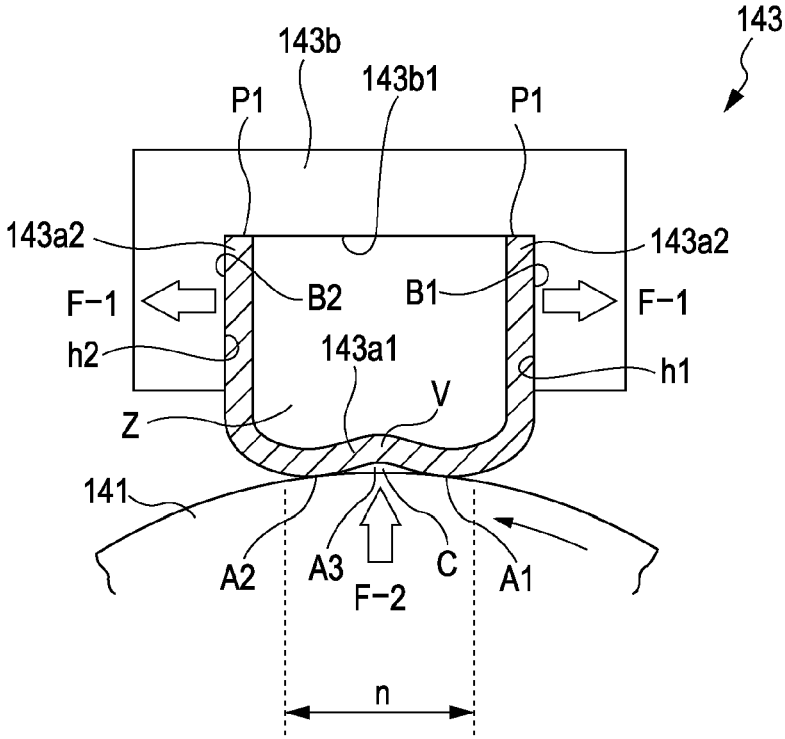

As shown in FIG. 21B, the flexible sheet member 143*a* bent in a U-shape includes first contact portions A1 and A2 which are made to contact with the developing sleeve 141 on the outer side of the generally center portion 143*a*1 in the widthwise direction which has a protruded shape facing the developing sleeve 141. The outer side of the generally center portion 143*a*1 of the flexible sheet member 143*a* protrudes from a recessed portion 143*b*1 formed at the side facing the developing sleeve 141 of the flexible sheet holding member 143*b*. Subsequently, both end portions 143*a*2 and 143*a*2 in the widthwise direction of the flexible sheet member 143*a* are attached to the inside of the recessed portion 143*b*1 of the flexible sheet holding member 143*b*.

At this time, the restoration force F-1, which attempts to revert back from the state bent in the longitudinal direction, acts on the flexible sheet member 143*a*. Therefore, second contact portions B1 and B2 at the upstream and downstream in the surface movement direction of the developing sleeve 141, which are the outer side around both end portions in the widthwise direction of the flexible sheet member 143*a*, are made to contact with holding portions h1 and h3 of the inner side of the recessed portion 143*b*1 of the flexible sheet holding member 143*b* by pressure. Thus, the flexible sheet member 143*a* is held by the recessed flexible sheet holding member 143*b* in a stable manner even without adhesion or being supported by another component. Note that the flexible sheet holding member 143*b* can be fabricated with an appropriate arbitrary material such as plastic, metal, or the like so as not to deform substantially depending on the elastic force of the flexible sheet member 143*b*.

However, with the present example, in order to allow simple attachment, as described above, the flexible sheet member 143*a* is not adhered to the flexible sheet holding member 143*b*, but of the second contact portions B1 and B2 as to the holding portions h1 and h2, both or one may be adhered. Also, an arbitrary fixing unit can be employed instead of adhesion. In this case as well, the same advantages as the present example can be exhibited.

With the present example, as the flexible sheet member 143*a*, a urethane rubber with a hardness of 70° with JIS-A was employed. Also, with the present example, the flexible sheet member 143*a* is a sheet member which has a thickness of 0.4 mm and a widthwise length of 12.5 mm. Also, the length of the longitudinal direction of the flexible sheet member 143*a* is arranged to be generally the same as the length of the longitudinal direction of the developing sleeve 141. The flexible sheet member 143*a* is received at the recessed portion 143*b*1 of the flexible sheet holding member 143*b* having a width of 5.0 mm (see FIG. 22), thereby forming a U-shape.

With the present example, a urethane rubber was employed as a flexible member (flexible material) making up the flexible sheet member 143*a*, but other than this, the other elastic member such as a silicone rubber, NBR, or the like, or a rubber elastic member may be employed for obtaining the same advantages.

With the present example, a contact condition between the flexible sheet member 143*a* and the developing sleeve 141 is arranged to be set to contact pressure of 20 KPa by setting the push-in amount to 0.8 mm. Note that the push-in amount is an imaginary overlap amount between the tip position of the flexible sheet member 143*a* and the surface of the developing sleeve 141.

Figure 23:
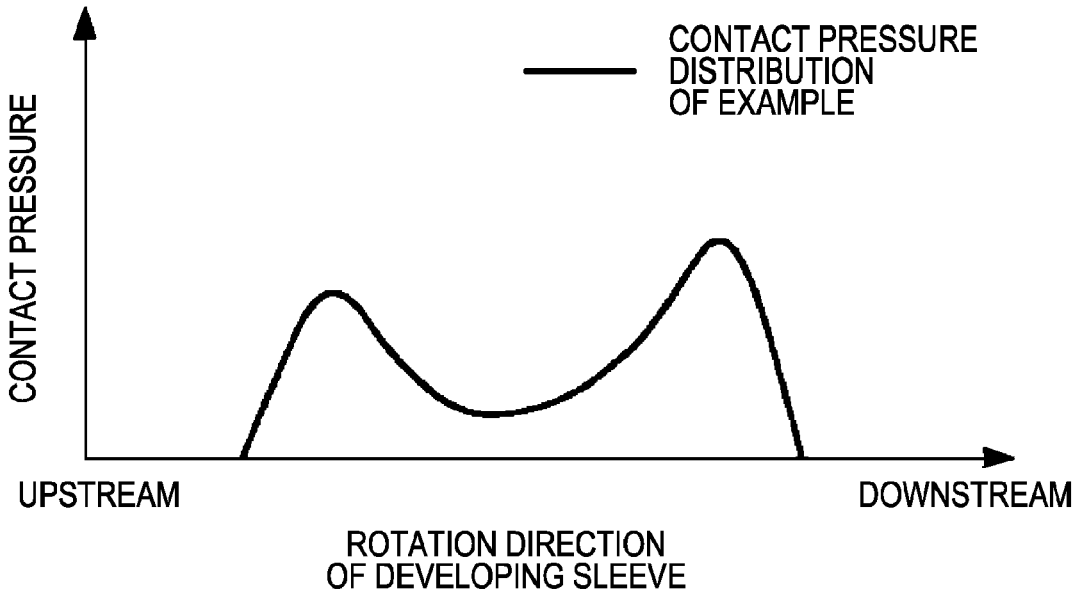
FIG. 23 is a graph illustrating one example of a contact pressure distribution of a contact nip portion between a regulation member and a developing sleeve in accordance with the present invention.

Now, a pressure distribution (contact pressure distribution) within a nip portion (contact nip) serving as a contact region between the developing sleeve 141 and the flexible sheet member 143*a* is shown in FIG. 23. As shown in FIG. 23, with the present example, a contact pressure distribution including two local maximum values of contact pressure is formed. That is to say, this contact pressure distribution includes a local maximum value of contact pressure at the upstream and downstream in the surface movement direction of the developing sleeve 141, and includes a low region of contact pressure at the center thereof.

With the fourth embodiment, the measurement of a contact pressure distribution was performed as follows.

Change in contact pressure is detected as an electric signal by employing a strain gauge. Specifically, a strain gauge "KFG-02-120" manufactured by Kyowa Electronic Instruments Co. Ltd. is attached to a hole provided in a hollow acrylic roller having the same diameter as the developing sleeve. At this time, the tip of the resin base portion of the strain gauge is attached so as to protrude from the surface of the acrylic roller in a range of 0.1 mm through 0.3 mm. Also, the lead wire of the strain gauge is extracted from the hollow portion to the end portion of the acrylic roller, thereby enabling the roller to be rotated. Upon the acrylic roller to which the strain gauge is attached being made to contact with the regulation member, and being rotated, the tip of the resin base portion of the strain gauge is deformed by contact pressure received from the regulation member. Thus, change in the contact pressure can be detected with an electric signal as change in the strain amount of the strain gauge itself. At this time, in order to reduce the noise of the electric signal, the members coming into contact with the developing sleeve 3 other than the regulation member are removed. "PCD-300A" manufactured by Kyowa Electronic Instruments Co. Ltd. was employed for detection of the electric signal.

Note that let us say that the contact nip n means a region from a contact starting position between the regulation member and the developing sleeve at the upstream side to a contact ending position at the downstream side, in the surface movement direction of the developing sleeve. In the event that there are a plurality of local maximum values of contact pressure, with the contact nip n from the contact starting position to the contact ending position, there may be a region where the regulation member is not made to contact with the developing sleeve.

With the present fourth embodiment, the contact pressure (absolute value) as the entirety of the contact nip n serving as a contact region between the regulation member and the developing sleeve was measured as follows. The generally used measurement method for contact pressure is to employ a pressure sensor in a thin sheet shape (for example, Prescale film manufactured by Fuji Film Corporation or the like). With the present embodiment, the contact pressure is low, and measurement is difficult with a general pressure sensor. Therefore, measurement of the contact pressure is performed by layering together three layers of hard H material of SUS 304 stainless steel with a thickness of 20 μm, inserting this at the contact portion between the regulation member and the developing sleeve, pulling out a thin plate from the center of the contact face in the linear direction of contact with a spring scale, and measuring the pullout force thereof. Thus, the measurement of contact pressure is obtained from the proof value and contact width from the pullout pressure measurement in the event of a known load being placed on the pressure measurement tool.

Description will be made regarding the reason why a plurality of contact peaks are formed in a contact pressure distribution within the contact nip n according to the present example.

As shown in FIG. 21A, upon the developing sleeve 141 being pushed in the flexible sheet member 143*a* supported in a U-shape, the flexible sheet member 143*a* is made to contact with the developing sleeve 141 at an elastic portion having a hollow portion (hollow state) Z formed at the center portion in a U-shape. The outer side of the generally center portion 143*a*1 in the widthwise direction of the flexible sheet member 143*a* is made to contact with the developing sleeve 141. At this time, elastic force is generated by the flexible sheet member 143*a* being deformed, whereby contact pressure arranged to regulate the amount of toner on the developing sleeve 141 can be realized. That is to say, as shown in FIG. 21A, at this time, the flexible sheet member 143*a* receives pressure force F-2 from the developing sleeve 141 at a point P2.

By the flexible sheet member 143*a* being pushed in from the developing sleeve 141 at a point P2, the flexible sheet member 143*a* attempts to spread in the same direction as the restoration force which attempts to revert from the state wherein the end sides P1 and P1 in the widthwise direction are subjected to bending into a U-shape. However, the deformation in the direction where the flexible sheet member 143*a* attempts to spread is regulated by the holding portions h1 and h2 of the inner surface of the recessed portion 143*b*1 of the flexible sheet holding member 143*b*.

Thus, the flexible sheet member 143*a* includes a first contact portion which comes into contact with the developing sleeve 141, and a second contact portion which comes into contact with holding portions h1 and h2. Elastic force is generated by the flexible sheet member 143*a* being made to contact with the developing sleeve 141 at the first contact portion and/or being made to contact with the holding portions h1 and h2 at the second contact portion, and thus, the flexible sheet member 143*a* is supported by the holding portions h1 and h2, and by the holding member 143*b*.

Figure 22A:
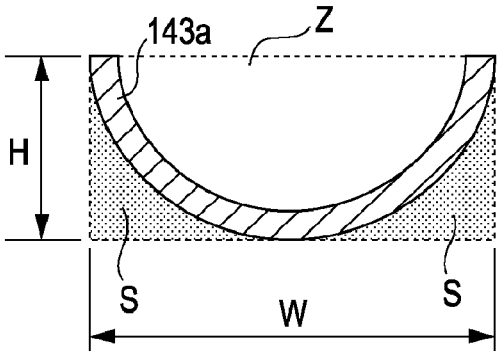
FIGS. 22A-22C are schematic views for describing formation process of a contact nip between a regulation member and a developing sleeve in accordance with the present invention.

Now, as shown in FIG. 22A, let us consider with reference to an arc-shaped portion in a state in which the flexible sheet member 143*a* is supported in a U-shape is extracted. The arc-shaped portion is generally not protruded externally from the frame shown with a dashed line (and dashed dotted line in FIGS. 22B and 22C). This reason is that the sheet holding portion 143*b* regulates the spread of both end portions 143*a*2 and 143*a*2 of the flexible sheet member 143*a*. The width W of the frame shown with the dashed line and dashed dotted line is approximately the groove width of the recessed portion 143*b*1 of the flexible sheet holding portion 143*b*, and is constant. Also, the height H of the frame, as shown with the dashed dotted line in FIGS. 22B and 22C, decreases as the push-in amount of the developing sleeve 141 increases. On the other hand, the length of the extracted arc-shaped portion of the flexible sheet member 143*a* needs to be kept constant regardless of change in the frame size shown with the dashed dotted line.

Figure 22B:
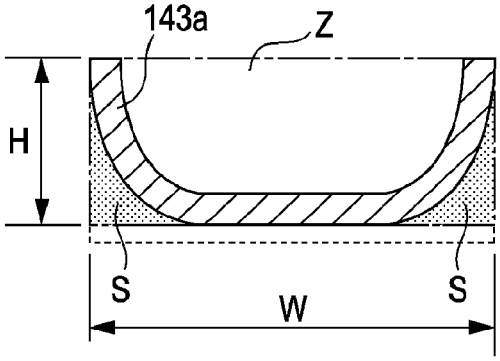

As shown in FIG. 22B, in the event that the push-in amount of the developing sleeve 141 is small, the flexible sheet member 143*a* pushed in by the developing sleeve 141 deforms itself in accordance with space S which is a shaded portion to escape, whereby the length of the arc-shaped portion can be kept constant.

Figure 22C:
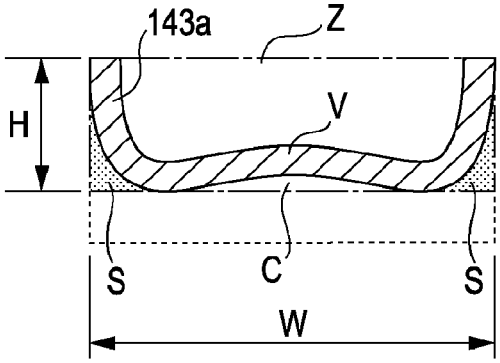

Next, as shown in FIG. 22C, in the event that the push-in amount of the developing sleeve 141 exceeds a predetermined amount, the space S which is a shaded portion is sandwiched with the space S which is a shaded portion, and accordingly, the flexible sheet member 143*a* pushed in by the developing sleeve 141 fails to deform itself to escape. Therefore, the flexible sheet member 143*a* deforms itself toward the above-mentioned hollow portion Z at the center portion of the arc-shaped portion, whereby the length of the arc-shaped portion is kept constant. At this time, the compression load due to reaction force received from the holding portions h1 and h2 acts on the arc-shaped portion of the flexible sheet member 143*a*. This compression load exceeds limit load wherein buckling occurs at the center of the arc portion of the flexible sheet member 143*a*. Subsequently, the flexible sheet member 143*a* is made to contact with the developing sleeve 141 in a state wherein buckling occurs.

Thus, as shown in FIG. 21B, with the contact nip n between the developing sleeve 141 and the flexible sheet member 143*a*, there are a contact region A1 at the upstream portion in the surface movement direction of the developing sleeve 141, a region A3 where contact pressure is low at the center, a slack V, and a contact region A2 at the downstream portion. Normally, a space C where the flexible sheet member 143*a* of the region A3 is not in contact with the developing sleeve 141 is formed between the flexible sheet member 143*a* and the developing sleeve 141 within the contact nip n. Note that with the region A3, there may be a case wherein the flexible sheet member 143*a* is made to contact with the developing sleeve 141 at lower contact pressure than the contact regions A1 and A2, as the second contact portion. Subsequently, with the regulation apparatus 143 having such a configuration, as shown in FIG. 23, a contact pressure distribution of the contact nip n including two local maximum values is formed. That is to say, this contact pressure distribution includes local maximum values at the upstream and downstream of the contact nip n in the surface movement direction of the developing sleeve 141, and includes a region where contact pressure is low at the center portion of the contact nip n.

Also, with the present example, as for a relation with the flux density distribution of the magnet roll 142 shown in FIG. 20, the flexible sheet member 143*a* is in contact with the contact nip n of θ=65 through 83 degrees. That is to say, the peak position of the closest magnetic pole is set outside the contact nip n between the developing sleeve 141 and the flexible sheet member 143*a*. Also, the peak of the closest magnetic pole is positioned at the downstream of the contact nip n between the developing sleeve 141 and the flexible sheet member 143*a* in the surface movement direction of the developing sleeve 141.

Example 6

Regulation Member: U-Shaped Sheet Member, Contact Pressure: Two Peaks, Closest Magnetic Pole: Upstream of Nip The present example is basically conformed to the example 5, but as for a relation with the flux density distribution of the magnet roll 142 shown in FIG. 20, the deference is in that the developing sleeve 141 is made to contact with the flexible sheet member 143*a* at the contact nip n of θ=12 through 30 degrees. Accordingly, with the present example, as with the example 5, the closest magnetic pole is set outside the contact nip n, but the peak position of the closest magnetic pole exists at the upstream of the contact nip n between the developing sleeve 141 and the flexible sheet member 143*a* in the surface movement direction of the developing sleeve 141.

Example 7

Figure 24:
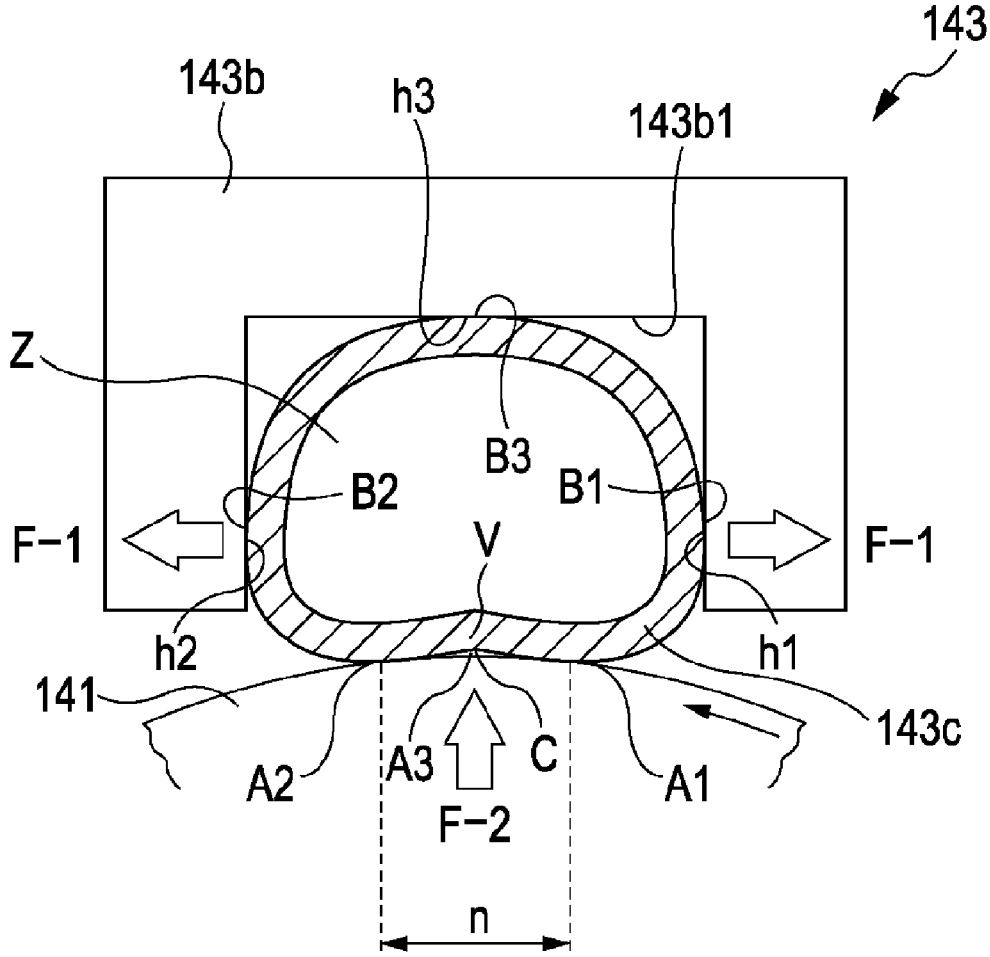
FIG. 24 is a schematic cross-sectional view illustrating another example of a regulating apparatus in accordance with the present invention.

Regulation Member: Tube Member, Contact Pressure: Two Peaks, Closest Magnetic Pole: Downstream of Nip FIG. 24 illustrates the schematic cross-sectional view of the regulation apparatus 143 according to the present example. The regulation apparatus 143 according to the present example comprises a seamless flexible tube member 143*c* serving as a regulation member, and a flexible tube holding member 143*b* serving as a holding member including a recessed portion 143*b*1 facing the developing sleeve 141.

The flexible tube member 143*c* is pressed in within the recessed portion 143*b*1 of the flexible tube holding member 143*b*. The axial direction of the flexible tube member 143*c*, serving as a tubular member, and the longitudinal direction of the developing sleeve 141 are substantially in parallel. That is to say, the regulation apparatus 143 is provided such that the longitudinal direction of the entirety and the longitudinal direction of the developing sleeve 141 are substantially in parallel.

The flexible tube member 143*c* includes first contact portions A1 and A2, which are in contact with the developing sleeve 141, at the outer surface exposed from the recessed portion 143*b*1 toward the developing sleeve 141. Subsequently, second contact portions B1, B2, and B3 are made to contact, by pressure, with holding portions h1, h2, and h3 of the inner side of the recessed portion 143*b*1 of the flexible tube holding member 143*b* within the recessed portion 143*b*1, respectively. The second contact portions B1 and B2 are each the outer surfaces of the upstream side and downstream side in the surface movement direction of the developing sleeve 141 of the flexible tube member 143*c*. Also, the second contact portion B3 is the outer surface of the opposite side of the developing sleeve 141 side through a hollow portion Z of the center of the flexible tube member 143*c*.

The flexible tube member 143*c* is supported by the recessed-shaped flexible tube holding member 143*c* in a stable manner even without adhesion or supporting by another component. However, the flexible tube member 143*c* may be fixed to the flexible tube holding member 143*b* by employing an arbitrary fixing unit such as adhesion or the like.

With the present example, a cylinder member which is formed of a silicone rubber with an outer diameter of 5 mm and a thickness of 0.5 mm, and a hardness of 60° with JIS-A, as the flexible tube member 143*c*. Subsequently, the flexible tube member 143*c* is received by the recessed portion 143*b*1 of the flexible tube holding member 143*c* with a width W of 5.2 mm.

As for a flexible material (flexible member) making up the flexible tube member 143*c*, other than a silicone rubber, an elastic member such as a urethane rubber, NBR, or the like, or optimally a rubber elastic member may be employed to obtain the same advantage.

With the present example, a contact condition between the flexible tube member 143*c* and the developing sleeve 141 was set so as to obtain contact pressure of 20 KPa by setting the push-in amount to 0.8 mm. Note that the push-in amount is the imaginary overlap amount between the tip position of the flexible tube member 143*c* and the surface of the developing sleeve 141.

As for the pressure distribution (contact pressure distribution) within the contact nip n where the developing sleeve 141 is made to contact with the flexible tube member 143*c*, as with the example 5, a contact pressure distribution including two local maximum values of contact pressure is formed. Specifically, this contact pressure distribution includes local maximum values of contact pressure at the upstream and downstream in the surface movement direction of the developing sleeve 141, and also includes a region whose contact pressure is low at the center thereof.

Also, with the present example, the contact position between the flexible tube member 143*c* and the developing sleeve 141 was set as with the example 5. Specifically, as for a relation with the flux density distribution of the magnet roll 142 shown in FIG. 20, the flexible tube member 143*c* is in contact with the developing sleeve 141 at the contact nip n of θ=65 through 83 degrees. That is to say, the peak position of the closest magnetic pole is set outside the contact nip n between the developing sleeve 141 and the flexible tube member 143*c*. Also, the peak of the closest magnetic pole is positioned at the downstream of the contact nip n between the developing sleeve 141 and the flexible tube member 143*c* in the surface movement direction of the developing sleeve 141.

Example 9

Regulation Member: U-Shaped Sheet Member, Contact Pressure: Two Peaks, Closest Magnetic Pole: within Nip The present example is basically conformed to the example 5, but the deference is in that the developing sleeve 141 is made to contact with the flexible sheet member 143*a* at the contact nip n of θ=80 through 98 degrees. Accordingly, with the present example, the magnetic pole is set within the contact nip n.

Comparative Example 9

Figure 29:
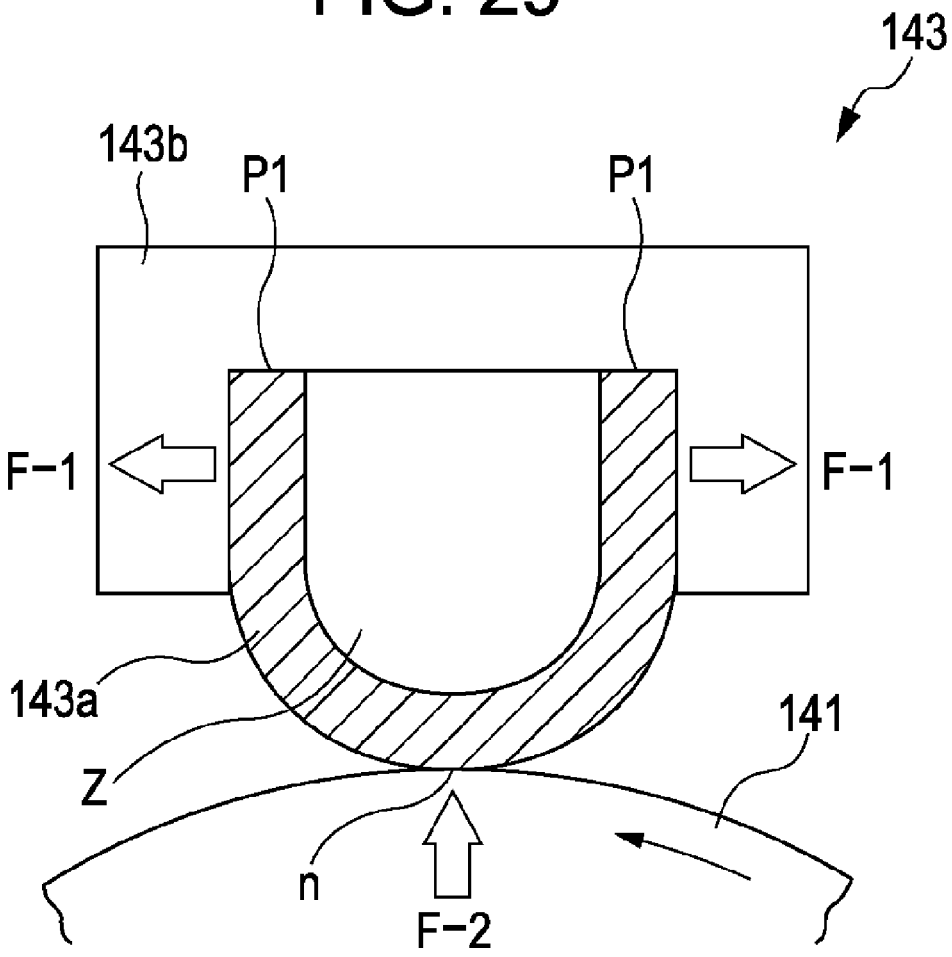
FIG. 29 is a schematic cross-sectional view illustrating a regulating apparatus according to a comparative example.

Regulation Member: U-Shaped Sheet Member, Contact Pressure: One Peak, Closest Magnetic Pole: Downstream of Nip FIG. 29 illustrates the schematic cross-sectional view of the regulation apparatus 143 according to the present comparative example. The regulation apparatus 143 according to the present comparative example is basically conformed to the regulation unit described in the example 5, but the push-in amount of the developing sleeve 141 as to the flexible sheet member 143*a* is set to 0.3 mm. According to this push-in amount, in the event of employing the same sheet as the example 5, it is difficult to obtain contact pressure necessary for reducing the toner on the developing sleeve 141 to obtain a sufficient thin layer. Therefore, with the present comparative example, as the flexible sheet member 143*a*, optimal contact pressure has been realized by employing a sheet thicker than that in the example 5. With the comparative example, as with the example 5, contact pressure was set so as to be 20 KPa.

Specifically, with the comparative example, as the flexible sheet member 143*a*, a urethane rubber with a thickness of 1.0 mm, and a hardness of 70° with JIS-A was employed. Also, the length in the widthwise direction of the flexible sheet member 143*a* is 12.5 mm, and the flexible sheet member 143*a* is received by the recessed portion 143*b*1 of the flexible tube holding member 143*b* with a width W of 5.0 mm, thereby forming a U-shape.

The flexible sheet member 143*a* according to the present comparative example has thicker a sheet thickness than that in the example 5, so elastic force is high. Therefore, the flexible sheet member 143*a* supported in a U-shape is made to contact with the surface of the developing sleeve 141 in a state wherein the curvature of the curved surface thereof is almost the same as that in a state wherein the flexible sheet member 143*a* is not in contact with the developing sleeve 141. In this case, the buckling of the flexible sheet member 143*a* does not occurs, so as for a contact pressure distribution at the contact nip n with the developing sleeve 141, a contact pressure distribution including one local maximum value which makes the contact pressure at the center portion of the contact nip n the maximum in the surface movement direction of the developing sleeve 141 is formed.

Also, with the comparative example, according to a relation with the flux density distribution of the magnet roll 142 shown in FIG. 20, the contact position between the flexible sheet member 143*a* and the developing sleeve 141 (the center position of the contact nip n in the surface movement direction of the developing sleeve 141) is θ=70 degrees.

Comparative Example 10

Regulation Member: Blade Shape

Figure 30:
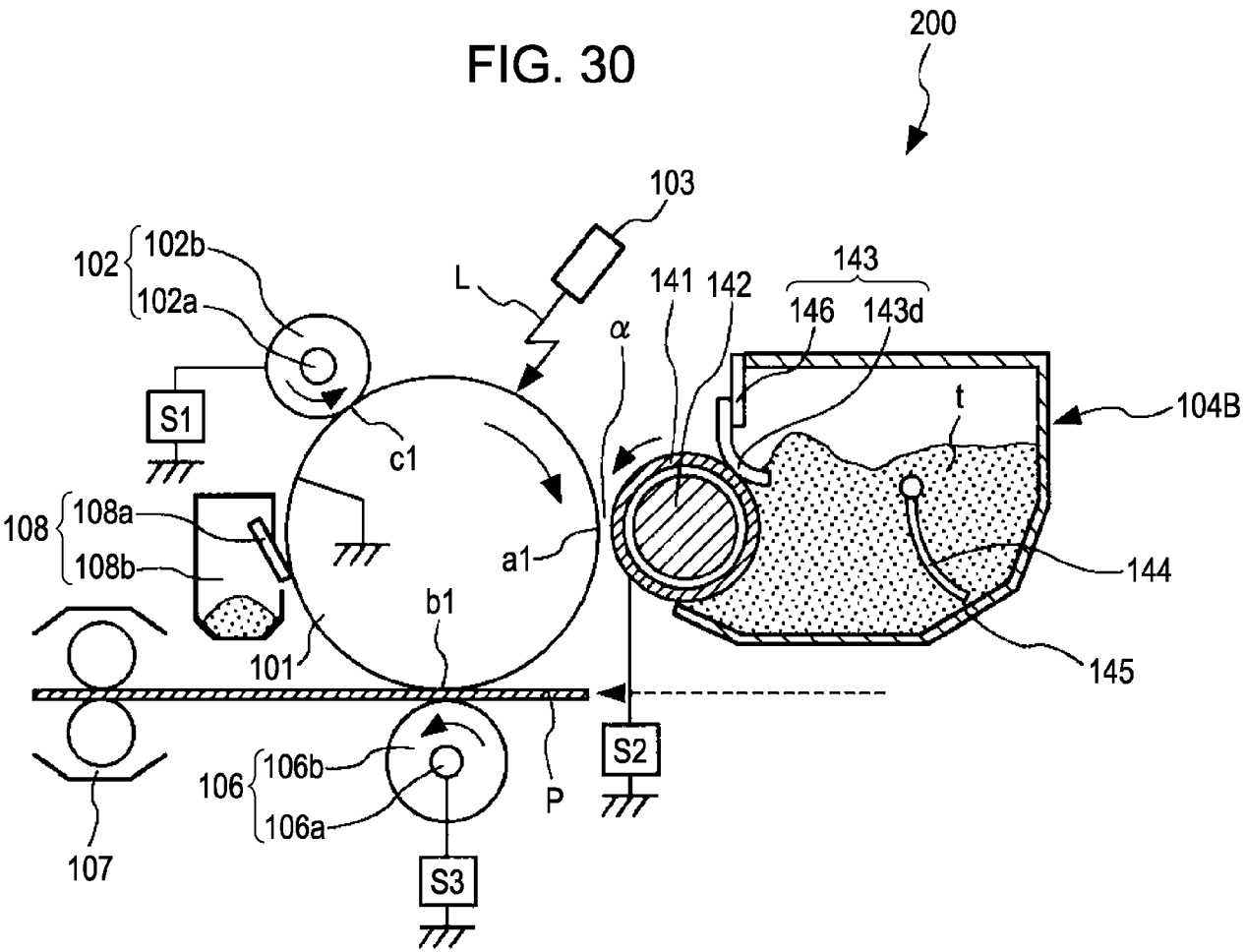
FIG. 30 is a schematic cross-sectional view of an image forming apparatus including a regulating apparatus according to another comparative example.

FIG. 30 illustrates the schematic cross-sectional configuration of an image forming apparatus 200 employing a developing apparatus 104B including the regulation apparatus 143 according to the present comparative example. In FIG. 30, components including the same function and configuration as those of the image forming apparatus 100 shown in FIG. 19, or equivalent to those are appended with the same reference numerals, and detailed description thereof will be omitted.

With the present comparative example, a blade-shaped (plate-shaped) regulation blade 143*d* serving as a regulation member is supported along one side in the longitudinal direction with a supporting metal plate 146 fixed to the developer container 145. The regulation blade 143*d* can be fabricated appropriately with an elastic member such as urethane rubber or the like. The underside of the facing portion of the regulation blade 143*d* as to the developing sleeve 141 is in contact with the developing sleeve 141.

With the present comparative example, the supporting metal plate 146 with a thickness of 1.2 mm is employed, a urethane rubber plate with a thickness of 0.9 mm is adhered to the supporting metal plate 146 as the regulation blade 143*d*. The distance from the supporting portion along one side in the longitudinal direction of the urethane rubber plate to the contact portion with the developing sleeve 141, i.e., free length is 6.5 mm, and the push-in amount as to the urethane rubber of the developing sleeve 141 is 3.1 mm. With the present comparative example, as with the example 5, contact pressure was set so as to be 20 KPa.

Also, with such a configuration, as for a contact pressure distribution at the contact portion between the regulation blade 143*d* and the developing sleeve 141, a contact pressure distribution including one local maximum value which makes the contact pressure at the center portion of the contact nip n the maximum in the surface movement direction of the developing sleeve 141 is formed.

Also, with the comparative example, according to a relation with the flux density distribution of the magnet roll 142 shown in FIG. 20, the contact position between the regulation blade 143*d* and the developing sleeve 141 (the center position of the contact nip n in the surface movement direction of the developing sleeve 141) is θ=70 degrees.

Comparative Example 11

Regulation Member: Metal Plate+U-Shaped Tension Sheet (Nip Width is Great)

FIG. 31 illustrates the schematic cross-sectional configuration of the regulation apparatus 143 according to the present comparative example. The regulation apparatus 143 according to the present comparative example includes a flexible sheet member 143*a*, serving as a regulation member, and a flexible sheet holding member 143*e*, serving as a regulation member holding member. Upon comparing between the present comparative example and the example 5, the present comparative example differs from the example 5 in that when supporting the flexible sheet member 143*a* in a U-shape, the sides of both end portions 143*a*2 and 143*a*2 in the widthwise direction of the flexible sheet member 143*a* are not supported. The flexible sheet member 143*a* is supported by adhering the sides P1 and P1 of both end portions 143*a*2 and 143*a*2 in the widthwise direction to the flexible sheet holding member 143*e*. The flexible sheet member 143*a* itself is the same as that in the example 5. As for the flexible sheet holding member 143*e*, a plate-shaped member was employed.

Figure 31A:
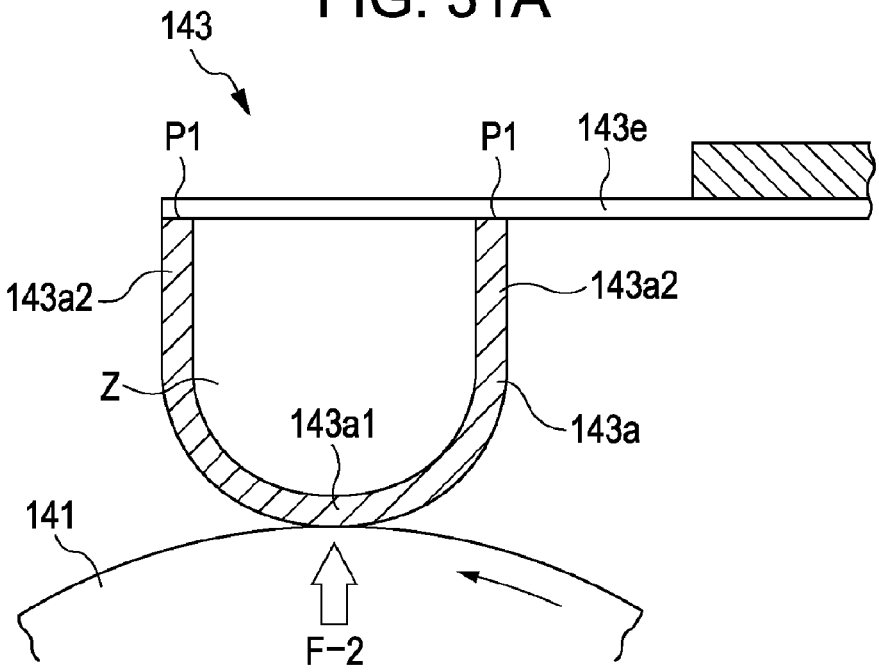
FIGS. 31A and 31B are schematic cross-sectional views illustrating a regulating apparatus according to another comparative example.

FIG. 31A illustrates a state when the developing sleeve is not pushed in as to the flexible sheet member 143*a* supported in a U-shape. Also, FIG. 31B illustrates a state when the developing sleeve 141 is pushed in as to the flexible sheet member 143*a* supported in a U-shape.

Figure 31B:
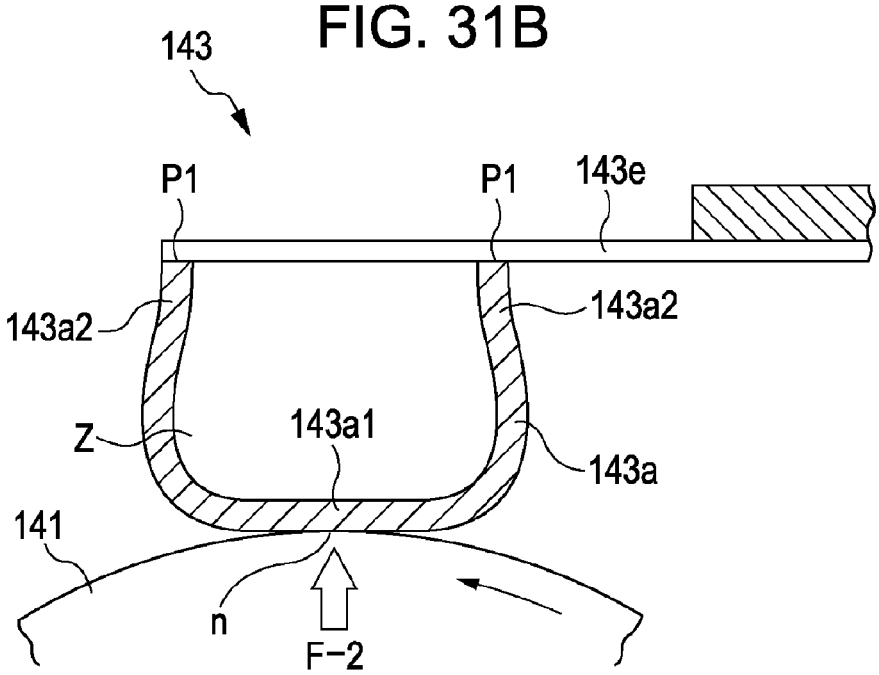

As shown in FIGS. 31A and 31B, the flexible sheet member 143*a* is made to contact with the developing sleeve 141 at an elastic portion including a hollow portion (hollow state) Z formed at the center portion in a U-shape, thereby receiving pressure force F-2. With this configuration, the flexible sheet holding member 143*e* does not regulate both sides of the flexible sheet member 143*a*, so even in the event that the push-in amount of the developing sleeve 141 increases, the flexible sheet member 143*a* can spread in the direction perpendicular to the pressure force F-2. Therefore, with this configuration, for example, even in the event that the push-in amount of the developing sleeve 141 is set to the same amount as that in the example 5, the buckling of the flexible sheet member 143*a* does not readily occur. As for the contact pressure distribution at the contact nip n with the developing sleeve 141, a contact pressure distribution including one local maximum value which makes the contact pressure at the center portion of the contact nip n the maximum in the surface movement direction of the developing sleeve 141 is formed. With the present comparative example, as with the example 5, contact pressure was set so as to be 20 KPa.

Also, with the comparative example, according to a relation with the flux density distribution of the magnet roll 142 shown in FIG. 20, the contact position between the flexible sheet member 143*a* and the developing sleeve 141 (the center position of the contact nip n in the surface movement direction of the developing sleeve 141) is θ=70 degrees.

Note that as a configuration similar to the present comparative example, there is a developing apparatus disclosed in Japanese Patent Laid-Open No. 11-265115.

Comparative Example 12

Regulation Member: a Plurality of Blades

Figure 32:
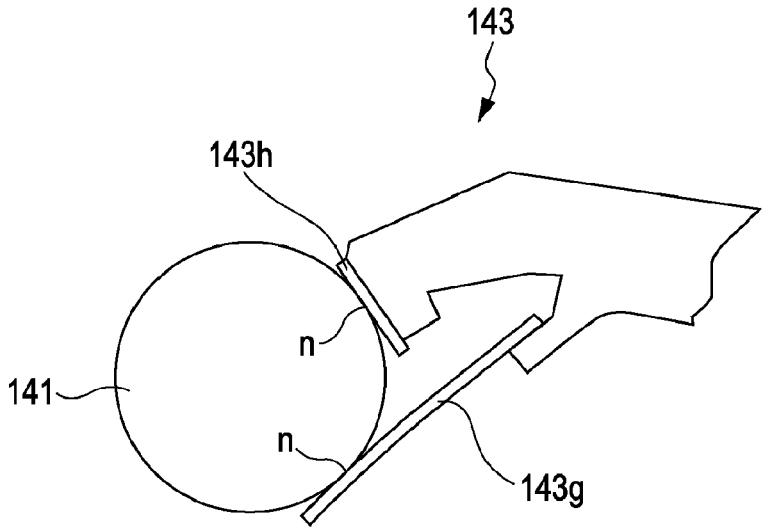
FIG. 32 is a schematic cross-sectional view illustrating a regulating apparatus according to another comparative example.

FIG. 32 illustrates the schematic cross-sectional view of the regulation apparatus 143 according to the present comparative example. The regulation apparatus 143 according to the present comparative example includes a first metal blade 143*g*, and a second metal blade 143*h* which support a thin-shaped elastic member such as a phosphor bronze plate or the like along one side in the longitudinal direction. The second metal blade 143*h* causes the underside of the facing portion thereof as to the developing sleeve 141 to make contact with the developing sleeve 141 as first and second regulation members. The second metal blade 143*h* is disposed at the downstream side of the first metal blade 143*g* in the surface movement direction of the developing sleeve 141. Thus, the regulation apparatus 143 according to the present comparative example has a configuration wherein the first and second regulation members are made to contact with the developing sleeve 141 at the two portions.

With the present comparative example, each contact portion of the first metal blade 143*g* and the second metal blade 143*h* as to the developing sleeve 141 includes a contact pressure distribution where one local maximum value is formed at the center portion of the contact nip n in the surface movement direction of the developing sleeve 141. With the present comparative example, as the whole of the regulation apparatus 143, there is provided a contact pressure distribution including two local maximum values of contact pressure in the surface movement direction of the developing sleeve 141. With regard to each of the first and second metal blades 143*g* and 143*h*, contact pressure was set to be 20 KPa.

Further, with the present comparative example, according to a relation with the flux density distribution of the magnet roll 142 shown in FIG. 20, the contact position between the first metal blade 143*g* and the developing sleeve 141 is θ=−30 degrees., and the contact portion between the second metal blade 143*h* and the developing sleeve 141 is θ=68 degrees. The contact positions thereof are each the center positions in the surface movement direction of the developing sleeve 141 of the contact nip n.

Note that as a configuration similar to the present comparative example, there is a developing apparatus disclosed in Japanese Patent Laid-Open No. 6-95484.

Comparative Example 13

Regulation Member: a Plurality of Blades, Contact with Edge

Figure 33:
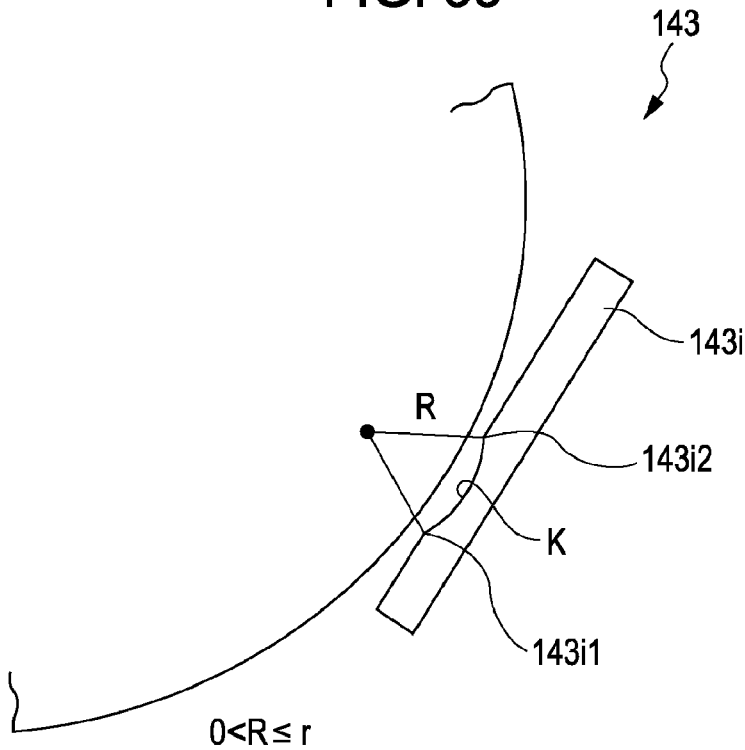
FIG. 33 is a schematic cross-sectional view illustrating a regulating apparatus according to yet another comparative example.

FIG. 33 illustrates the schematic cross-sectional view of the regulation apparatus 143 according to the present comparative example. The regulation apparatus 143 according to the present comparative example includes a metal blade 143*i* serving as a regulation member. Particularly, with the present comparative example, the metal blade 143*i*, which is in contact with the developing sleeve 141, includes an arc-shaped recessed portion K at the contact portion. When assuming that the radius of the developing sleeve 141 is r, and the curvature radius of the recessed portion K is R, such a configuration satisfies a relation of $0<R\leqq r$. At this time, two edge portions of the arc-shaped recessed portion K of the metal blade 143*i* are made to contact with the developing sleeve 141.

With such a configuration, the contact nip n between the developing sleeve 141 and the metal blade 143*i* includes the following respective regions. The regions included in the contact nip n are a first edge contact portion 143*i*1 at the upstream portion of the contact nip n, a region which is not in contact with the developing sleeve 141 at the center portion of the contact nip n (i.e., recessed portion K), and a second edge contact portion 143*i*2 at the downstream portion of the contact nip n.

The contact pressure distribution at the contact nip n according to the comparative example is a contact pressure distribution including a region where contact pressure does not occur at the center of the contact nip n, and two local maximum values including steep peak contact pressure at the first edge contact portion and the second edge contact portion. The contact pressure at the metal blade 143*i* was set so as to be 20 KPa as a whole.

Further, with the present comparative example, according to a relation with the flux density distribution of the magnet roll 142 shown in FIG. 20, the contact position between the first edge contact portion 143*i*1 and the developing sleeve 141 is θ=68 degrees., and the contact portion between the second edge contact portion 143*i*2 and the developing sleeve 141 is θ=73 degrees.

Note that as a configuration similar to the present comparative example, there is a developing apparatus disclosed in Japanese Patent Laid-Open No. 6-95484.

Example 8

Figure 25A:
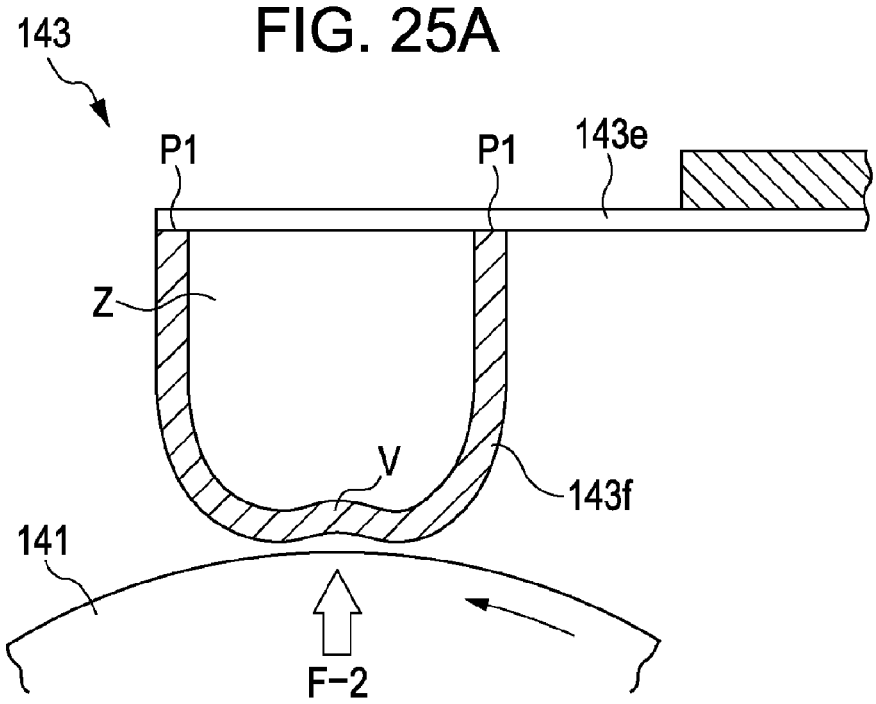
FIGS. 25A and 25B are schematic cross-sectional views illustrating yet another example of a regulating apparatus in accordance with the present invention.
Figure 25B:
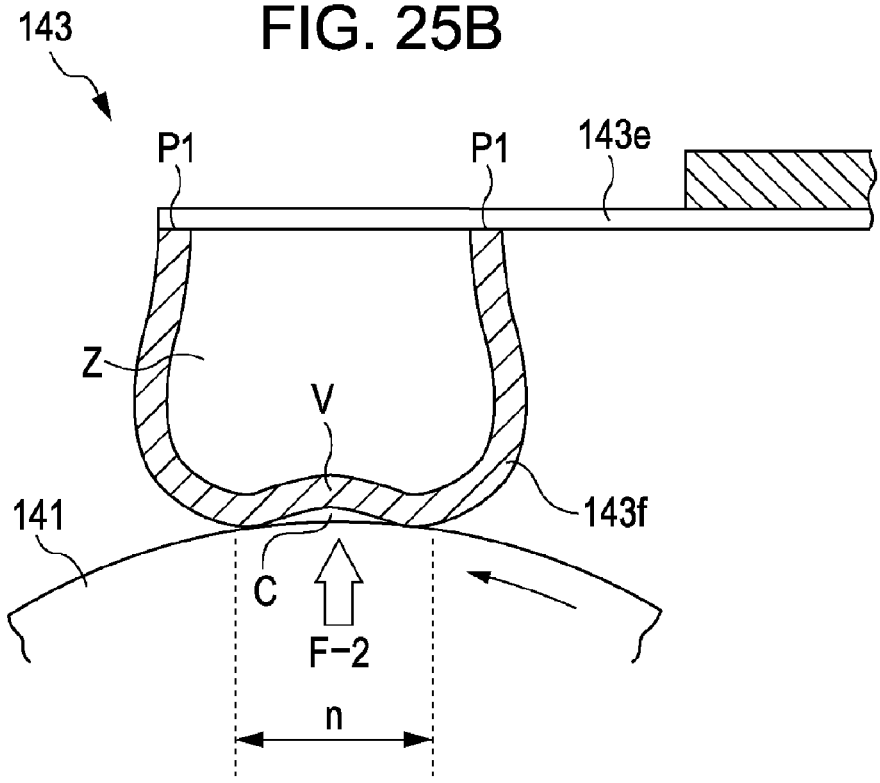

Regulation Member: U-Shaped Sheet Member, Edge Side Fixed, U-Shaped Tension Sheet, Contact Pressure: Two Peaks (Already Formed), Closest Magnetic Pole: Downstream of Nip FIGS. 25A and 25B illustrate the schematic cross-sectional configuration of the regulation apparatus 143 according to the present example. The regulation apparatus 143 according to the present example is similar to that in the comparative example 11, but the following point differs. That is to say, with the present example, a urethane sheet in a state in which a slack portion V is formed beforehand was employed as the flexible sheet member 143*f*.

As one example of a specific sheet fabrication method, a method arranged to form a slack portion can be referenced by performing aging and dryness while pressing a wire with a diameter of 0.5 mm following sheet molding.

The present example is an example wherein one slack portion V is formed beforehand, but even in the event of employing a flexible member wherein a plurality of slack portions V are formed beforehand, the same advantages as those in the present example can be provided.

With the present example, a contact condition between the flexible sheet member 143*f* and the developing sleeve 141 was set such that contact pressure is 20 KPa by setting the push-in amount to 0.8 mm. As the pressure distribution (contact pressure distribution) at this time within the contact nip n where the developing sleeve 141 is made to contact with the flexible sheet member 143*f*, a contact pressure distribution including two local maximum values of contact pressure is formed, as with the example 5. That is to say, this contact pressure distribution includes local maximum values of contact pressure at the upstream and downstream in the surface movement direction of the developing sleeve 141, and includes a region where contact pressure is low at the center thereof. Also, with the present example, the contact position between the flexible sheet member 143*f* and the developing sleeve 141 was set in the same way as that in the example 5. That is to say, according to a relation with the flux density distribution of the magnet roll 142 shown in FIG. 20, the flexible tube member 143*c* is in contact with the developing sleeve 141 at the contact nip n of θ=65 through 83 degrees. In other words, the peak position of the closest magnetic pole is set outside the contact nip n between the developing sleeve 141 and the flexible tube member 143*c*. Also, the peak of the closest magnetic pole is positioned at the downstream of the contact nip n between the developing sleeve 141 and the flexible sheet member 143*f* in the surface movement direction of the developing sleeve 141.

Image Evaluation Method of Example and Comparative Example

An image evaluation test is performed with an image forming apparatus employing the developing apparatus having a regulation apparatus 143 according to examples 5 through 9 and comparative examples 9 through 13 described above.

(a-1) Initial Negative Ghost

A solid image of the local maximum concentration level where black is printed on the whole surface of the image forming region of the transfer material P is output, and optical reflective concentration is measured with a Macbeth densitometer RD-1255. Specifically, the concentration at the image tip portion (first round of the developing sleeve 141) is measured at five points and the average thereof calculated, and following the concentration at the second round and thereafter of the developing sleeve 141 being measured at five points and the average thereof being calculated, the concentration difference Δ (delta) is obtained and evaluation performed in accordance with the following standards.

A: Concentration difference Δ is below 0.3.

C: Concentration difference Δ is at or above 0.3.

Evaluation results in the event that the concentration difference Δ is below 0.3 but minimal negative ghost is found is called B. The concentration evaluation is performed after printing 100 pages immediately following the process cartridge set into the image forming apparatus main assembly and following disuse for eight hours thereafter. The printing test is performed by continually printing a recorded image of horizontal lines with an image ratio of 5%.

(a-2) Cause of Initial Negative Ghost

A negative ghost is an image error of decreased concentration following two or more rounds of the developing sleeve 141, when the solid black image is printed wherein the concentration is high for only one round worth of the developing sleeve 141 in the direction corresponding to the surface movement direction (rotation direction) of the photosensitive drum 101. That is to say, with the present example, a negative ghost is an image error wherein the concentration of the solid black image is high at the leading edge of the transfer material P (one round worth of the developing sleeve 141) as to the conveying direction of the transfer material P, and the concentration of the solid black image decreases thereafter. In the event that there are not sufficient number of printed sheets immediately following the process cartridge being set (hereafter called Initial), the toner within the developer container 145 has almost no charge which is required for developing. The reason for this is that the process cartridge 109 has been in disuse for a long period of time, and is in a state wherein the amount of toner within the developer container 145 is high and no processes to apply a charge to the toner are being performed.

However, the concentration is high only for one round worth of the developing sleeve 141 during the printing of the solid black image, and a toner layer having an appropriate charge can be formed. The reason for this is that following the regulation unit for toner amount on the developing sleeve 141 is passed several times without consuming any toner, a toner coat layer was formed on the developing sleeve 141. Now, the reason for the toner passing through the toner regulation unit several times without consuming any toner is that the developing sleeve 141 rotates during times of non-printing. Therefore, even in the event that the toner charge amount within the developer container 145 is low, or in the event that the charge applied to the toner is low, the opportunity for frictional charge increases, and thus sufficient charge can be obtained.

On the other hand, concentration decreases at the second round worth and thereafter of the developing sleeve 141 during solid black image printing. Next, the reason thereof will be described. That is to say, during the previous rotation, toner is consumed at the developing region. Further, following the toner within the developer container 145 with a low charge wherein almost no charge is applied to the developing sleeve 141 being newly supplied to the developing sleeve 141, the toner passes through the regulation unit only once. Consequently, the toner with a low charge having almost no charge being applied, cannot obtain sufficient charge and thus the developing efficiency decreases.

In other words, it can be conceived that compared to the toner coat layer corresponding to one round worth of the developing sleeve 141, the toner charge at two rounds worth and thereafter is lower, and cannot obtain an appropriate charge, that is to say, concentration difference occurs during printing of the solid black image due to decreased developing efficiency.

(b-1) Positive Ghost During Printing Sheet Count Increase

The supply and scrapability of the developer on the developing sleeve 141 is evaluated with regard to developing ghosting. With consideration for peripheral speed of the developing sleeve 141 and process speed thereof, a positive ghost image appearing at the rotation cycle of the developing sleeve 141 is evaluated. Specifically, in the event that concentration difference occurring at the first round of the rotation cycle of the developing sleeve 141 can be observed visually for a halftone image having printed a patch image with a solid black square of a 5 mm square and a 25 mm square at the leading edge of the transfer material P, determination is made that there is an image error due to a ghost. A 600 dpi laser beam scanner is employed at the printer for each example, and image recording performed. With the present evaluation, a halftone image means a striped pattern wherein one line in the main scanning direction is recorded, following which four lines are not recorded, and represents halftone concentration as a whole.

Here, the image evaluation thereof is performed with the following standards.

D: During printing of a half-tone image after one or more rounds of the developing sleeve, concentration difference in the half-tone image is observed in both patches.

C: During printing of a half-tone image after only one round of the developing sleeve, concentration difference in the half-tone image is observed in one of the patches.

B: During printing of a half-tone image after only one round of the developing sleeve, concentration difference in the half-tone image is not observed but some noise is observed in one of the patches.

A: Concentration difference and noise is not observed in either patch.

The evaluation was performed after a printing test of 4000 sheets. The printing test is performed by continually printing a recorded image of horizontal lines with an image ratio (printing ratio) of 5%.

(b-2) Cause of Positive Ghost During Printing Sheet Count Increase

A positive ghost is an image error, wherein, when a half-tone image is printed immediately following printing of a patch image with a high printing ratio such as a solid black image, half-tone image concentration corresponding to the printed portions of a patch image is high compared to the half-tone image concentration corresponding to the portions not printing the patch image. In other words, a positive ghost is an image error wherein concentration difference occurs in a half-tone image from the developing history, and when the error is extremely poor, a concentration difference in patch form can occur in the rotation cycles of the developing sleeve 141.

Now, the mechanism for positive ghost occurring when the printing sheet count is increased will be described. When the toner charge amount differs between the toner coat layer on the developing sleeve 141 during non-printing and the toner coat layer on the developing sleeve 141 after the toner within the developer container 145 is newly supplied to the developing sleeve 141 immediately following printing, a positive ghost occurs. This will be described more specifically below.

As a process for forming a half-tone image, a charge (the charged toner) is moved so that the difference is minimized between the surface potential of the photosensitive drum 101 corresponding to the half-tone image and the surface potential of the developing sleeve 141. That is to say, by moving the toner having a charge, thus changing from an electrostatic non-balanced state to a balanced state, the half-tone image is formed.

Accordingly, when there is a difference in the amount of toner charge of the toner coat layers during non-printing and immediately following printing, a difference occurs in the toner movement amount in the process nearing an electrostatic balanced state. Consequently, this difference appears in the image as a concentration difference in the half-tone image.

During non-printing, the toner on the developing sleeve 141 is in the state of not being consumed, thus the toner coating the surface of the developing sleeve 141 beforehand readily remains. Consequently, since the toner passes through the regulation unit multiple times and the number of times of frictional charge increases, toner having excess charge is readily generated. When toner having excess charge increases, an electrostatic balanced state can be neared with a smaller amount of toner. That is to say, half-tone image concentration decreases.

On the other hand, with the toner coat layer on the surface of the developing sleeve 141 immediately following printing, the toner amount having excess charge decreases. This is because there is only one opportunity for the toner newly supplied from the developer container 145 to the developing sleeve 141 to obtain frictional charge at the regulating unit. That is to say, since there is a small amount of toner having excess charge, in order to ensure the charge movement amount for narrowing the difference between surface potential of the photosensitive drum 101 corresponding to the half-tone image and surface potential of the developing sleeve 141, a greater amount of toner is necessarily moved. Consequently, the concentration in the half-tone image is increased.

Further, when the printed sheet count increases, positive ghost tends to worsen. Normally, a granule diameter for readily consumable toner centers around an average granule diameter. Consequently, when printing sheet count increases, a broader granule diameter distribution than the initial average granule diameter distribution tends to be generated. It has been known that the charge amount of the toner as to granule diameter tends toward an increased charge amount as the granule diameter becomes smaller. This is thought to be because the smaller the granule diameter of toner, the more times contact is made.

In other words, at the time of printing sheet count increase, the toner granule diameter distribution broadens. Such broadening enables the tone with smaller granule diameters to have excess charge. Additionally, the excessively charged toner, that is to say, the toner having excess charge amounts, have a greater reflectivity with the developing sleeve 141, and more readily remains on the surface of the developing sleeve 141. Consequently, the toner with smaller granule diameters and excess charge amounts readily remain on the developing sleeve 141 during non-printing, whereby concentration of the half-tone image decreases.

Accordingly, in order to suppress a positive ghost, it is important to suppress specified toner from remaining on the developing sleeve 141 by appropriately switching between the remaining developing toner and the toner within the developer container 145, thus preventing an increase of toner having excess charge amount at the regulation unit. Alternatively, even if toner with excess charge amount is generated, scraping the remaining developing toner is important.

For example, as described above, employing a supply roller provided on the developing apparatus so as to slide the developing roller is a known technique to supply a non-magnetic monocomponent developer (non-magnetic toner) to the developing roller, such as that proposed in Japanese Patent Laid-Open No. 54-43027. Such a supply roller scrapes the remaining toner while supplying toner, so as to prevent developing history from generating. Consequently, in the event of employing such a developing apparatus, even if the toner charge polarity changes temporally or with environmental variances, the switching of toner is maintained, so a positive ghost does not readily occur.

On the other hand, particularly, with a developing apparatus not having a sliding member for the developing sleeve 141 other than the regulation member, and performing toner supply magnetically to the developing sleeve 141, scraping the remaining developing toner is physically difficult as with the supply roller, and a positive ghost is more likely to occur when increasing the printing sheet count.

(c) Longitudinal Concentration Unevenness when Increasing Printing Sheet Count

The image evaluation relating to longitudinal concentration unevenness when increasing printing sheet count is performed by outputting a solid black image on the entire sheet by printing a solid black image on the entire sheet, and visually evaluating whether or not there is any concentration unevenness in the form of bands across the longitudinal direction (laser main scanning direction). Note that the longitudinal direction is the longitudinal direction of the photosensitive drum 1, developing sleeve 141, regulation apparatus 143, and so froth, and is in the direction orthogonal to the conveying direction of the transfer material P.

C: Five or more band-shapes of concentration unevenness are observed.

B: At least two, but less than five, band-shapes of concentration unevenness are observed.

A: One or less band-shape of concentration unevenness is observed.

The evaluation of longitudinal concentration unevenness is performed after 4000 sheets of test printing. The printing test is performed by continually printing a recorded image of horizontal lines with an image ratio of 5%.

[Image Evaluation Results]

The evaluation results of each example and comparative example are shown in Table 2. The advantages of the present example will be further described below with reference to the image evaluation results shown in Table 2.

TABLE 2

| | | Longitudinal concentration unevenness at increase in printing sheet count | Initial negative ghost | Positive ghost at increase in printing sheet count |
|---|---|---|---|---|
| Examples | Example 5 | B | B | A |
| | Example 6 | B | C | B |
| | Example 7 | C | B | B |
| | Example 8 | C | B | B |
| | Example 9 | C | B | D |
| Comparative examples | Comparative example 9 | D | C | C |
| | Comparative example 10 | D | D | D |
| | Comparative example 11 | D | B | D |
| | Comparative example 12 | D | B | D |
| | Comparative example 13 | D | B | D |

(1) Superiority of Present Example as to Blade-Shaped Regulation Member

With the comparative example 10 employing a blade-shaped regulation member supporting a plate-shaped sheet along one side in the longitudinal direction, a positive ghost occurs when increasing the printing sheet count. The toner on the developing sleeve 141 is regulated once, so the charge application to the toner is low. Similarly, since regulation is performed only once, the toner on the developing sleeve 141 is readily influenced by the developing history. As a result, an initial negative ghost and a positive ghost when increasing the printing sheet count more readily occur.

Also, with the comparative example 10, longitudinal concentration unevenness when increasing the printing sheet count more readily occurs. The contact pressure linearly changes, so variation in contact pressure readily occurs. As a result, when printing an image wherein the longitudinal printing ratio differs, the contact pressure becomes uneven in the longitudinal direction, and longitudinal concentration unevenness occurs.

On the other hand, with the present example, an initial positive ghost, a positive ghost when increasing the printing sheet count, and longitudinal concentration unevenness can be significantly suppressed from occurring.

(2) Superiority of the Present Example for Each Evaluation Item

Each evaluation item will be described in further detail below in order to show the superiority of the present example.

(2-1) Longitudinal Concentration Unevenness when Increasing Printing Sheet Count The examples 5 through 9 and the comparative examples 9 through 13 will be compared with regard to the advantages of suppressing the longitudinal unevenness when increasing printing sheet count. The advantages of suppressing the longitudinal unevenness when increasing printing sheet count have been especially favorable in examples 5 and 6. The reasons that suppressing the longitudinal unevenness when increasing printing sheet count is enabled with the present example will be described below.

Figures 27A, 27B:
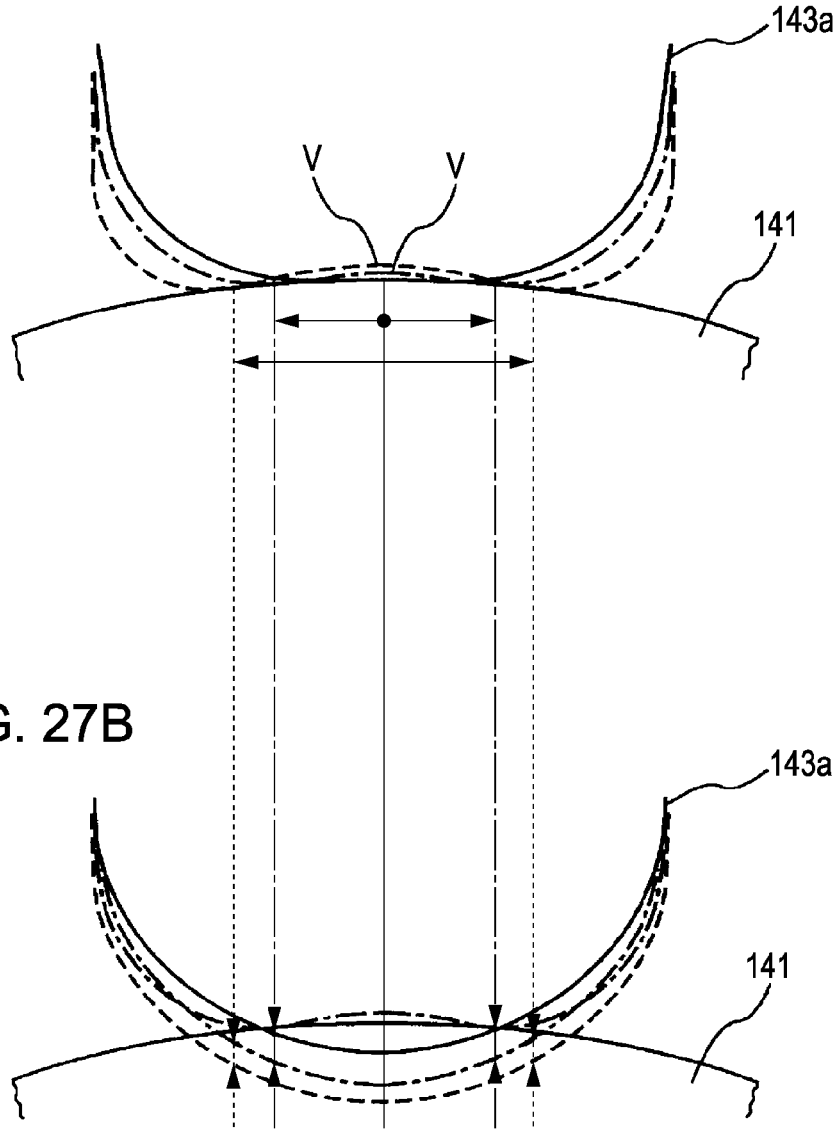
FIGS. 27A and 27B are schematic views for describing the transition of a deformed state of a flexible sheet member serving as a regulation member in accordance with the present invention.

With the examples 5 and 6, the contact pressure distribution within the contact nip has two local maximum values of contact pressure. FIG. 27A shows the transition of a deformed state of the flexible sheet member 143*a* as to an increase in the push-in amount of the developing sleeve 141. The push-in amount of the developing sleeve 141 increases in the order of the solid line, dashed-dotted line, and dashed line in FIG. 27A.

First, in the even that the push-in amount of the developing sleeve 141 is small, as shown with the solid line, contact pressure is at maximum pressure at the central portion of the contact nip in the surface movement direction of the developing sleeve 141. Next, in the event that the push-in amount of the developing sleeve 141 increases and the developing sleeve 141 is deformed as shown in the dashed-dotted line in FIG. 27A, a slack portion V occurs at the central portion of the contact nip in the surface movement direction of the developing sleeve 141. The position of the local maximum value of contact pressure then moves from the central portion of the contact nip to the upstream side and downstream side in the surface movement direction of the developing sleeve 141. Further, in the event that the developing sleeve push-in amount is increased and the developing sleeve 141 is deformed shown in the dotted line in FIG. 27A, the position of the local maximum value of the contact pressure moves further from the central portion of the contact nip to the upstream side and downstream side in the surface movement direction of the developing sleeve 141.

FIG. 27B shows the overlapped amount of the developing sleeve 141 and the regulation member (here, the flexible sheet member 143*a*). The solid line, dashed-dotted line, and dashed line in FIG. 27B each correspond to the overlapped amount for the states of the solid line, dashed-dotted line, and dashed line in FIG. 27A. Only the dashed-dotted line is shown along with the state of the regulation member being deformed, as with FIG. 27A. We can see in FIG. 27B that if an arc having a fixed curvature is overlapped, the overlapped amount thereof becomes maximum in the center of the contact portion, and gradually becomes smaller towards the upstream side and downstream side.

However, with the examples 5 and 6, when the contact pressure is at maximum a slack portion V should occur at the central portion of the contact nip. Further, as shown in FIG. 27A, the position where in the contact pressure is the local maximum value instead of the central portion shifts to the upstream side or downstream side where there is less overlap amount.

Therefore, in the event of the deformed state of the dashed-dotted line or the dashed line of FIG. 27A, the overlapped amount shown by the length of the arrow in FIG. 27B changes little. As a result, the local maximum value of contact pressure does not change proportional to the increase in the push-in amount of the developing sleeve 141, and an approximately predetermined value can be maintained.

Accordingly, even if the push-in amount changes in the longitudinal direction of the regulation member, a predetermined pressure can be maintained in a stable manner, thereby enabling significant suppression of the longitudinal concentration unevenness when increasing printing sheet count.

Specifically, the push-in amount is readily changed from the creeping of the regulation member deforming or the like from history or environment fluctuations of the output image when increasing printing sheet count. Particularly, although at a level of now appearing in the image immediately following setting the cartridge, in the event that the contact pressure is set differently when attaching the regulation member to the developing apparatus, if the printing sheet count increases, difference in push-in amount readily occurs in the longitudinal direction of the regulation member. This is because a difference in the rate of creeping deforming readily occurs from the stress received by the regulation member in the longitudinal direction differing. Nevertheless, with the examples 5 and 6, a region exists wherein the local maximum value of contact pressure does not readily change as to the increase in the push-in amount of the developing sleeve 141, thus the desired contact pressure can be maintained. Consequently, with the examples 5 and 6, even when increasing the printing sheet count, the longitudinal concentration unevenness can be suppressed significantly.

Also, with reduction in size of the apparatus, in the event that the diameter of the developing sleeve 141 becomes smaller and the curvature radius of the developing sleeve 141 becomes smaller, the above-described overlapped amount becomes smaller. Consequently, according to examples 5 and 6, even at a reduced size the present embodiment is superior in that a predetermined contact pressure can be maintained.

Also, with the examples 5 and 6, by having a nearest magnetic pole of a magnetic roll 142 outside the contact nip, which is between the developing sleeve 141 and the regulation member, the toner can be smoothly accumulated to be in a whirl at the slack portion V. Thus, significant toner deterioration can be suppressed.

Further, with the examples 5 and 6, a flexible member is employed as the regulation member, so a local increase of stress to the toner at the slack portion V accompanying the toner accumulation can be alleviated. Therefore, significant toner deterioration can be suppressed, and longitudinal concentration unevenness when increasing printing sheet count can be significantly suppressed.

Figure 26:
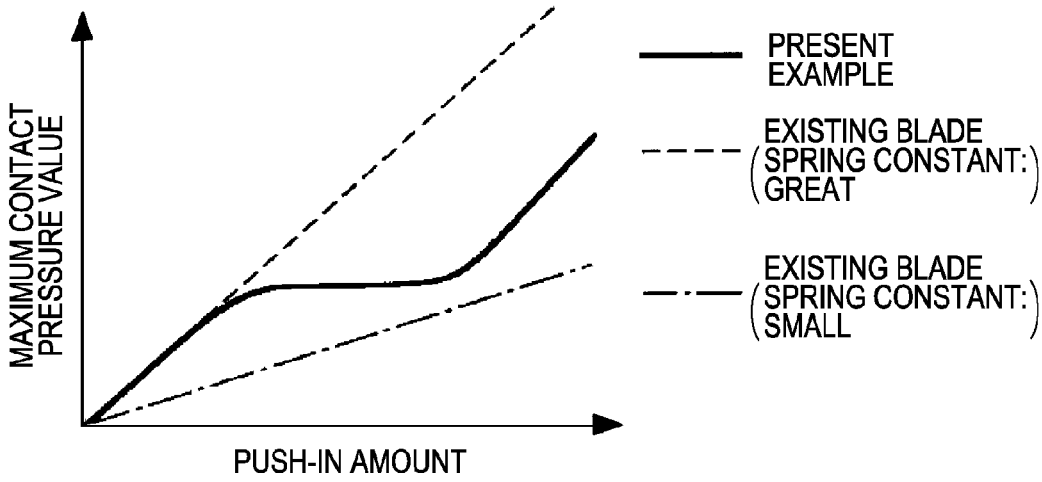
FIG. 26 is a graph for describing the relation between the push-in amount of a developing sleeve and a local maximum value of contact pressure according to a regulation member.

On the other hand, with the comparative examples 9 through 11, longitudinal concentration unevenness when increasing printing sheet count occurs. With the comparative example 9 through 11, the contact pressure distribution within the contact nip has one local maximum value of contact pressure. The local maximum value of the contact pressure as to the push-in amount of the developing sleeve 141 has a different slope depending on the spring constant based on each configuration, but is thought to increase linearly (see FIG. 26). As a result, maintaining a predetermined contact pressure over the entire longitudinal direction so as to be stable temporally is difficult, and thus longitudinal concentration unevenness when increasing printing sheet count occurs.

First, with the comparative examples 9 through 11, when reducing the size of the apparatus, the local maximum value of contact pressure widely varies as to the push-in amount to the developing sleeve 141, thus maintaining the predetermined contact pressure in a stable manner temporally becomes more difficult. Therefore, longitudinal concentration unevenness markedly occurs more readily.

Next, with the comparative examples 12 and 13, longitudinal concentration unevenness occurs when increasing printing sheet count, regardless of the contact pressure distribution having two local maximum values. The comparative example 12 is an example wherein the regulation member in the comparative example 10 is a plurality. However, these regulation members act similarly as the regulation member in the comparative example 10. That is to say, the local maximum value of contact pressure for each of the regulation members as to the push-in amount of the developing sleeve 141 increases linearly. It can be conceived that longitudinal concentration unevenness occurs when increasing printing sheet count as a result thereof.

With the comparative example 13, the regulation member is rigid, which is similar to the comparative example 10, and the local maximum value of contact pressure as to the push-in amount of the developing sleeve 141 increases linearly. Further, the locally increasing pressure on the toner at the recessed portion K within the contact nip cannot be dispersed, so that significant toner deterioration readily occurs. It can be conceived that longitudinal concentration unevenness occurs when increasing printing sheet count as a result thereof.

Also, similar to the comparative examples 9 through 11, the comparative example 12 and comparative example 13 also have difficulty maintaining predetermined pressure in a stable manner temporally when reducing the size of the apparatus, so significant longitudinal concentration unevenness occurs.

The longitudinal concentration unevenness evaluation of the example 9 when increasing printing sheet count is slightly worse compared to the examples 5 and 6. The reason for this may be that the peak magnetic flux density of the magnet roll 142 is positioned within the contact nip, and so toner deterioration is advanced. Specifically, toner deterioration occurs more readily because the toner is prevented from smoothly accumulating in the slack portion between the two local maximum values of the contact pressure in the pressure distribution within the contact nip. Consequently, longitudinal concentration unevenness when increasing printing sheet count is thought to worsen because of a difference in the deterioration rate of toner in the longitudinal direction of the regulation member from temporal changes or developing history.

The longitudinal concentration unevenness evaluation of the example 7 when increasing printing sheet count is slightly worse compared to the examples 5 and 6. This reason for this will be described. With the example 7, a seamless flexible tube is employed as a regulation member. In the event of employing a sheet-shaped member as a regulation member as with the examples 5 and 6, the variations in the longitudinal direction of the regulation member accompanying the developing history can be alleviated since both ends in the widthwise direction of each sheet is independently variable. On the other hand, with the seamless flexible tube, the degree of freedom is lower than that of the sheet-shaped member. Also, the seamless flexible tube is more readily twisted, and variations in contact pressure occur more readily in the longitudinal direction of the regulation member. Consequently, it can be conceived that in the example 7, temporal stability is low compared to the examples 5 and 6, and thus minor longitudinal concentration unevenness can occur when increasing the printing sheet count.

Lastly, the longitudinal concentration unevenness evaluation of the example 8 when increasing printing sheet count is slightly worse compared to the examples 5 and 6. This reason for this will be described. With the example 8, the sheet-shaped member serving as a regulation member is in contact with the developing sleeve 141 in the state of forming a slack portion B beforehand. Therefore, temporal contact stability is not as high as with the examples 5 and 6. As a result, it can be conceived that minor longitudinal concentration unevenness can occur when increasing the printing sheet count.

As described above, according to the present example, there are multiple local maximum values of the contact pressure in the pressure distribution within the contact nip wherein the developing sleeve 141 and the regulation member make contact with one another. Thus, a region exists wherein the maximum contact pressure does not change even when the push-in amount to the developing sleeve 141 changes, so the desired contact pressure of the regulation member can be maintained in a stable manner. As described above, the push-in amount in the longitudinal direction of the regulation member readily changes, specifically because of creeping deforming or the like of the regulation member from the output image history or environmental changes when increasing printing sheet count. Thus, according to the present example, the maximum contact pressure is not readily changed as to the push-in amount to the developing sleeve 141, even in a case wherein the push-in amount to the developing sleeve 141 in the longitudinal direction of the regulation member is readily changed. Therefore, the longitudinal concentration unevenness can be significantly suppressed.

Also, according to the present example, when reducing the size of the apparatus, variations in the maximum contact pressure are small, regardless of the push-in amount to the developing sleeve 141 changing widely. Therefore, the desired contact pressure can be maintained, and longitudinal concentration unevenness can be significantly suppressed.

Also, according to the present example, the peak position of the magnetic flux density of the magnet roll 142 nearest the contact nip between the developing sleeve 141 and the regulation member exists outside the contact nip. Therefore, the toner can be accumulated as in a whirl at the slack portion V between the local maximum values of the contact pressure. Thus, toner deterioration can be suppressed significantly, and longitudinal concentration unevenness can be suppressed significantly.

Further, by employing a flexible member as the regulation member, increases of local stress to the toner accompanying the toner accumulation at the slack portion V can be alleviated. Thus, toner deterioration can be suppressed significantly, and longitudinal concentration unevenness can be suppressed significantly.

(2-2) Evaluation of Initial Negative Ghost and Positive Ghost when Increasing Printing Sheet Count The examples 5 through 7, example 9, and comparative examples 9 through 13 will be compared with regard to the advantages of suppressing an initial negative ghost and a positive ghost when increasing printing sheet count. The advantages of suppressing an initial negative ghost and a positive ghost when increasing printing sheet count are particularly favorable in the example 5. The reasons for favorably suppressing both an initial ghost and a positive ghost when increasing printing sheet count will be described with regard to the present example.

First, the initial negative ghost will be described. The generating mechanism for an initial negative ghost is the same as previously described. With the present example, the pressure distribution within the contact nip in which the developing sleeve 141 and the regulation member make contact have two contact pressure local maximum values. Therefore, following supplying new toner from within the developer container 145 to the developing sleeve 141, there are two opportunities for the toner to be charged at the regulation unit. As a result, even if the toner whose initial charge amount is low, appropriate charge can be applied. Further, with the present example, the contact nip width itself widens, and accordingly is though to be superior in charge applicability.

Thus, with the present example, the pressure distribution within the contact nip wherein the developing sleeve 141 and the regulation member make contact has two contact pressure local maximum values, and has a wide contact nip width, thus charge applicability to the toner is high. Accordingly, even if toner with the initial charge amount being low is in a state of being readily supplied, the appropriate charge can be applied, and the initial negative ghost can be significantly suppressed.

In other words, according to the present example, the pressure distribution within the contact nip wherein the developing sleeve 141 and the regulation member make contact has multiple contact pressure local maximum values, thus increasing the number of times of frictional charge occurring, and charge applicability improves. Therefore, an initial state such as the state wherein the printing sheet count after setting the cartridge is low, i.e. even in a state wherein there is a large amount of toner with a low charge within the developer container 145, a predetermined charge amount can be applied to the toner. Accordingly, the initial negative ghost can be significantly suppressed.

Next, the positive ghost when increasing printing sheet count will be described. The generating mechanism for the positive ghost when increasing printing sheet count is as described above. The present example, and in particular the example 5, have no positive ghosts even when increasing the printing sheet count, and is thus favorable. The reason thereof will be described.

First, the present example, and in particular the example 5, is superior in charge applicability, similar to the suppression of the negative ghost. Therefore, appropriate charge can be applied to the toner in a stable manner.

Also, with the example 5, the pressure distribution within the contact nip wherein the developing sleeve 141 and the regulation member make contact have two contact pressure local maximum values. Consequently, regulating force is applied to the toner twice, and toner accumulation occurs so as to be a whirl immediately prior to the local maximum value of the contact pressure. First, with the regulation unit regulated by the local maximum value upstream of the surface movement direction of the developing sleeve 141, the shape of the toner being taken in is wide, and the toner newly supplied from the developer container 145 and the remaining developing toner wraps in a whirl, thus switchability increases. Also, with the regulation unit regulated by the local maximum value downstream of the surface movement direction of the developing sleeve 141, the amount of toner is regulated by the regulation unit upstream, and so a small amount of toner being regulated is expected. Accordingly, even if excessively charged toner attached strongly to the developing sleeve 141, this can be scraped off by the whirl of the toner immediately prior to the local maximum value. As a result, switchability of toner at the regulation unit regulated by the local maximum value upstream of the surface movement direction of the developing sleeve 141, and scrapability of the regulation unit regulated by the local maximum value downstream of the developing sleeve, are improved.

Also, the toner having passed the regulation unit regulated by the local maximum value upstream arrives at the regulation member by the local maximum value downstream. In this event, it can be conceived that the toner is regulated at the regulation member by the local maximum value downstream, and the toner not having passed through the regulation member circulates through the slack portion V between the two local maximum values, thus toner accumulation occurring. Consequently, toner with a weak charge amount can be thought to be prevented from passing through.

Figure 28:
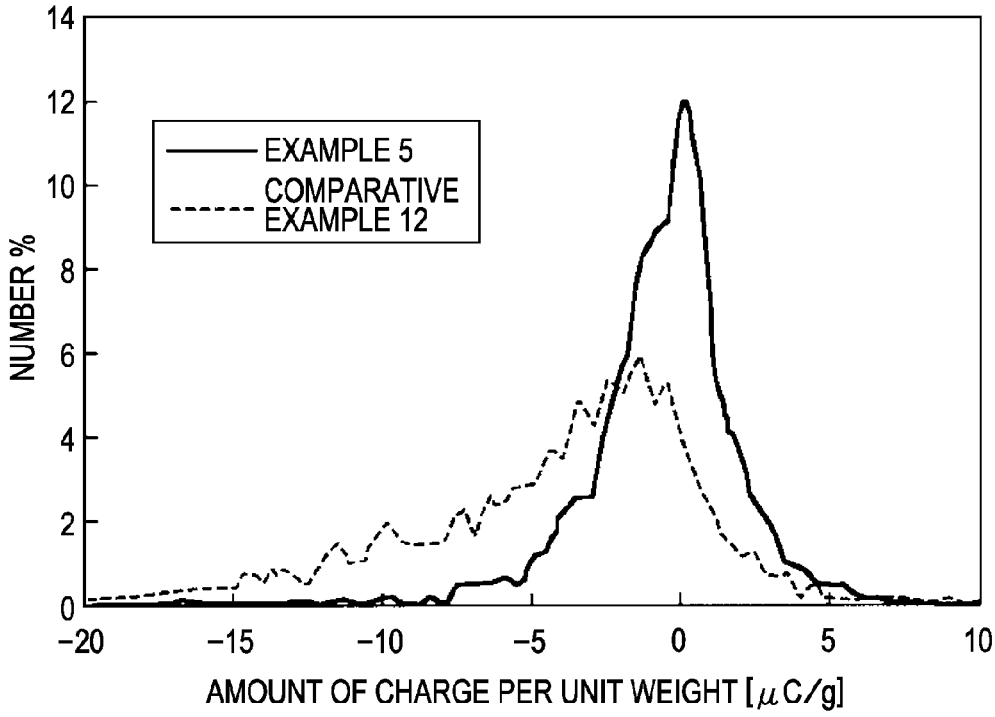
FIG. 28 is a graph illustrating a charge distribution of a toner coat layer according to an example 5 and a comparative example 12.

The charge distribution of the toner coated on the developing sleeve 141 is shown in FIG. 28. FIG. 28 shows the charge amount by unit on the horizontal axis, and the number distribution of the entire toner count measured on the vertical axis. Note that the measurement of the charge distribution is performed employing a Hosokawa Micron E-SPART ANALYZER EST-II. With the example 5, the cause is not always clear, but with regard to the charge distribution of the toner layer coated on the developing sleeve 141, excessively charged toner is observed as being suppressed. That is to say, with the regulation member in the present example, and particularly with the example 5, the forming of a toner coat layer in a state wherein charge application is not sufficiently performed, or a state having excess charge application performed can be thought to be significantly suppressed. Consequently, an appropriate amount of charge can be applied to the toner, and positive ghosts can be significantly suppressed.

Thus, with the present example, and particularly with the example 5, regardless of the developing history, toner switchability and scrapability are favorable even in the event that a state occurs wherein toner having excess charge amount is readily generated by temporal changes or environmental variations. Additionally, appropriate charge application can be performed uniformly as to the toner, thus a positive ghost can be significantly suppressed.

On the other hand, the comparative example 10 has problems with both the initial negative ghost and the positive ghost when increasing printing sheet count. With the comparative example 10, the pressure distribution within the contact nip wherein the developing sleeve 141 and the regulation member make contact has one contact pressure local maximum value. Accordingly, there is one opportunity for applying frictional charge to the toner. Therefore, applying appropriate charge to the toner with low initial charge amount is difficult, and the initial negative ghost worsens. Further, the opportunity for regulation force to operate occurs once, and it follows that there is only one opportunity for the switching of the toner. Therefore, scrapability is poor. Also, the shape for taking in the toner immediately preceding the contact nip is narrow, so switchability between the toner supplied to the contact nip and the toner already at the contact nip is poor. As a result, when increasing the printing sheet count, the toner having excess charge applied is accumulated on the surface of the developing sleeve 141. Therefore, the positive ghost is thought to worsen.

The comparative example 12 has a configuration with two regulation members provided similar to the comparative example 10 for improving chargeability. Therefore, the chargeability improves, and the initial negative ghost improves. However, the positive ghost when increasing printing sheet count is similarly poor as with the comparative example 10. With the comparative example 12, measuring when the charge distribution in the toner coating layer of the developing sleeve 141 showed excessively charged toner to be detected (FIG. 28). In other words, with the comparative example 12, the charging opportunities are increased to twice, so it can be conceived that while the chargeability increases, the toner having excess charge amount is less readily generated. Consequently, it can be conceived that the toner more readily receives influence from the developing history, and so the positive ghost occurs.

Thus, with the comparative example 12, the advantages of toner accumulation as in a whirl, from the slack portion V between the two local maximum values of the contact pressure provided by the pressure distribution within the contact nip wherein the developing sleeve 141 and regulation member make contact, are not obtained. Therefore, it can be conceived that an even charge application cannot be obtained.

Further, the advantages of the above-mentioned slack portion V in the present example become clear from the image evaluation results in the comparative example 13. That is to say, in the comparative example 13, the rigid regulation member is employed, and the pressure distribution within the contact nip in which the developing sleeve 141 and the regulation member make contact is set so as to have two contact pressure local maximum values. With this configuration, the initial negative ghost improves since the charge applicability improves as with the present example, in particular the example 5. However, regardless of whether there is a space with weak contact pressure between the two local maximum values, a positive ghost occurs when increasing printing sheet count. The reason thereof may be as follows.

With the comparative example 13, similar to the example 5, there is a space between the two local maximum values with a low contact pressure, so it can be conceived that an even chargeability can be obtained. However, with the comparative example 13, when variations occur in the toner amount within the space with weak contact pressure, since a rigid regulation member is being employed, a local pressure increase occurs within the space. When the printing sheet count is increased, the stress on the toner increasing significantly and toner deterioration is advanced. As a result, it can be conceived that toner with widely different charge amounts is generated, widening the charge distribution of the toner. Measuring the toner charge distribution yielded observations that the toner excessively charged or the toner unable to obtain sufficient charge is coated. Therefore, the positive ghost when increasing the printing sheet count is thought to worsen.

On the other hand, with the present example, particularly with the example 5, the positive ghost is favorable even when increasing the printing sheet count. The reason for this is thought to be that a flexible member is employed with the present example as the regulation member. Therefore, with the present example, particularly with the example 5, toner amount variations occur at the slack portion V between the two local maximum values of the contact pressure, similar to the comparative example 13. However, with the example 5, a flexible member is employed for the regulation member, so it can be conceived that even if pressure is applied locally, the sheet can deform, thereby causing the dispersion of pressure. As a result, an increase of local stress to the toner, and the occurrence of a positive ghost, can be significantly suppressed.

The advantages of having multiple local maximum values of the contact pressure at the pressure distribution within the contact nip wherein the developing sleeve 141 and regulation member make contact are made clear by comparing the example 5 and the comparative examples 9 and 11.

That is to say, with the comparative example 9, there have been minor image errors with the initial negative ghost. With the comparative example 9, the pressure distribution within the contact nip wherein the developing sleeve 141 and the regulation member make contact has one contact pressure local maximum value, and the toner is charged once. Therefore, the comparative example 9 is slightly inferior to the example 5 with regard to chargeability. Consequently, there are minor negative ghost occurrences. Further, with comparative example 9, there is one opportunity for the regulation force to act on the toner, thus decreasing switchability. Additionally, with the comparative example 9, there is no slack portion V between the two contact pressure local maximum values, thus an even charge application cannot be obtained. Therefore, a positive ghost may occur when increasing the printing sheet count.

With the comparative example 11, the pressure distribution within the contact nip wherein the developing sleeve 141 and the regulation member make contact has one contact pressure local maximum value, and is set so that the nip width is wide. Consequently, charge applicability improves, improving the initial negative ghost. However, with the comparative example 11, the regulation force of the toner is approximately the same as with comparative example 9, and there is also no slack portion V. Therefore the switchability and even charge applicability deteriorates compared to the example 5. Consequently, the positive ghost is thought to worsen when increasing printing sheet count.

Next, the relation between the magnetic pole position of the magnet roll 142 and the contact position of the regulation member as to the developing sleeve 141 will be described by comparing the examples 5 and 6 and example 9.

With example 9, the peak magnetic flux density of the magnet roll 142 is positioned within the contact nip wherein the developing sleeve 141 and the regulation member make contact. With example 9, the initial negative ghost is favorable, but the positive ghost when increasing printing sheet count worsens. The reason may be as follows.

With example 9, the pressure distribution within the contact nip wherein the developing sleeve 141 and the regulation member make contact has two contact pressure local maximum values, thus a slack portion V occurs. However, when a peak magnetic flux density of the magnet roll 142 exists within the contact nip, the toner at the slack portion V is not readily pulled magnetically toward the direction of the developing sleeve 141. Therefore, maintaining a smooth toner accumulation in a whirl at the slack portion V becomes difficult. Accordingly, significant stress to the toner occurs at the contact nip, and deterioration of the toner readily advances. Consequently, significant positive ghost is though to occur when increasing printing sheet count.

On the other hand, with the examples 5 and 6, there is a peak magnetic flux density of the magnet roll 142 outside the contact nip. Therefore, it is thought that such significant toner deterioration should not occur. Consequently, a positive ghost when increasing printing sheet count can be suppressed from occurring.

Now, with the example 6, the initial negative ghost worsens slightly compared to the example 5. The reason for this may be that in the surface movement direction of the developing sleeve 141, the peak magnetic flux density of the nearest magnet roll 142 is positioned upstream of the contact nip. Specifically, when there is a peak magnetic flux density upstream of the contact nip, the toner amount supplied to the developing sleeve 141 becomes excessive. Therefore, with the example 6, even if the charge applicability is of the same strength as the example 5, the charge amount applied to each of the toner diminishes. Consequently, with example 6, since the charge applicability decreases, an initial negative ghost is though to occur slightly. On the other hand, with example 5, since there is a peak magnetic flux density near the downstream of the contact nip, excessive toner supply to the developing sleeve 141 as described above can be suppressed. Further, with example 5, the magnetic binding force of the toner is not significantly strengthened at the regulation unit, so regulation force by the regulation member is not decreased. As a result, variations to the toner coat amount is suppressed, and by the high charge applicability the initial negative ghost can be suppressed.

Also, with the example 5, the positive ghost when increasing printing sheet count is significantly more favorable as compared with the example 6, conceivably due to less toner deterioration. That is to say, with the example 5, the peak magnetic flux density of the magnet roll 142 is positioned downstream of the contact nip. Now, in accordance with the increase of printing sheet count, pressure changes occur within the contact nip. In such an event, the slack portion V between the two local maximum values of the contact pressure within the contact nip can have sudden pressure changes. However, with example 5, the peak of the magnetic flux density of the magnet roll 142 is positioned at the exit opening of the contact nip, i.e. downstream of the contact nip, and since magnetic force is working towards the downstream direction of the contact nip, the toner readily passes through the control unit. Consequently, the pressure increase within the contact nip can be suppressed. That is to say, the toner stress within the contact nip can be diminished, and toner deterioration when increasing printing sheet count and positive ghost image errors can be significantly suppressed.

Thus, with the present example, the peak magnetic flux density of the magnet roll 142 is positioned outside of the contact nip. Therefore, the toner is smoothly accumulated in the slack portion V between the two local maximum values of the contact pressure in the pressure distribution within the contact nip, wherein the developing sleeve 141 and regulation member make contact. Thus, improvements to charge applicability as to the toner and even charge applicability as to the toner can be made.

Also, with the present example, by accumulating the toner in the slack portion V smoothly as in a whirl as described above, significant toner deterioration can be prevented, thus the positive ghost when increasing printing sheet count can be suppressed.

Also, in addition to the peak magnetic flux density of the magnet roll 142 being positioned outside the contact nip, positioning the peak magnetic flux density in the surface movement direction of the developing sleeve downstream of the contact nip is desirable. Thus, sudden stress to the toner within the contact nip can be significantly diminished, and a positive ghost when increasing printing sheet count can be significantly suppressed.

Next, the difference between the sheet member serving as a flexible regulation member and the seamless tube-shaped member will be described by comparing the example 5 and example 7. The example 7 has the same configuration as that of the example 5, other than employing a seamless tube-shaped member. With the example 7, the positive ghost when increasing printing sheet count deteriorates slightly as compared to the example 5. The reason for this may be that with the example 7, toner deterioration is more readily advanced as compared to the example 5, or that even charge applicability to the toner is somewhat lower. That is to say, with the example 7, the regulation member is in a seamless form, so in the event that pressure has built up at the slack portion V, the bending direction of the flexible member serving as the regulation member is limited as compared to the case wherein the regulation member has edges as that in the example 5. In other words, with the example 7, an even charge applicability by the accumulation of toner at the slack portion V cannot be obtained as much as with the example 5, or the advantages for preventing local pressure increase when the toner amount at the slack portion V has varied is lower than with the example 5. As a result, it can be conceived that the toner deterioration is advanced, or the even charge applicability to the toner is decreased, thus a slight positive ghost occurs.

Next, the difference between a holding method of the regulation member and a forming method for the contact pressure local maximum value with the pressure distribution within the contact nip will be described by comparing the example 5 and example 8. With the example 8, the positive ghost when increasing printing sheet count is somewhat poor as compared to the example 5. The reason for this may be that the deformation of the slack portion V is fairly fixed at the initial state. That is to say, with the example 8, a shape is stored at the sheet-shaped flexible member beforehand, and the slack portion V is formed in a state without making contact with the developing sleeve 141. Therefore, at the initial state, the advantages similar to the example 5 can be obtained. However, since the increase of local pressure at the slack portion V occur irregularly when increasing printing sheet count, performing dispersion of continual pressure becomes difficult. As a result, with the example 8, the advantages of suppressing the positive ghost when increasing printing sheet count may be somewhat less than the example 5. On the other hand, with the example 5, the slack portion V is formed by buckling the sheet-shaped regulation member. Thus, the deformation of the slack portion V can be maintained over time. As a result, pressure dispersion can be performed continually corresponding to the irregular local pressure increase of the slack portion V when increasing printing sheet count. Accordingly, with the example 5, toner deterioration when increasing printing sheet count and position ghost can be significantly suppressed.

Now, when reducing the size of the apparatus, accompanying the decrease in contact stability of the regulation member as to the developing sleeve, the toner coat state (charge amount, toner layer thickness, and so forth) readily becomes unstable. Conversely, according to the present example, as described regarding the mechanism for longitudinal concentration unevenness suppression when increasing printing sheet count, high contact stability is maintained even when reducing the size of the apparatus. As a result, even when reducing the size of the apparatus, the ghost can be suppressed in a stable manner temporally.

As described above, according to the present example, there are multiple contact pressure local maximum values in the pressure distribution within the contact nip wherein the developing sleeve 141 and regulation member make contact, thus the number of times for applying frictional charge to the toner increases, and the charge applicability as to the toner increases. Therefore, in a state wherein the number of printed sheets is a small number following setting the cartridge, that is to say, even in a state wherein there is a very large amount of toner with a low charge amount within the developer container 145, predetermined charge amount can be applied to the toner. Therefore, an initial negative ghost can be suppressed significantly.

Also, there are multiple contact pressure local maximum values in the pressure distribution within the contact nip wherein the developing sleeve 141 and regulation member make contact, thus the number of times that the regulation force acts on the toner increases. Thus, switchability and scrapability of the toner increases. Particularly, with the regulation unit regulated by the upstream local maximum value in the surface movement direction of the developing sleeve 141, the shape for taking in toner is large, so switchability of the toner newly supplied from the developer container 145 and the remaining developing toner improves. With the regulation unit regulated by the downstream local maximum value in the surface movement direction of the developing sleeve 141, regulation force can be applied in the state of the toner amount being regulated beforehand. Therefore, even if the toner having an excessive charge amount is strongly adhered to the surface of the developing sleeve 141, this can be scraped off.

Also, the toner can be smoothly accumulated as in a whirl, by the slack portion V between the contact pressure local maximum values of the pressure distribution within the contact nip and the regulation force from the downstream local maximum value in the surface movement direction of the developing sleeve 141. Thus, appropriate charge application can be made evenly as to the toner. In other words, toner with excessive charge or toner with insufficient charge can be significantly suppressed.

Also, by employing a flexible member as the regulation member, local pressure increase when the toner amount varies in the slack portion V within the contact nip can be prevented. Also, the toner can be smoothly accumulated as in a whirl at the slack portion V, by having a magnetic pole of the magnet roll 142 outside the contact nip, thus enabling preventing toner deterioration significantly. As a result, broadening of the toner charge distribution from toner deterioration, i.e. the occurrence of toner having excess charge and toner with insufficient charge can be significantly suppressed. Accordingly, according to the present example, positive ghosting when increasing the printing sheet count can be significantly suppressed.

Also, in order to significantly suppress local pressure increases when the toner amount at the slack portion V within the contact nip varies, the magnetic pole position of the magnet roll 142 should be set as follows. That is to say, the peak magnetic flux density downstream of the contact nip, outside the contact nip, in the surface movement direction of the developing sleeve 141, should be set.

Also, employing a sheet-shaped member having edges is desirable to serve as a regulation member. This is so that, since the regulation member is not readily restricted in the distorted direction, local pressure increases when the toner amount at the slack portion V within the contact nip varies can be significantly suppressed, or that an even charge applicability can be obtained.

Further, in order to prevent irregular pressure increase of the contact nip, forming the slack portion V using the buckling of the sheet-shaped regulation member is more desirable.

With the above advantages, according to the present example, the initial negative ghost and the positive ghost when increasing printing sheet count can be significantly suppressed. That is to say, according to the present embodiment, a negative ghost in a state wherein the initial toner charge amount within the developer container 145 is low, and a positive ghost when increasing the printing sheet count in the event of excess charge amount occurring or the toner charge amount distribution broadens, can be suppressed. Accordingly, with the present example, a ghost image reflecting developing history can be temporally suppressed.

Particularly, according to the present example, the above-described advantages can be obtained even when the apparatus size is reduced and the toner coat state and contact state are likely to be unstable.

Note that with the above-described example, the developing apparatus has been described particularly as a developing apparatus of a magnetic monocomponent non-contact developing method which performs developing in a state wherein the developer bearing member and image bearing member are not in contact with one another. As described above, the developing apparatus with a magnetic monocomponent non-contact developing method, wherein the member sliding the developer bearing member is actually only a regulation member, can be employed in the present invention. However, the present invention should not be limited to this, and can be applied to a developing apparatus with a method for developing by employing a magnetic monocomponent developer and allowing the developer bearing member to make contact with the image bearing member, and thus obtain similar advantages to those described above.

According to the present invention, the developer amount regulation member is an effort for improving balanced functionality as to cost, adverse effects, and image concentration unevenness when reducing the size of the apparatus, compared to the developer amount regulation members used till now.

According to the present invention, a developing apparatus of a reduced size compared to current technology can be made, as well as assembly being improved from simple configurations. Also, developing with a developer bearing amount which is stable over a long period of time as to a developer bearing member has become possible.

The developer amount regulation member according to the present invention does not require a high degree of precision in the assembly thereof, even when reducing the size of the apparatus. The reason may be as follows. With regard to increase in the push-in amount of the developer bearing member as to the developer amount regulation member, there is a region wherein the local maximum values of both contact pressures do not change proportionately. Thus, a desired contact pressure local maximum value can be set in a stable manner, thus a high degree of precision is not required at time of assembly.

Also with the present invention, the contact portion between the developer amount regulation member and the developer bearing member form a state of being in contact to the two points of the upstream side and downstream side as to the rotation direction of the developer bearing member as a result of the developer bearing member being pushed in to make contact. Therefore, a continually stable contact state can be realized even with a simple assembly.

Also the image concentration unevenness in the longitudinal direction of the developer bearing member after the endurance test of the apparatus can be effectively suppressed by the following reasons. With the developer amount regulation member according to the present invention, there is a region wherein the contact pressure local maximum value of the contact between the developer amount regulation member and developer bearing member does not increase as to the push-in amount of the developing bearing member. Therefore, limiting to use within the range of this region, scattered push-in amounts of the developer bearing member as to the developer amount regulation member across the entire longitudinal direction can be absorbed, and even after the endurance test, longitudinal concentration unevenness of the solid black image can be suppressed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. A developing apparatus comprising:

a developer bearing member configured to bear a developer for developing an electrostatic image formed on an image bearing member; and a developer amount regulating device configured to regulate an amount of the developer carried by the developer bearing member, wherein the developer amount regulating device includes:

a flexible developer amount regulating member including a pressing portion configured to contact and press the developer bearing member;

a holding member configured to hold the developer amount regulating member in a curvature shape in which the developer amount regulating member forms a convex shape toward the developer bearing member in a state that the developer amount regulating member is not in contact with the developer bearing member;

a portion, disposed in the holding member, which an end face of each end of the developer amount regulating member in a shorter direction comes into contact with when the developer amount regulating member is pressed against the developer bearing member; and a supporting portion disposed in the holding member and configured to prevent the each end from spreading by contacting a surface where the pressing portion in the developer amount regulating member is provided, wherein the developer amount regulating member is held by the holding member by contact pressure of the surface where the pressing portion is provided against the when the developer amount regulating member is pressed against the developer bearing member; and a supporting portion disposed in the holding member and configured to prevent the each end from spreading by contacting a surface where the pressing portion in the developer amount regulating member is provided, wherein the developer amount regulating member is held by the holding member by contact pressure of the surface where the pressing portion is provided against the supporting portion due to a restoration force generated by the developer amount regulating member trying to revert from a bended shape, wherein the developer amount regulating device deforms the developer amount regulating member by pressing the developer amount regulating member against the developer bearing member so that pressure distribution includes two maximum values in a rotation direction of the developer bearing member in the pressing portion, and wherein the holding member includes a concave portion, the portion where the end face contacts is a bottom face of the concave portion, and the supporting portion is a side face of the concave portion.

2. A cartridge detachable from a main assembly of an image forming apparatus, the cartridge comprising:

a developer bearing member configured to bear a developer for developing an electrostatic image formed on an image bearing member; and a developer amount regulating device configured to regulate an amount of the developer carried by the developer bearing member, wherein the developer amount regulating device includes:

a flexible developer amount regulating member including a pressing portion configured to contact and press the developer bearing member;

a holding member configured to hold the developer amount regulating member in a curvature shape in which the developer amount regulating member forms a convex shape toward the developer bearing member in a state that the developer amount regulating member is not in contact with the developer bearing member;

a portion, disposed in the holding member, which an end face of each end of the developer amount regulating member in a shorter direction comes into contact with that the developer amount regulating member is not in contact with the developer bearing member, wherein the supporting portion of the holding member prevents each end of the developer amount regulating member from spreading by contacting a surface where the pressing portion in the developer amount regulating member is provided, wherein the developer amount regulating member is held by the holding member by contact pressure of the surface where the pressing portion is provided against the supporting portion due to a restoration force generated by the developer amount regulating member trying to revert from a bended shape, and wherein the developer amount regulating device deforms the developer amount regulating member by pressing the developer amount regulating member against the developer bearing member so that pressure distribution includes two maximum values in a rotation direction of the developer bearing member in the pressing portion, in a state that an end face of the each end of the developer amount regulating member in a shorter direction contacts with the holding member.

3. A developing apparatus comprising:

a developer bearing member configured to bear a developer for developing an electrostatic image formed on an image bearing member; and a developer amount regulating device configured to regulate an amount of the developer carried by the developer bearing member, wherein the developer amount regulating device includes:

a developer amount regulating member including a pressing portion configured to contact and press the developer bearing member; and a holding member, including a supporting portion, configured to hold the developer amount regulating member in a curvature shape in which the developer amount regulating member forms a convex shape toward the developer bearing member in a state supporting portion due to a restoration force generated by the developer amount regulating member trying to revert from a bended shape, wherein the developer amount regulating device deforms the developer amount regulating member by pressing the developer amount regulating member against the developer bearing member so that pressure distribution includes two maximum values in a rotation direction of the developer bearing member in the pressing portion, and wherein the holding member includes a concave portion, the portion where the end face contacts is a bottom face of the concave portion, and the supporting portion is a side face of the concave portion.

4. The developing apparatus according to claim 3, wherein the holding member includes a concave portion, and the end face of the developer amount regulating member contacts with the holding member at a bottom face of the concave portion, and the developer amount regulating member contacts with the supporting portion of the holding member at a side face of the concave portion.

5. A cartridge detachable from a main assembly of an image forming apparatus, the cartridge comprising:

a developer bearing member configured to bear for developing an electrostatic image formed on an image bearing member; and a developer amount regulating device configured to regulate an amount of the developer carried by the developer bearing member, wherein the developer amount regulating device includes:

a developer amount regulating member including a pressing portion configured to contact and press the developer bearing member; and a holding member, including a supporting portion, configured to hold the developer amount regulating member in a curvature shape in which the developer amount regulating member forms a convex shape toward the developer bearing member in a state that the developer amount regulating member is not in contact with the developer bearing member, wherein the supporting portion of the holding member prevents each end of the developer amount regulating member from spreading by contacting a surface where the pressing portion in the developer amount regulating member is provided, wherein the developer amount regulating member is held by the holding member by contact pressure of the surface where the pressing portion is provided against the supporting portion due to a restoration force generated by the developer amount regulating member trying to revert from a bended shape, and wherein the developer amount regulating device deforms the developer amount regulating member by pressing the developer amount regulating member against the developer bearing member so that pressure distribution includes two maximum values in a rotation direction of the developer bearing member in the pressing portion, in a state that an end face of the each end of the developer amount regulating member in a shorter direction contacts with the holding member.

6. The cartridge according to claim 5, wherein the holding member includes a concave portion, and the end face of the developer amount regulating member contacts with the holding member at a bottom face of the concave portion, and the developer amount regulating member contacts with the supporting portion of the holding member at a side face of the concave portion.

7. An apparatus comprising:

a developer bearing member configured to bear a developer for developing an electrostatic image formed on an image bearing member; and a developer amount regulating device configured to regulate an amount of the developer carried by the developer bearing member, wherein the developer amount regulating device includes:

a developer amount regulation member configured to contact the developer bearing member; and a concave holding member, including a supporting portion, configured to hold the developer amount regulation member in a convex curvature shape in a state that the developer amount regulating member is not in contact with the developer bearing member, wherein the supporting portion of the holding member prevents each end of the developer amount regulating member from spreading, wherein the developer amount regulating member is held inside of the concave holding member, and wherein the developer amount regulating device deforms the developer amount regulating member by pressing the developer amount regulating member against the developer bearing member so that pressure distribution includes two maximum values in a rotation direction of the developer bearing member.

* * * * *